US011491375B2

(12) United States Patent
Henrikson et al.

(10) Patent No.: US 11,491,375 B2
(45) **Date of Patent: *Nov. 8, 2022**

(54) GOLF CLUB HEADS WITH TURBULATORS AND METHODS TO MANUFACTURE GOLF CLUB HEADS WITH TURBULATORS

(71) Applicant: Karsten Manufacturing Corporation, Phoenix, AZ (US)

(72) Inventors: Erik M. Henrikson, Phoenix, AZ (US); Paul D. Wood, Phoenix, AZ (US); John Hart, Shefield (GB); Marty R. Jertson, Phoenix, AZ (US); Ryan M. Stokke, Anthem, AZ (US); Xiaojian Chen, Phoenix, AZ (US)

(73) Assignee: Karsten Manufacturing Coperation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/543,356

(22) Filed: Aug. 16, 2019

(65) Prior Publication Data

US 2019/0366169 A1 Dec. 5, 2019

Related U.S. Application Data

(63) Continuation of application No. 16/104,835, filed on Aug. 17, 2018, now Pat. No. 10,413,788, which is a (Continued)

(51) Int. Cl.

| | |
|---|---|
| ***A63B 53/04*** | (2015.01) |
| ***A63B 60/52*** | (2015.01) |
| ***A63B 60/00*** | (2015.01) |

(52) U.S. Cl.
CPC ..... *A63B 53/0466* (2013.01); *A63B 53/04* (2013.01); *A63B 60/52* (2015.10); (Continued)

(58) Field of Classification Search
CPC ..... A63B 53/0466; A63B 60/52; A63B 53/04; A63B 53/047; A63B 2225/01; (Continued)

(56) References Cited

U.S. PATENT DOCUMENTS

| | | | |
|---|---|---|---|
| D192,515 | S | 4/1962 | Henrich |
| 3,997,170 | A | 12/1976 | Goldberg |

(Continued)

FOREIGN PATENT DOCUMENTS

| | | |
|---|---|---|
| JP | H03114477 | 5/1991 |
| JP | H04327864 | 11/1992 |
| JP | S52538 | 1/1997 |

OTHER PUBLICATIONS

Taylormade Golf—R11s Fairway, (2012), at http://www.taylormadegolf.com/products/fairways/R11s-fairway.

(Continued)

*Primary Examiner* — Sebastiano Passaniti

(57) ABSTRACT

A golf club head including a face defining a loft plane, a rear, and a crown, the crown having a turbulator comprising a plurality of ridges. Each ridge includes a front surface having a first end nearest the face, a second end nearest the ridge apex, and a rear surface nearest the rear portion of the club head. The turbulator is positioned in a forward two-fifths portion of the crown in a front end to a rear end direction. The ridge apex of each ridge is positioned within the first 50% of the ridge length.

20 Claims, 34 Drawing Sheets

Related U.S. Application Data continuation-in-part of application No. 15/656,340, filed on Jul. 21, 2017, now Pat. No. 10,232,232, which is a continuation-in-part of application No. 15/354,697, filed on Nov. 17, 2016, now Pat. No. 10,300,349, which is a continuation of application No. 14/710,420, filed on May 12, 2015, now Pat. No. 9,555,294, which is a continuation of application No. 14/093,967, filed on Dec. 2, 2013, now Pat. No. 9,168,432, which is a continuation-in-part of application No. 13/536,753, filed on Jun. 28, 2012, now Pat. No. 8,608,587, said application No. 14/710,420 is a continuation-in-part of application No. 13/536,753, filed on Jun. 28, 2012, now Pat. No. 8,608,587.

(60) Provisional application No. 62/547,524, filed on Aug. 18, 2017, provisional application No. 62/517,104, filed on Jun. 8, 2017, provisional application No. 62/515,363, filed on Jun. 5, 2017, provisional application No. 62/365,911, filed on Jul. 22, 2016, provisional application No. 61/775,982, filed on Mar. 11, 2013, provisional application No. 61/651,392, filed on May 24, 2012, provisional application No. 61/553,428, filed on Oct. 31, 2011.

(52) U.S. Cl.
CPC ..... *A63B 53/047* (2013.01); *A63B 53/0408* (2020.08); *A63B 53/0412* (2020.08); *A63B 53/0433* (2020.08); *A63B 53/0437* (2020.08); *A63B 53/0487* (2013.01); *A63B 60/002* (2020.08); *A63B 60/006* (2020.08); *A63B 2225/01* (2013.01); *Y10T 29/49* (2015.01); *Y10T 29/49826* (2015.01)

(58) Field of Classification Search
CPC ..... A63B 53/0487; A63B 53/0408; A63B 53/0412; A63B 53/0433; A63B 53/0437; A63B 60/002; A63B 60/006
USPC ..... 473/324–350, 287–292
See application file for complete search history.

(56) References Cited

U.S. PATENT DOCUMENTS

| | | | | |
|---|---|---|---|---|
| 4,065,133 | A | 12/1977 | Gordos | |
| 4,077,633 | A | 3/1978 | Studen | |
| 4,139,196 | A | 2/1979 | Riley | |
| 4,754,974 | A | 7/1988 | Kobayashi | |
| 4,930,783 | A | 6/1990 | Antonious | |
| 5,092,599 | A | 3/1992 | Okumoto et al. | |
| 5,141,230 | A * | 8/1992 | Antonious | A63B 53/04 473/327 |
| 5,190,289 | A | 3/1993 | Nagai et al. | |
| 5,193,810 | A | 3/1993 | Antonious | |
| 5,203,565 | A | 4/1993 | Murray et al. | |
| 5,213,328 | A | 5/1993 | Long et al. | |
| 5,213,329 | A | 5/1993 | Okumoto | |
| 5,221,086 | A | 6/1993 | Antonious | |
| 5,271,622 | A | 12/1993 | Rogerson | |
| D354,784 | S | 1/1995 | Long | |
| 5,441,263 | A | 8/1995 | Gorman | |
| 5,467,989 | A | 11/1995 | Good et al. | |
| 5,511,786 | A | 4/1996 | Antonious | |
| 5,533,728 | A | 7/1996 | Pehoski et al. | |
| D425,157 | S | 5/2000 | Reed et al. | |
| 6,074,308 | A | 6/2000 | Domas | |
| D434,820 | S | 12/2000 | Reed et al. | |
| 6,319,148 | B1 | 11/2001 | Tom | |
| 6,605,006 | B2 | 8/2003 | Mason | |
| 6,679,781 | B1 | 1/2004 | Green | |
| D549,792 | S | 8/2007 | Parise | |
| 7,258,625 | B2 | 8/2007 | Kawaguchi et al. | |
| 7,281,992 | B2 | 10/2007 | Tseng | |
| D584,783 | S | 1/2009 | Barez et al. | |
| 7,641,568 | B2 | 1/2010 | Hoffman et al. | |
| 7,988,565 | B2 | 8/2011 | Abe | |
| 8,162,775 | B2 | 4/2012 | Tavares et al. | |
| 8,360,900 | B2 | 1/2013 | Snyder | |
| 8,366,565 | B2 | 2/2013 | Tavares et al. | |
| 8,556,742 | B2 | 10/2013 | Stites | |
| 8,608,587 | B2 | 12/2013 | Henrikson et al. | |
| 8,753,224 | B1 | 6/2014 | Kim | |
| 8,777,773 | B2 * | 7/2014 | Burnett | A63B 53/0466 473/327 |
| 8,864,601 | B1 | 10/2014 | Ehlers | |
| 9,168,432 | B2 | 10/2015 | Henrikson et al. | |
| 9,393,465 | B2 * | 7/2016 | Stokke | A63B 53/0466 |
| 9,555,294 | B2 | 1/2017 | Henrikson et al. | |
| 9,776,056 | B2 * | 10/2017 | Stokke | A63B 53/0466 |
| 9,925,430 | B2 * | 3/2018 | Stokke | A63B 53/0466 |
| 9,975,010 | B2 * | 5/2018 | Saso | A63B 53/0466 |
| 10,195,499 | B2 * | 2/2019 | Stokke | A63B 53/0466 |
| 10,232,232 | B2 * | 3/2019 | Henrikson | A63B 53/04 |
| 10,258,838 | B2 * | 4/2019 | Stokke | A63B 53/0466 |
| 10,300,349 | B2 * | 5/2019 | Henrikson | A63B 53/04 |
| 10,413,788 | B2 * | 9/2019 | Henrikson | A63B 60/52 |
| 10,449,427 | B2 * | 10/2019 | Stokke | A63B 53/0466 |
| 10,543,408 | B2 * | 1/2020 | Henrikson | A63B 53/0466 |
| 10,695,625 | B2 * | 6/2020 | Henrikson | A63B 53/04 |
| 2002/0077195 | A1 | 6/2002 | Carr et al. | |
| 2003/0220154 | A1 | 11/2003 | Anelli et al. | |
| 2005/0049073 | A1 | 3/2005 | Herber | |
| 2010/0009771 | A1 | 1/2010 | Newcomer | |
| 2010/0016095 | A1 | 1/2010 | Burnett et al. | |
| 2015/0238826 | A1 | 8/2015 | Llewellyn et al. | |
| 2016/0213985 | A1 * | 7/2016 | Jertson | A63B 53/0466 |
| 2018/0111025 | A1 * | 4/2018 | Vrska, Jr. | A63B 53/0466 |

OTHER PUBLICATIONS

International Search Report from the Corresponding PCT Application No. PCT/US2012/045380, filed Jul. 3, 2012, dated Feb. 1, 2013.

* cited by examiner

Fig. 21
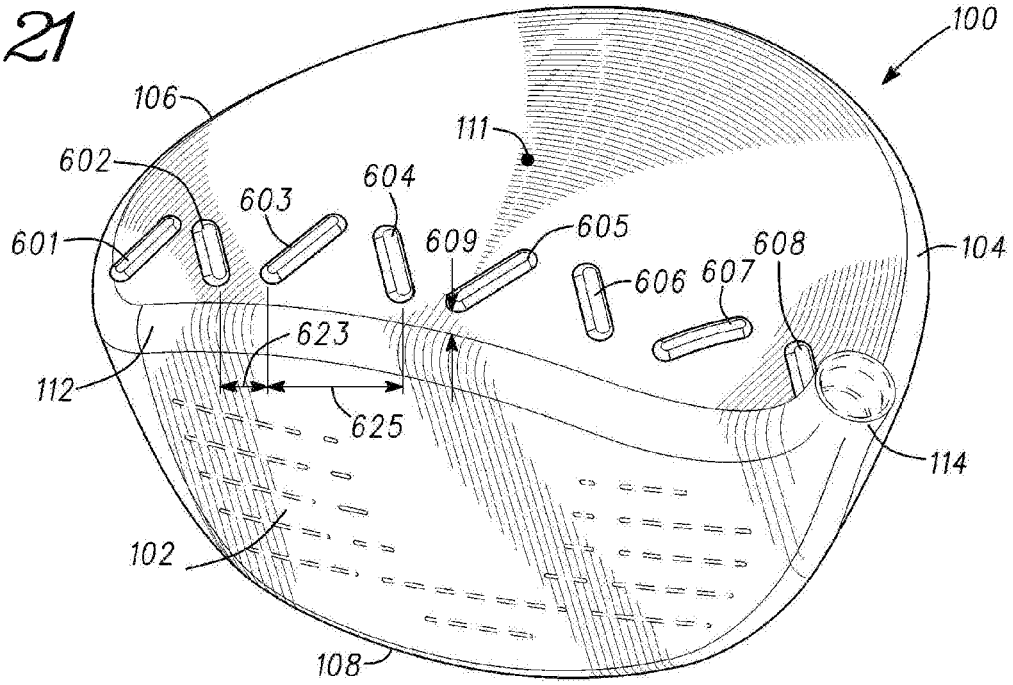
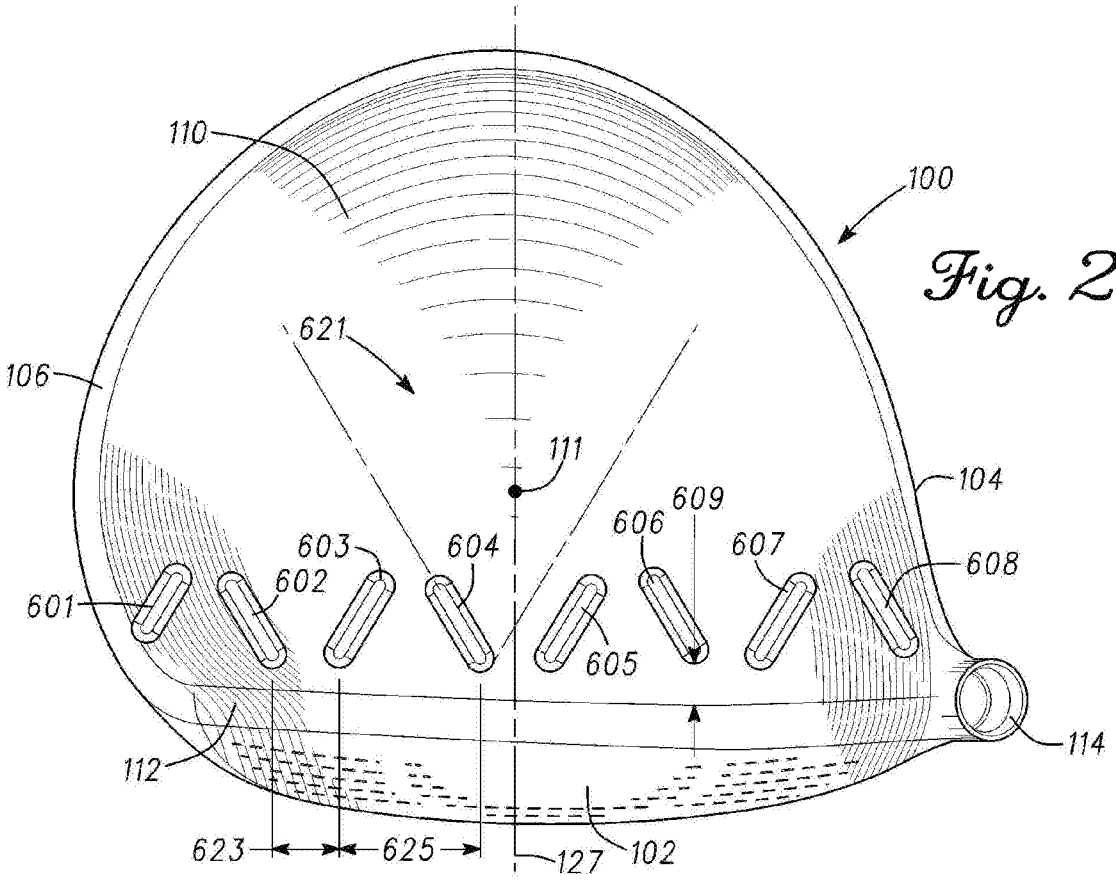
Fig. 22

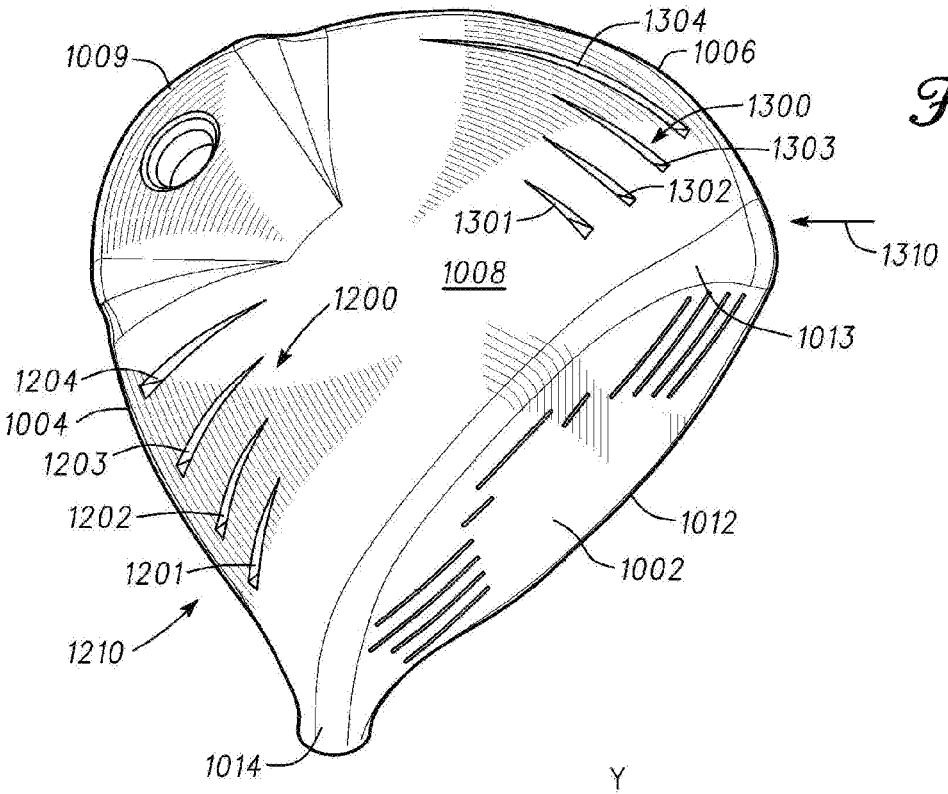
Fig. 36
Fig. 37
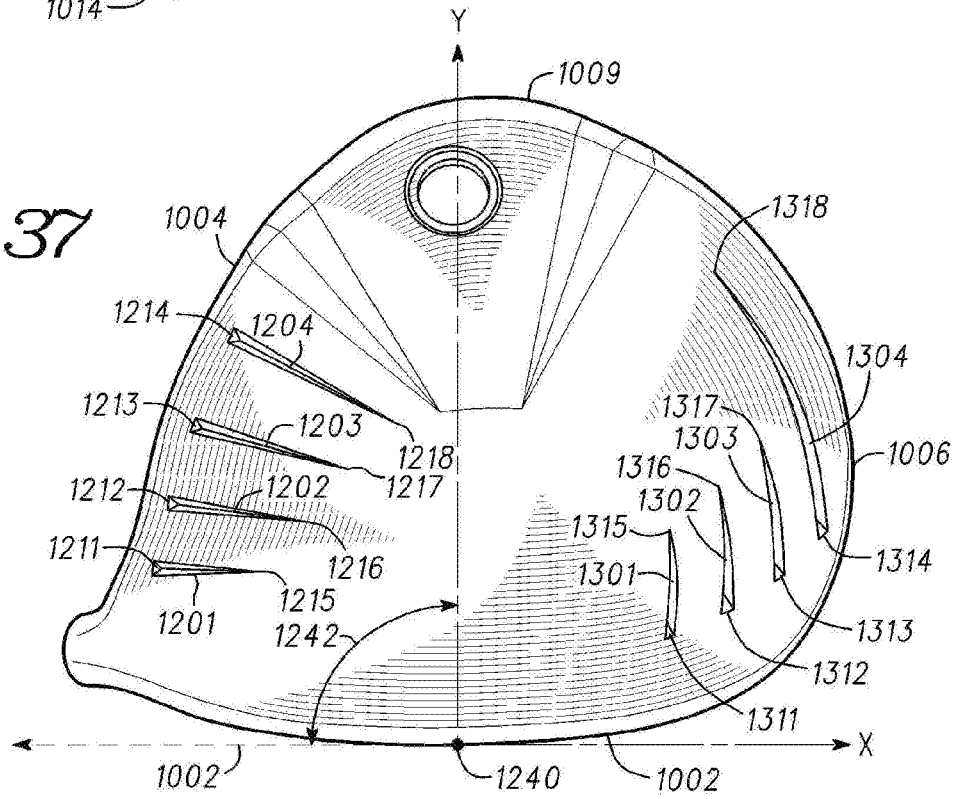

GOLF CLUB HEADS WITH TURBULATORS AND METHODS TO MANUFACTURE GOLF CLUB HEADS WITH TURBULATORS

CROSS REFERENCE TO RELATED APPLICATION

This is a continuation of U.S. patent application Ser. No. 16/104,835, filed on Aug. 17, 2018, which claims the benefit of U.S. Provisional Application No. 62/547,524, filed Aug. 18, 2017, and is a continuation-in-part of U.S. patent application Ser. No. 15/656,340, filed Jul. 21, 2017, now U.S. Pat. No. 10,232,232, which claims the benefit of U.S. Provisional Application No. 62/517,104, filed Jun. 6, 2017, U.S. Provisional Application No. 62/515,363, filed Jun. 5, 2017, and U.S. Provisional Application No. 62/365,911, filed Jul. 22, 2016, which is also a continuation in part of U.S. patent application Ser. No. 15/354,697, filed Nov. 17, 2016, which is a continuation of U.S. patent application Ser. No. 14/710,420, filed on May 12, 2015, now U.S. Pat. No. 9,555,294, which is a continuation of U.S. patent application Ser. No. 14/093,967, filed on Dec. 2, 2013, now U.S. Pat. No. 9,168,432, which claims the benefit of U.S. Provisional Patent Application No. 61/775,982, filed on Mar. 11, 2013; U.S. patent application Ser. No. 14/093,967 is also a continuation in part of U.S. patent application Ser. No. 13/536,753, filed on Jun. 28, 2012, now U.S. Pat. No. 8,608,587; U.S. patent application Ser. No. 14/710,420 is also a continuation in part of U.S. patent application Ser. No. 13/536,753, filed on Jun. 28, 2012, now U.S. Pat. No. 8,608,587, which claims the benefit of U.S. Provisional Patent Application No. 61/651,392, filed on May 24, 2012, and U.S. Provisional Patent Application No. 61/553,428, filed on Oct. 31, 2011, the contents of all of which are incorporated fully herein by reference.

FIELD

The present application generally relates to golf clubs, and more particularly, to golf club heads with turbulators and methods to manufacture golf club heads with turbulators.

BACKGROUND

When air flows over a golf club head, viscous forces near the surface of the club head create a velocity gradient from the surface to the free stream region. Accordingly, air flow velocity near the surface may be relatively slow and gradually increases toward the free stream velocity, which is the air flow region where air velocity is not influenced by the club head. This velocity gradient region is called a boundary layer. Flow separation occurs when the boundary layer travels on the golf club head far enough against an adverse pressure gradient that the air flow velocity in the boundary layer relative to the surface of the club head falls almost to zero. The air flow becomes detached from the surface of the club head and takes the form of eddies and vortices. Flow separation may result in increased drag, which may be caused by the pressure differential between the front and rear surfaces of the club head. The increased drag may reduce the speed of the club head, which in turn may lower the velocity of a golf ball that is struck by the club head.

BRIEF DESCRIPTION OF THE DRAWINGS

FIGS. 21 and 22 are perspective views of a club head having a turbulator according to one embodiment.

FIGS. 35-38 are different perspective views of a club head having sole turbulators according to one embodiment.

DETAILED DESCRIPTION

Described herein is a golf club head comprising a turbulator including a plurality of ridges to trip the air flow on the crown to create turbulence within the boundary layer. The turbulence energizes the boundary layer to delay the separation of the air flow on the crown and move the separation region toward the aft region of the crown. This movement of the separation region toward the aft region of the crown reduces the drag force during golf club swings. In many embodiments, each ridge of the plurality of ridges comprises a front surface, a top surface, a rear surface, and a ridge apex defined as a maximum height of the ridge measured in a direction perpendicular from the base of the ridge. Each ridge of the plurality of ridges of the turbulator comprises multiple planar surfaces and a ridge apex positioned further back from the leading edge compared to previous turbulator embodiments to delay the trip of air flow on the crown to reduce the drag force during golf club swings.

Figure 1:
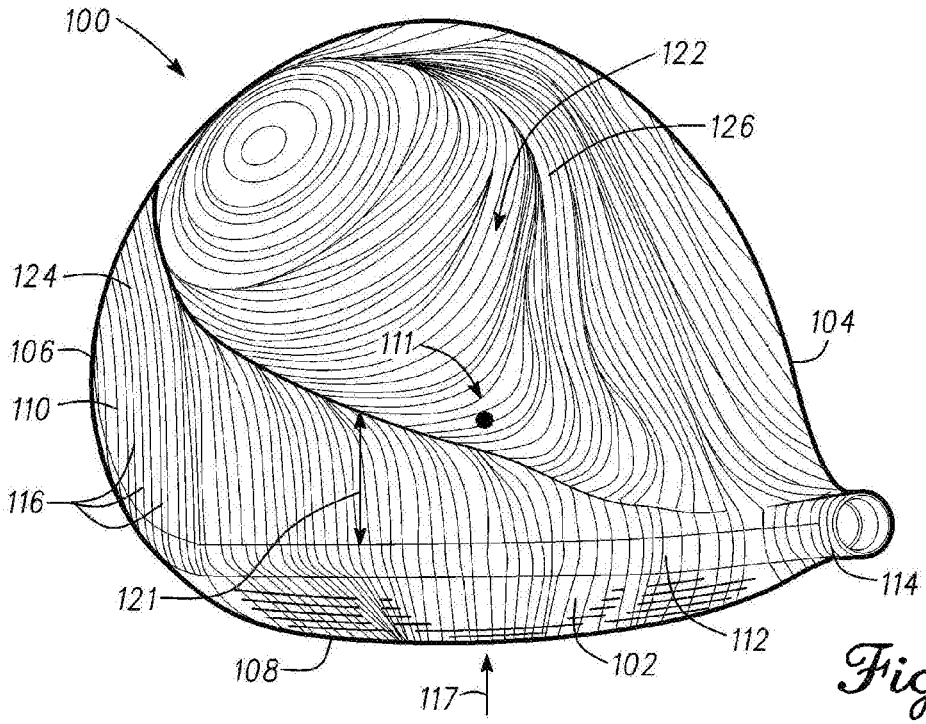
FIG. 1 is a top perspective view of a club head showing air flow streamlines on the club head.

Referring to FIG. 1, a golf club head 100 is shown, which includes a face 102 that extends horizontally from a heel end 104 to a toe end 106 and vertically from a sole 108 to a crown 110. A transition region between the face 102 and the crown 110 defines a leading edge 112. The highest point on the crown 110 defines an apex 111. The club head 100 also includes a hosel 114 for receiving a shaft (not shown). The club head 100 is a wood-type club head. However, the present disclosure is not limited to wood-type club heads and applies to any type of golf club head (e.g., a driver-type club head, a fairway wood-type club head, a hybrid-type club head, an iron-type club head, a wedge-type club head, or a putter-type club head). The apparatus, methods, and articles of manufacture described herein are not limited in this regard.

FIG. 1 shows an exemplary air flow pattern on the club head 100 with streamlines 116. Air flowing in the direction of the arrow 117 flows over the crown 110 from the leading edge 112 toward the rear section of the crown 110. The airflow may remain attached to the crown 110 from the leading edge 112 to a separation region 120 located at a certain separation distance 121 from the leading edge 112. The separation may occur in a narrow strip on the crown 110, hence the separation region 120 may also be referred to herein as a separation line 120. As shown in FIG. 1, the distance 121 may vary from the heel end 104 to the toe end 106 depending on the physical characteristics of the club head 100. At the separation region 120, the airflow detaches from the crown 110 and creates a wake region 122, which is defined by the airflow becoming turbulent or forming eddies and vortices in the free stream region. The pressure differential between the wake region 122 and the attached flow region on the crown 110 creates a pressure drag on the club head 100. The pressure drag reduces the speed of the club head 100, hence affecting the speed by which a ball is hit with the club head 100. To maintain the air flow attached on the crown 110 for a longer distance 121, the air flow in the boundary layer before the separation region 120 can be energized to delay air flow detachment or to move the separation region 120 farther back on the crown 110. To energize the boundary layer, which may be laminar upstream of the separation region 120, the boundary layer can be made turbulent (or more turbulent if the flow is turbulent) upstream of the separation region 120.

Figure 2:
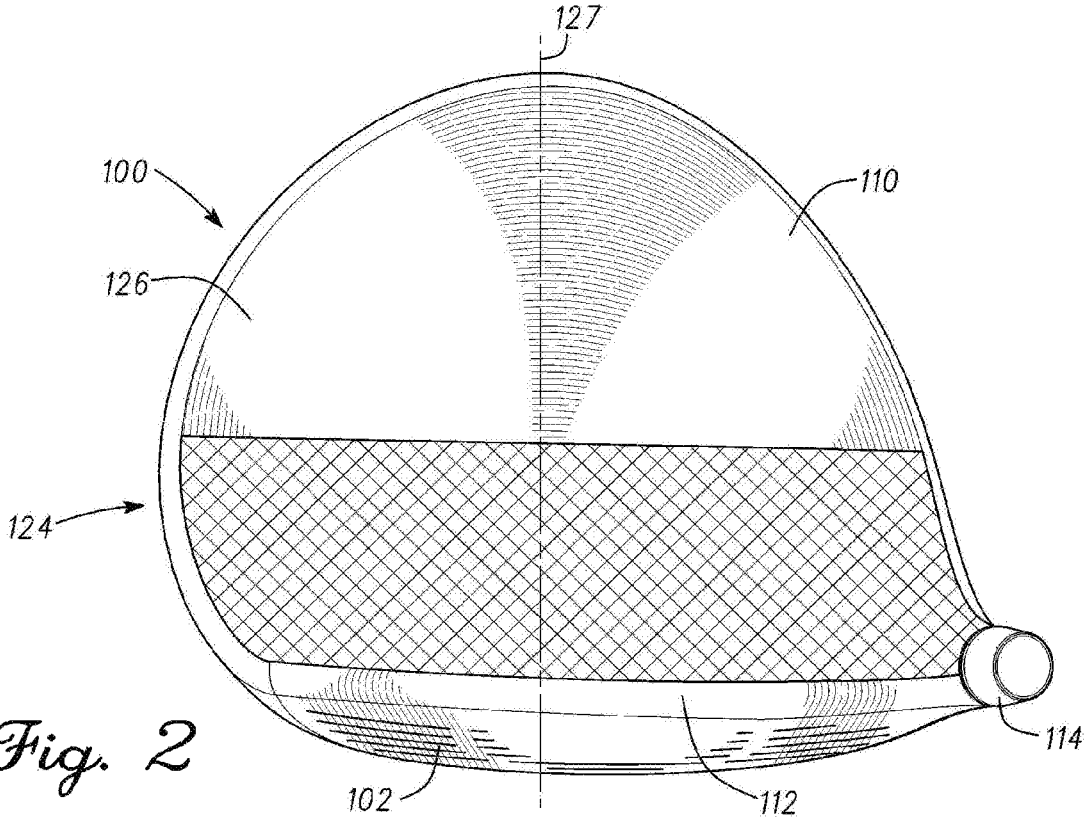
FIG. 2 is a top perspective view of a club head shown front and aft regions of a crown of the club head.
Figure 3:
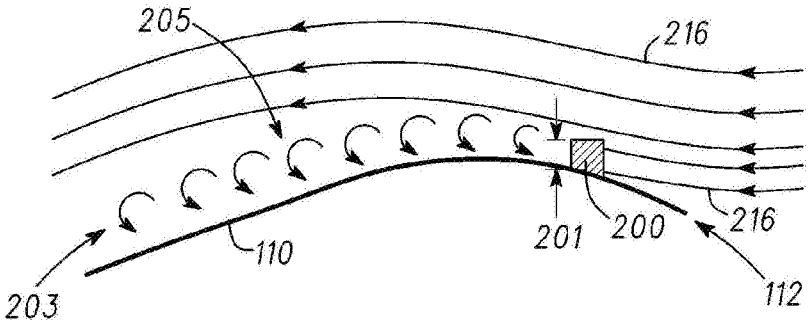
FIG. 3 is a schematic cross-sectional diagram of a turbulator according to one embodiment.

To delay air flow separation or detachment as described above, the golf club head 100 includes turbulators positioned on the crown 110 as described in detail below. Referring to FIG. 2, the turbulators may be positioned in the front region 124 of the crown 110 and before the separation region 120 to delay air flow separation or move the separation region 120 toward the rear region 126 of the crown 110. In some embodiments, the turbulators can be positioned (from a front end to rear end) within a front half of the crown 110. In other embodiments, the turbuators can be positioned (from the front end to rear end) on ⅓ of the crown, ¼ of the crown, ⅕ of the crown, or ⅖ of the crown. A schematic diagram of an exemplary turbulator 200 is shown in cross section in FIG. 3. The turbulator 200 projects upward from the crown 110 at a height 201 such that it is inside the boundary layer 203. The turbulator 200 trips the air flowing over the crown 110 as shown by the streamline 216 to create turbulence 205 inside the boundary layer 203. The turbulence energizes the boundary layer 203 to delay separation of the air flow on the crown 110 and move the separation region 120 toward the aft region 126 of the crown 110. In other words, the turbulators according to the disclosure increase the distance 121 shown in FIG. 1.

The turbulators can further be orientated at an angle relative to the club face 102, or leading edge 112, wherein the turbulartors do not parallel the contour of the club face 102. The turbulators can be orientated at an angle ranging from 20 degrees to 70 degrees. For example, the turbulators can have an angle of 20 degrees, 30 degrees, 40 degrees, 50 degrees, 60 degrees, or 70 degrees relative to the club face 102, or leading edge 112.

In some embodiments, the turbulators can be linear. In other embodiments, the turbulators can be curvilinear to any degree of curvature. In other embodiments, the turbulators can be linear and curvilinear. For example, the turbulators can be linear at one end, and begin to be curvilinear toward the other end.

Figure 4:
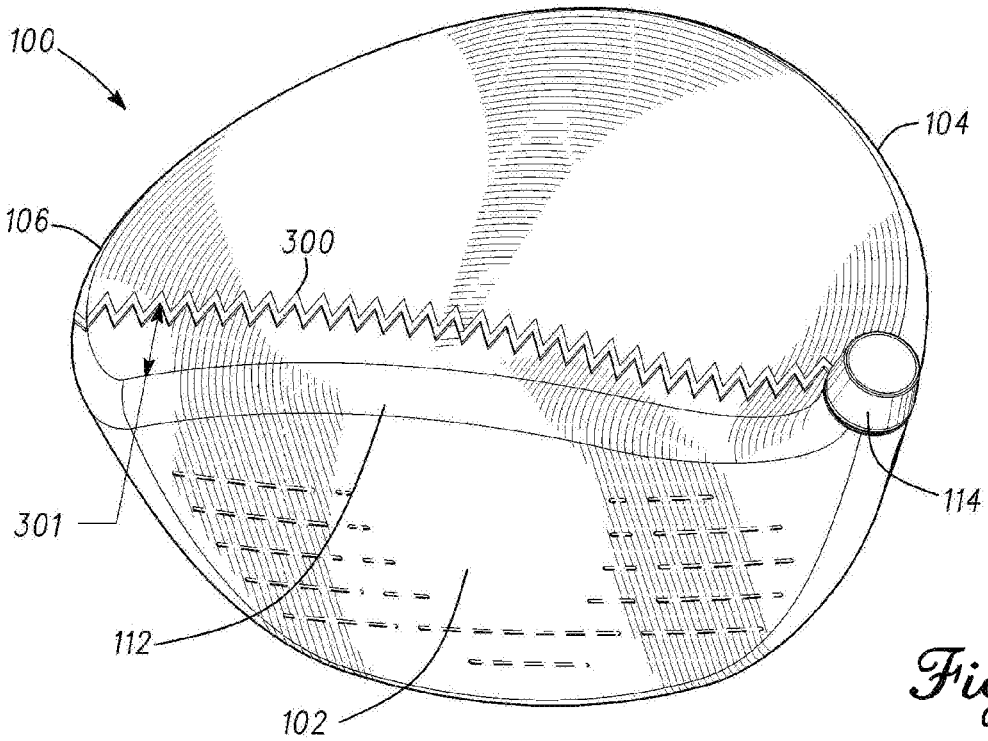
FIG. 4 is a perspective view of a club head having a turbulator according to one embodiment.

An example of a turbulator 300 is shown in FIG. 4. The turbulator 300 energizes the boundary layer on the crown 110 by generating turbulence in the boundary layer. The turbulator 300 is located on the crown 110 at a constant or variable distance 301 downstream of the leading edge 112 and may extend from the hosel 114 or the heel end 104 to the toe and 106. The turbulator 300 provides a plurality of projected surfaces in discrete or continuous form on the surface of the crown 110 at a height (not showing FIGS. 4-8, but generally shown with reference number 201 in FIG. 3). When the air flowing over the crown 110 encounters the projected surfaces of the turbulator 300, the air trips and becomes turbulent inside the boundary layer to energize the boundary layer.

Figure 5:
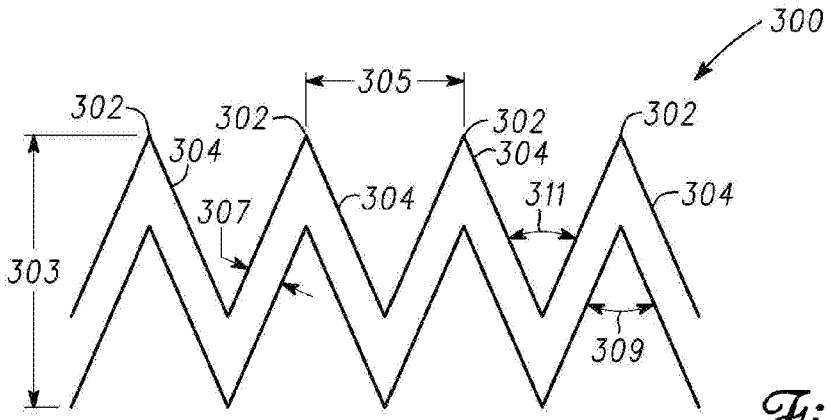
FIG. 5 is a schematic diagram of the turbulator of FIG. 4.
Figure 6:
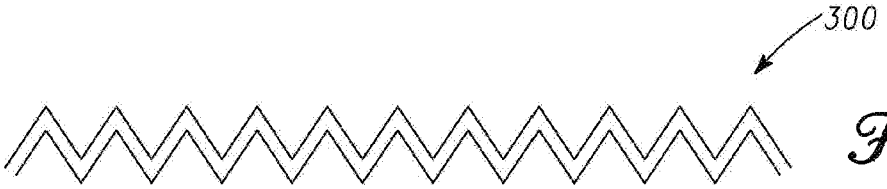
FIGS. 6-8 show examples of different turbulators according to the embodiment of FIG. 4.
Figure 7:
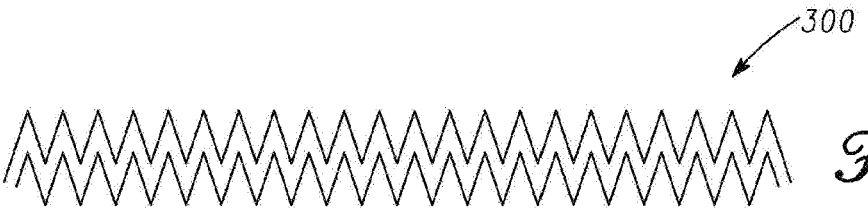
Figure 8:
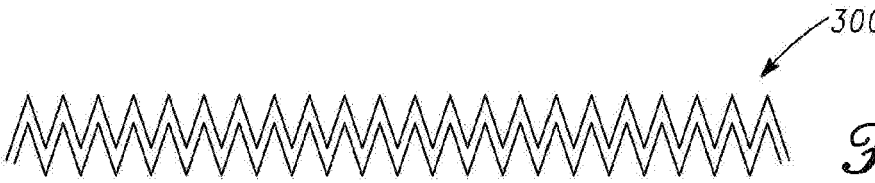

The turbulator 300 shown in the example of FIG. 4 is formed by a strip having a zigzag pattern. Referring to FIG. 5, the zigzag pattern provides peaks 302 and swept back surfaces 304. The peaks 302 and the swept back surfaces 304 provide continuous tripping of the air flow across the width 303 of the turbulator 300. The peaks 302 are spaced apart by a distance 305 and the turbulator 300 has a thickness 307, a height (not shown in FIGS. 4-8), and surface characteristics that may affect air flow. The peaks 302 are defined by a peak angle 309 and the angle between two adjacent peaks 302 is defined by a valley angle 311. Referring to FIGS. 6-8, the width 303, the distance 305, the thickness 307, the height and/or the angles 309 and 311 may be different for each application to provide a particular flow pattern over the crown 110. The surface characteristics of the turbulator 300 may also vary to provide a certain flow pattern over the crown 110. The surface characteristics of the turbulator 300 may refer to the roughness or smoothness of the top surface of the turbulator 300. In the examples of FIGS. 6-8, the turbulator 300 shown in FIG. 7 may provide greater turbulence in a boundary layer than the turbulator 300 of FIG. 6. Accordingly, the turbulator 300 of FIG. 7 may be suitable in a certain application depending on the physical characteristics of the club head 100. However, the turbulator 300 of FIG. 6 may be suitable for another type of club head 100. Accordingly, each of the exemplary turbulators 300 of FIGS. 6-8 may be suitable for different club heads 100.

The turbulator 300, for example, may have a height that does not exceed 0.5 inches (1.27 cm). In one embodiment, the turbulator 300 may have a height that is greater than 0.02 inches (0.05 cm) but less than 0.2 inches (0.51 cm). In one embodiment, the width 303 of the turbulator may be less than 0.75 inches (1.91 cm). The turbulator 300 may have a peak-to-peak distance 305 that contributes to the delay in airflow separation. The location of the turbulator 300 may vary depending on the physical characteristics of the club head 100 and the flow pattern on the crown 110. The turbulator 300 may be located on the crown 110 at an oblique angle relative to the club face 102 as shown in FIG. 4, or be parallel to the club face 102 between 0.25 inches (0.64 cm) and 4.5 inches (11.43 cm) from the club face 102. The turbulator 300 may be located in a curvilinear manner on the crown 110 based on the separation region 120 of a particular club head 100. In one embodiment, the turbulator 300 is located between the club face 102 and the apex 111 of the crown 110. Accordingly, the turbulator 300 may be located between the leading edge 112 and the apex 111 of the crown 110. The turbulator 300 may be located on the crown 110 such that the swept back surfaces 304 form an angle of between 20° and 70° degrees relative to the centerline 127 (shown in FIG. 2) of the club head 100.

Referring to FIG. 4, for example, the turbulator 300 may be a strip that extends from the heel end 104 to the toe end 106. Additionally, the distance 301 increases from the heel end 104 to the toe end 106. This increase in the distance 301 positions the turbulator to approximately follow the shape of the separation region 120 shown in FIG. 1. Alternatively, the turbulator 300 may be a curved strip (not shown) that substantially follows the shape of the separation region 120.

The width 303, the distance 305, the thickness 307, the height and/or the angles 309 and 311 may be constant along the length of the turbulator as shown in FIGS. 6-8. However, any one or all of noted parameters may vary along the turbulator 300 from the heel end 104 to the toe end 106 to provide a particular airflow effect. Furthermore, the surface characteristics of the turbulator 300 may be constant or vary along the turbulator 300 from the heel end 104 to the toe end 106. The turbulator 300 may have any pattern similar to the zigzag pattern described above or other patterns that can provide the boundary layer energizing function described above. Such patterns may include various geometric shapes such as square, rectangular, triangular, curved, circular, polygonal or other shapes in discrete or continuous configurations. The apparatus, methods, and articles of manufacture described herein are not limited in this regard.

The turbulator 300 is shown to be a continuous strip in FIG. 4. However, the turbulator 300 may be formed by a plurality of turbulator segments that are positioned on the crown 110 in different configurations relative to each other such as aligned, offset and/or tandem. For example, the turbulator 300 may include three discrete zigzag strips that are positioned at different distances 301 on the crown 110. Each of the discrete strips may have similar or different properties, such as similar or different height, width 303, the distance 305, the thickness 307, the angles 309 and/or 311.

The turbulator 300 may be constructed from any type of material, such as stainless steel, aluminum, titanium, various other metals or metal alloys, composite materials, natural materials such as wood or stone or artificial materials such as plastic. If the turbulator 300 is constructed from metal, it may be formed on the club head 100 or simultaneously with the club head 100 by stamping (i.e., punching using a machine press or a stamping press, blanking, embossing, bending, flanging, or coining, casting), injection molding, forging, machining or a combination thereof, or other processes used for manufacturing metal parts. With injection molding of metal or plastic materials, a one-piece or a multi-piece mold can be constructed which has interconnected cavities corresponding to the above-described parts of the club head 100 and/or the turbulator 300. Molten metal or plastic material is injected into the mold, which is then cooled. The club head 100 and/or the turbulator 300 is then removed from the mold and may be machined to smooth out irregularities on the surfaces thereof or to remove residual parts. If the turbulator 300 is manufactured separately from the club head 100, the turbulator 300 can be fixedly or removably attached to the crown 110 with fasteners, adhesive, welding, soldering, or other fastening methods and/or devices. In one example, the turbulator 300 may be formed from a strip of material having an adhesive backing. Accordingly, the turbulator 300 may be attached to the club head 100 at any location on the crown with the adhesive backing.

Figure 9:
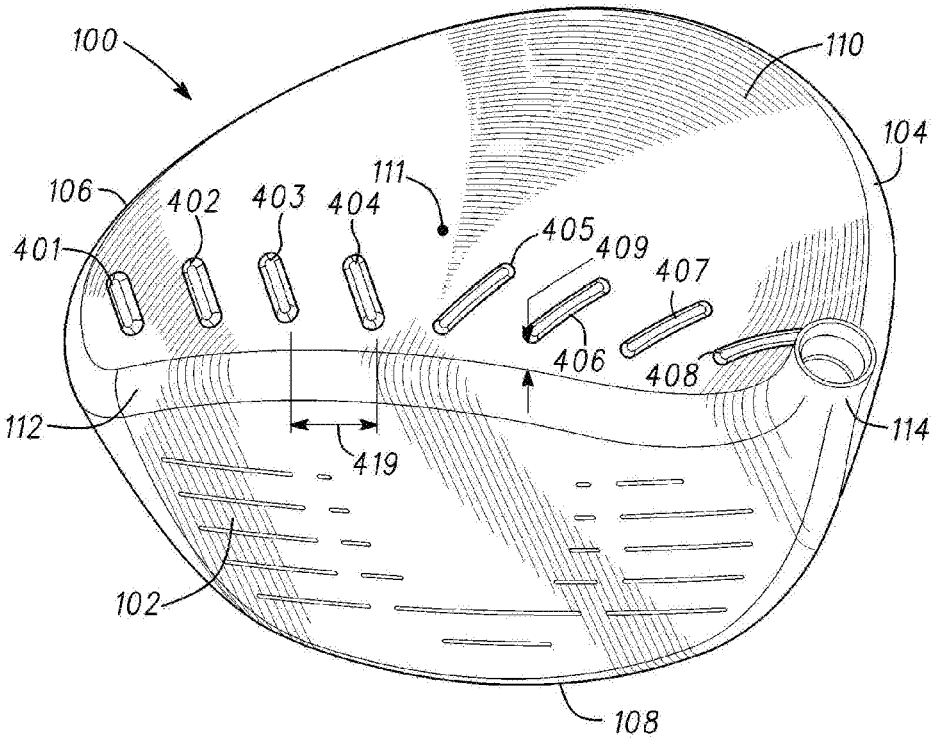
FIGS. 9 and 10 are perspective views of a club head having a turbulator according to one embodiment.
Figure 10:
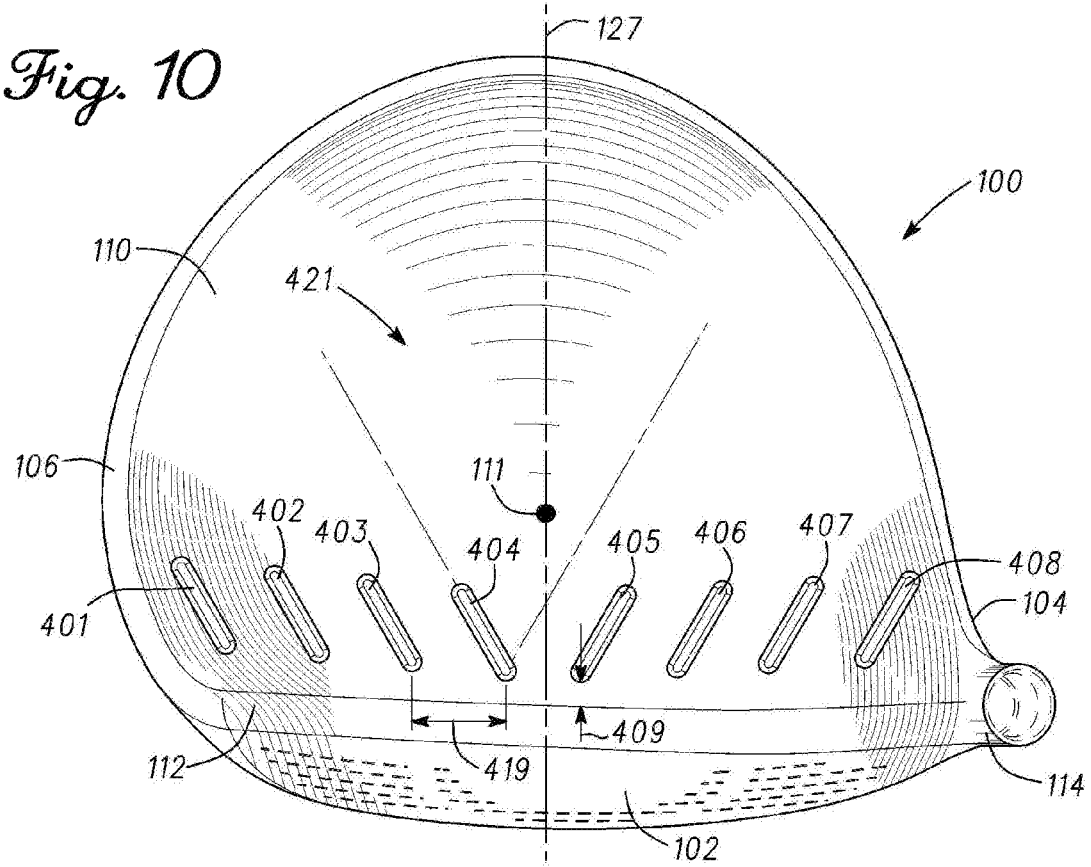

Referring to FIGS. 9 and 10, another exemplary turbulator 400 is shown. The turbulator 400 includes a plurality of ridges 401-408 that are positioned downstream of the leading edge 112 and at least partly before the separation region 120. Each ridge 401-408 may be spaced from the leading edge 112 at the same distance 409 as another ridge or a different distance 409 than another ridge. While FIGS. 9 and 10 may depict a particular number of ridges, the apparatus, methods, and articles of manufacture described herein may include more or less number of ridges. Referring to FIGS. 11-14, in which examples of only the ridge 404 are shown, each ridge 401-408 has a length 411, a base width 413, a height 415 (shown in FIG. 12) and an angle 417 relative to the leading edge 112 of the club head 100. Each ridge 401-408 may be spaced apart from an adjacent ridge by a distance 419 (shown in FIGS. 9 and 10), which is measured from the leading edges 410 of the ridges 401-408 if the ridges are not parallel.

Figure 11:
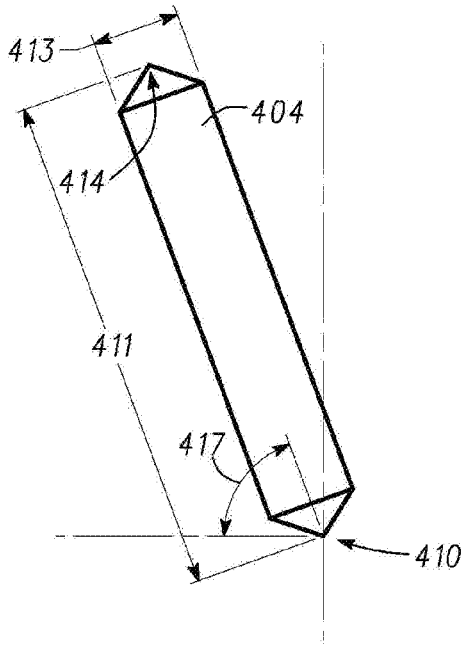
FIG. 11 is a schematic diagram of a section of the turbulator of FIGS. 9 and 10.
Figure 12:
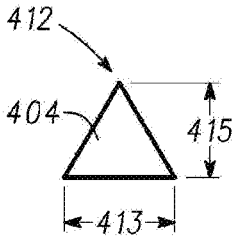
FIGS. 12-14 show different cross-sectional diagrams of turbulators according to the embodiment of FIGS. 9 and 10.
Figure 13:
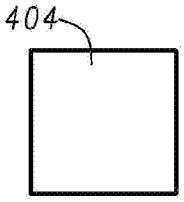
Figure 14:
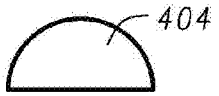

FIG. 11 illustrates an exemplary shape for the ridge 404 and does not in any way limit the shape of the ridges 401-408. The ridges 401-408 may have any cross-sectional shape. In FIGS. 12-14, three exemplary cross-sectional shapes for the ridges 401-408 are shown. The length 411 may be substantially greater than the base width 413. The ridges 401-408 function as vortex generators to energize the boundary layer that forms on the crown 110, hence moving the separation region 120 further aft on the crown 110. Thus, each ridge 401-408 functions as a turbulator. The height 415 of each ridge 401-408 may be such that the top 412 (shown in FIG. 12) of each ridge 402 remains inside the boundary layer. However, any one or more of the ridges may extend above the boundary layer.

The angle 417 for each ridge 401-408 may be configured so that each ridge 401-408 is oriented generally perpendicular, parallel or oblique relative to the leading edge 112 and/or relative to each other. In one embodiment, the angle 417 may be between 20° and 70°. In the example of FIGS. 9 and 10, the turbulator 400 includes four ridges 401-404 on the toe end side of the club head 100 that are oriented generally at an angle 417 of about 60°-70° and parallel to each other. The turbulator 400 also includes four ridges 405-408 that are symmetric with respect to the angle 417 about a centerline 127 of the club head 100 relative to the ridges 401-404.

Each ridge 401-408 is shown to be a linear. However, each of the ridges 401-408 can be curved, have variable base width 413 along the length 411, have variable cross-sectional shapes, have variable height 415 along the length 411 and/or the base width 413, have sharp or blunt leading edges 410 or trailing edges 414, have sharp or blunt tops 412, have different surface textures, and/or have other physical variations along the length 411, the base width 413 and/or the height 415. The distance 409 may increase for each ridge 401-408 from the heel end 104 to the toe end 106 to approximately correspond with the location of the separation line 120 on the crown 110. However, as shown in FIGS. 9 and 10, each ridge 401-408 may be located on the crown 110 at substantially the same distance 409 from the leading edge 112. Furthermore, each of the ridges 401-408 may be placed anywhere on the crown 110 to provide the boundary layer effects described herein. The location of the ridges may vary depending on the physical characteristics of the club head 100 and the airflow pattern on the crown 110. Each of the ridges 401-408 may be located along a straight line or a curvilinear line on the crown 110 between 0.25 inches (0.64 cm) and 4.5 inches (11.43 cm) from the club face 110. Each ridge 401-408 may have a height 415 that does not exceed 0.5 inches (1.27 cm). In one embodiment, at least one ridge 401-408 may have a height 415 that is greater than 0.02 inches (0.05 cm) but less than 0.2 inches (0.51 cm). The ridges 401-408 may have a distance 419 that contributes to the delay in airflow separation. The ridges 401-408 may be arranged on the crown 110 in a curvilinear manner based on the location of the separation region 120 of a particular club head 100. In one embodiment, the ridges 401-408 are located between the face 102 and the apex 111 of the crown 110. Accordingly, the ridges 402 may be located between the leading edge 112 and the apex 111 of the crown 110.

Referring to FIG. 10, each ridge 401-408 trips the air flowing over the ridge to create small eddies or vortices along the length 411 for energizing the boundary layer downstream of the ridge 401-408 in an area 421 (shown only on ridge 404). Accordingly, the separation region 120 is moved farther aft on the crown 110. The distance 419 between each ridge 401-408, length 411, base width 413, height 415 and/or angle 417 may be configured so that the areas 421 slightly or greatly overlap, or do not overlap. As shown in the example of FIG. 10, the distance 419, the length 411 and the angle 417 of each ridge 401-408 are configured such that the leading edge 410 of each ridge 401-408 is generally aligned along the direction of airflow with the trailing edge 414 of an adjacent ridge 401-408. Thus, the arrangement of the ridges 401-408 on the crown 110 as shown in of FIGS. 9 and 10 provides overlapping areas 421 of boundary layer turbulence. However, the ridges 401-408 can be configured to have any physical characteristics and spaced apart at any distance 419. For example, if the ridges have shorter lengths than the length 411 of the ridges 401-408 shown in FIGS. 9 and 10, the distance 419 can be reduced to ensure overlap of areas 421 downstream of the ridges 401-408. In another example, if the angles 417 of the ridges 401-408 relative to the club face 100 are different than the angle 417 shown in FIGS. 9 and 10, the distance 419 or the lengths 411 of the ridges 401-408 can be accordingly modified to ensure that areas 421 overlap downstream of the ridges 401-408. In yet another example, multiple rows of ridges can be provided on the crown 110 in tandem or offset relative to each other. Thus, any number of ridges with each ridge having any physical characteristic and distance 409 relative to an adjacent ridge can be provided on the crown 110. For example, in certain application, overlapping of the areas 421 may not be suitable. Accordingly, the ridges 401-408 can be configured to reduce, minimize or prevent overlap of the areas 421.

Referring to FIG. 10, the ridges 401-404 are arranged to point toward the centerline 127, and the ridges 405-408 are also arranged to point toward the centerline 127. Accordingly, the ridges 401-408 can function as an alignment aid for a player to align the club face 102 with a ball. An individual standing in an address position may visually determine the position of the ball (not shown) relative to the centerline 127 with the aid of the ridges 401-408.

Figure 15:
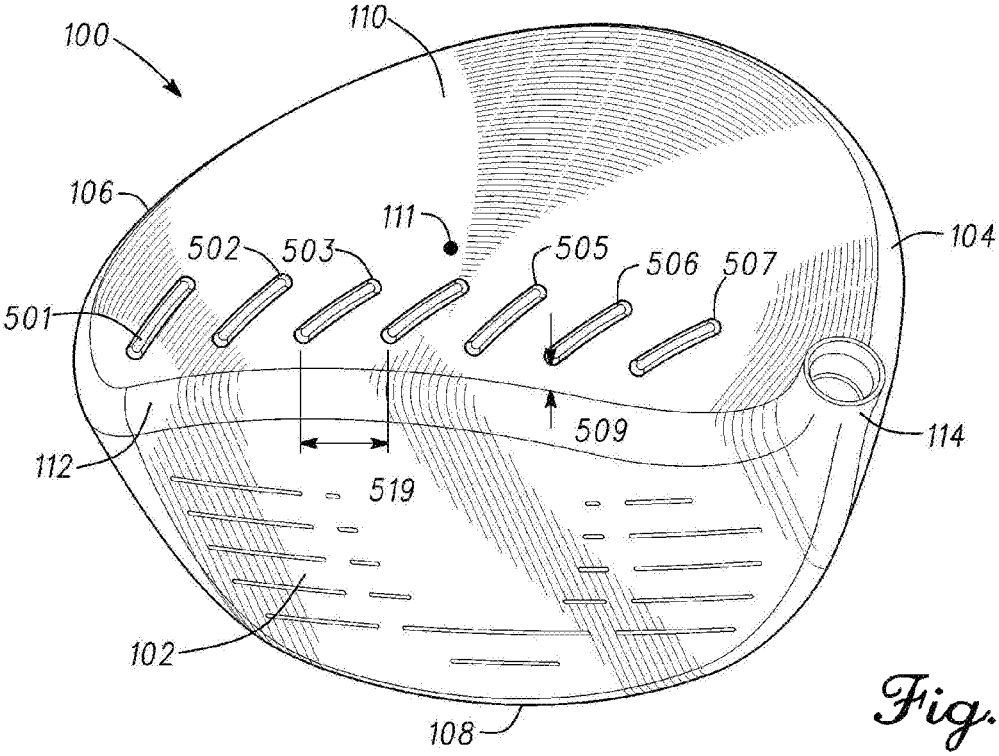
FIGS. 15 and 16 are perspective views of a club head having a turbulator according to one embodiment.
Figure 16:
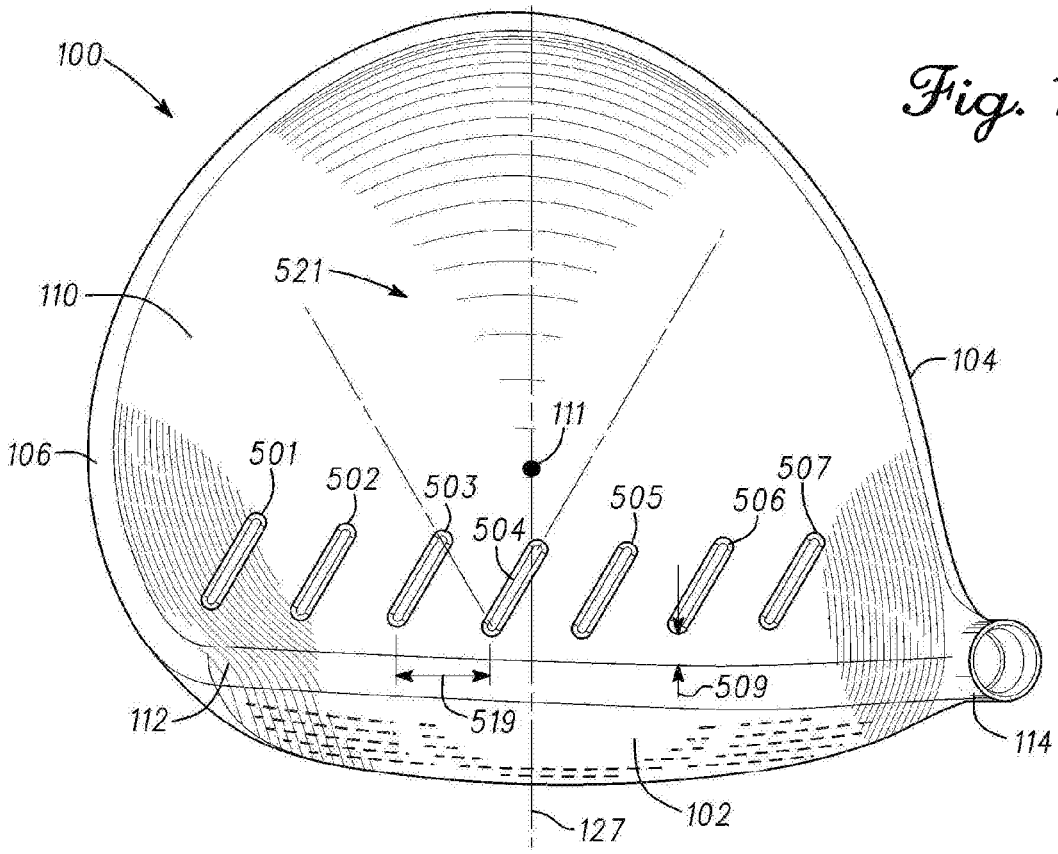

Referring to FIGS. 15 and 16, another exemplary turbulator 500 is shown. The turbulator 500 includes a plurality of ridges 501-507 that are positioned downstream of the leading edge 112 and at least partly before the separation region 120. Each ridge 501-507 may be spaced from the leading edge 112 at the same distance 509 as another ridge or a different distance 509 than another ridge. While FIGS. 15 and 16 may depict a particular number of ridges, the apparatus, methods and articles of manufacture described herein may include more or less number of ridges. Referring to FIGS. 17-20, in which examples of only the ridge 504 are shown, each ridge 501-507 has a length 511, a base width 513, a height 515 (shown in FIG. 18) and an angle 517 relative to the leading edge 112 of the club head 100. Each of the ridges 501-507 is spaced apart from an adjacent ridge by a distance 519 (shown in FIGS. 15 and 16), which is measured from the leading edges 504 of the ridges 501-507 if the ridges are not parallel.

Figure 17:
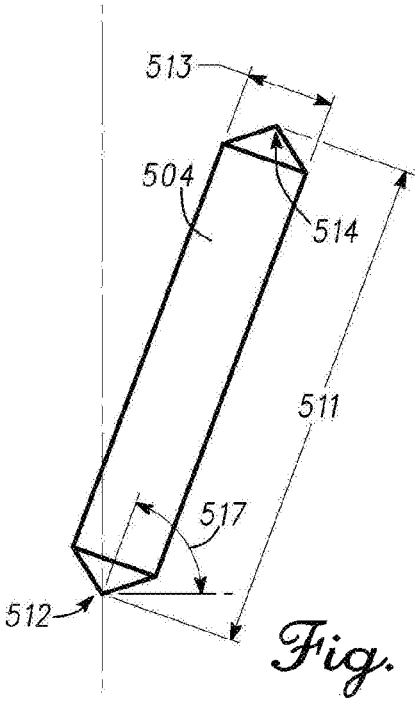
FIG. 17 is a schematic diagram of a section of the turbulator of FIGS. 15 and 16.
Figure 18:
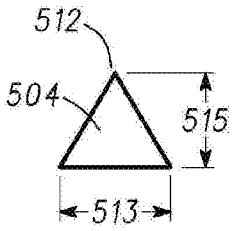
FIGS. 18-20 show different cross-sectional diagrams of turbulators according to the embodiment of FIGS. 15 and 16.
Figure 19:
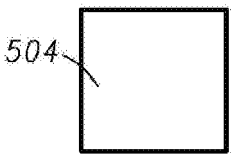
Figure 20:
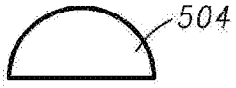

FIG. 17 illustrates an exemplary shape for the ridge 504 and does not in any way limit the shape of the ridges 501-507. The ridges 501-507 may have any cross-sectional shape. In FIGS. 18-20, three exemplary cross-sectional shapes for the ridges 501-507 are shown. The length 511 may be substantially greater than the base width 513. The ridges 501-507 function as vortex generators to energize the boundary layer that forms on the crown 110, hence moving the separation region 120 further aft on the crown 110. Thus, each ridge 501-507 functions as a turbulator. The height 515 of each ridge 501-507 may be such that the top 512 (shown in FIG. 18) of each ridge 501-507 remains inside the boundary layer. However, any one or more of the ridges may extend above the boundary layer.

The angle 517 for each ridge may be configured so that each ridge 501-507 is oriented generally perpendicular, parallel or oblique relative to the leading edge 112 and/or relative to each other. In one embodiment, the angle 517 may be between 20° and 70°. In the example of FIGS. 15 and 16, the turbulator 500 includes seven ridges 501-507 that are oriented generally at an angle 517 of about 60°-70° and parallel to each other.

Each ridge 501-507 is shown to be a linear. However, each of the ridges 501-507 can be curved, have variable base width 513 along the length 511, have variable cross-sectional shapes, have variable height 515 along the length 511 and/or the base width 513, have sharp or blunt leading edges 510 or trailing edges 514, have sharp or blunt tops 512, have different surface textures, and/or have other physical variations along the length 511, the base width 513 and/or the height 515. The distance 509 may increase for each ridge 501-507 from the heel end 104 to the toe end 106 to approximately correspond with the location of the separation line 120 on the crown 110. However, as shown in FIGS. 15 and 16, each ridge 501-507 may be located at substantially the same distance 509 from the leading edge 112. Furthermore, each of the ridges 501-507 may be placed anywhere on the crown 110 to provide the boundary layer effects described herein. The location of the ridges may vary depending on the physical characteristics of the club head 100 and the airflow pattern on the crown 110. Each of the ridges 501-507 may be located along a straight line or a curvilinear line on the crown 110 between 0.25 inches (0.64 cm) and 4.5 inches (11.43 cm) from the club face 110. Each ridge 501-507 may have a height 515 that does not exceed 0.5 inches (1.27 cm). In one embodiment, at least one ridge 501-507 may have a height 515 that is greater than 0.02 inches (0.05 cm) but less than 0.2 inches (0.51 cm). The ridges 501-507 may have a distance 519 that contributes to the delay in airflow separation. The ridges 501-507 may be arranged on the crown 110 in a curvilinear manner based on the location of the separation region 120 of a particular club head 100. In one embodiment, the ridges 501-507 are located prior to the apex 111 of the crown 110. Accordingly, the ridges 501-507 may be located between the leading edge 112 and the apex 111 of the crown 110.

Referring to FIG. 16, each ridge 501-507 trips the air flowing over the ridge to create small eddies or vortices along the length 511 for energizing the boundary layer downstream of the ridge 501-507 in an area 521 (shown only on ridge 504). Accordingly, the separation region 120 is moved farther aft on the crown 110. The distance 519 between each ridge 501-507, length 511, base width 513, height 515 and/or angle 517 may be configured so that the areas 521 slightly or greatly overlap, or do not overlap. As shown in the example of FIG. 16, the distance 519, the length 511 and the angle 517 of each ridge 501-507 are configured such that the leading edge 510 of each ridge 501-507 is generally aligned along the direction of airflow with the trailing edge 514 of an adjacent ridge 501-507. Thus, the arrangement of the ridges 501-507 on the crown 110 as shown in of FIGS. 15 and 16 provides overlapping areas 521 of boundary layer turbulence. However, the ridges 501-507 can be configured to have any physical characteristics and spaced apart at any distance 519. For example, if the ridges have shorter lengths than the length 511 of the ridges 501-507 shown in FIGS. 15 and 16, the distance 519 can be reduced to ensure overlap of areas 521 downstream of the ridges 501-507. In another example, if the angles 517 of the ridges 501-507 relative to the club face 100 are different than the angle 517 shown in FIGS. 15 and 16, the distance 519 or the lengths 511 of the ridges 501-507 can be accordingly modified to ensure that areas 521 overlap downstream of the ridges 501-507. In yet another example, multiple rows of ridges can be provided on the crown 110 in tandem or offset relative to each other. Thus, any number of ridges with each ridge having any physical characteristic and distance 509 relative to an adjacent ridge can be provided on the crown 110. For example, in certain application, overlapping of the areas 521 may not be suitable. Accordingly, the ridges 501-507 can be configured to reduce minimize or prevent overlap of the areas 521.

Referring to FIGS. 21 and 22, another exemplary turbulator 600 is shown. The turbulator 600 includes a plurality of ridges 601-608 that are positioned downstream of the leading edge 112 and at least partly before the separation region 120. Each ridge 601-608 may be spaced from the leading edge 112 at the same distance 609 as another ridge or at a different distance 609 than another ridge. While FIGS. 21 and 22 may depict a particular number of ridges, the apparatus, methods, and articles of manufacture described herein may include more or less number of ridges. Referring to FIGS. 22-26, in which examples of only the ridge 604 are shown, each ridge 601-608 has a length 611, a base width 613, a height 615 (shown in FIG. 24) and an angle 617 relative to leading edge 112 of the club head 100. Each of the ridges 601-608 is spaced apart from an adjacent ridge by either a first peak-to-peak distance 623 or a second peak-to-peak distance 625 (shown in FIGS. 21 and 22), where 623 and 625 are measured from the leading edges 604 of adjacent ridges 601-608.

Figure 23:
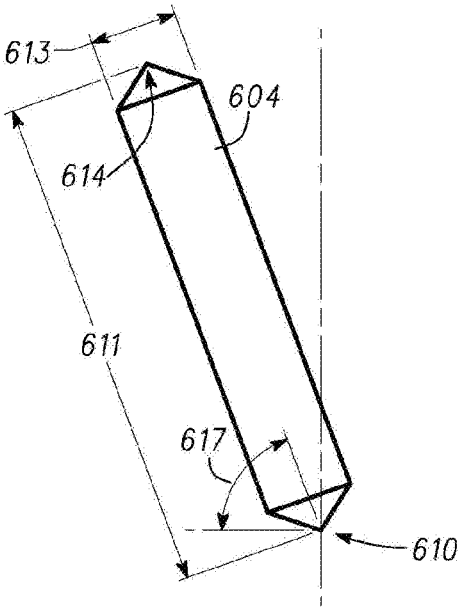
FIG. 23 is a schematic diagram of a section of the turbulator of FIGS. 21 and 22.
Figure 24:
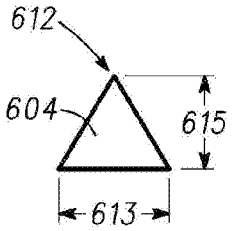
FIGS. 24-26 show different cross-sectional diagrams of turbulators according to the embodiment of FIGS. 21 and 22.
Figure 25:
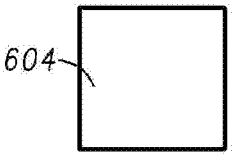
Figure 26:
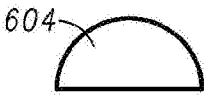

FIG. 23 illustrates an exemplary shape for a ridge 604 and does not in any way limit the shape of the ridges 601-608. The ridges 601-608 may have any cross-sectional shape. In FIGS. 24-26, three exemplary cross-sectional shapes for the ridges 601-608 are shown. The length 611 may be substantially greater than the base width 613. The ridges 601-608 function as vortex generators to energize the boundary layer forming on the crown 110, hence moving the separation region 120 further aft on the crown 110. Thus, each ridge 601-608 functions as a turbulator. The height 615 of each ridge 601-608 may be such that the top 612 (shown in FIG. 24) of each ridge 601-608 remains inside the boundary layer.

The angle 617 for each ridge may be configured so that each ridge 601-608 is oriented generally perpendicular, parallel or oblique relative to the leading edge 112 and/or relative to each other. In one embodiment, the angle 617 may be between 20° and 70° in the absolute value. In the example of FIGS. 21 and 22, the turbulator 600 includes eight ridges 601-608. The ridges 601, 603, 605 and 607 are oriented generally at an angle 617 of about −60° to −70° (see FIG. 17 for a positive angle of a ridge) and parallel to each other. The turbulator 600 also includes four ridges 602, 604, 606 and 608 that are oriented at an angle 617 of about 60° to 70°. Thus, each pair of adjacent ridges 601 and 602; 603 and 604; 605 and 606; and 606 and 608 is configured to resemble a V shape, a triangle or a similar shape.

The ridges 604 and 605 symmetrically straddle the centerline 127 and generally point toward the centerline 127. Accordingly, the ridges 604 and 605 can function as an alignment device to assist a player in generally aligning the ball with the centerline 127.

Each ridge 601-608 is shown to be a linear. However, each of the ridges 601-608 can be curved, have variable base width 613 along the length 611, have variable cross-sectional shapes, have variable height 615 along the length 611 and/or the base width 613, have sharp or blunt leading edges 610 or trailing edges 614, have sharp or blunt tops 612, have different surface textures, and/or have other physical variations along the length 611, the base width 613 and/or the height 615. The distance 609 may increase for each ridge 601-608 from the heel end 104 to the toe end 106 to approximately correspond with the location of the separation line 120 on the crown 110. However, as shown in FIGS. 21 and 22, each ridge 601-608 may be located at substantially the same distance 609 from the leading edge 112. Furthermore, each of the ridges 601-608 may be placed anywhere on the crown 110 to provide the boundary layer effects described herein. The location of the ridges may vary depending on the physical characteristics of the club head 100 and the airflow pattern on the crown 110. Each of the ridges 601-608 may be located along a straight line or a curvilinear line on the crown 110 between 0.25 inches (0.64 cm) and 4.5 inches (11.43 cm) from the club face 110. Each ridge 601-608 may have a height 615 that does not exceed 0.5 inches (1.27 cm). In one embodiment, at least one ridge 601-608 may have a height 615 that is greater than 0.02 inches (0.05 cm) but less than 0.2 inches (0.51 cm). The ridges 601-608 may have a distance 623 or 625 that contributes to the delay in airflow separation. The ridges 601-608 may be arranged on the crown 110 in a curvilinear manner based on the location of the separation region 120 of a particular club head 100. In one embodiment, the ridges 601-608 are located prior to the apex 111 of the crown 110 (highest point on the crown). Accordingly, the ridges 601-608 may be located between the leading edge 112 and the apex 111 of the crown 110.

Referring to FIG. 22, each ridge 601-608 trips the air flowing over the ridge to create small eddies or vortices along the length 611 for energizing the boundary layer downstream of the ridge 601-608 in an area 621 (shown only on ridge 604). Accordingly, the separation region 120 is moved farther aft on the crown 110. The distance 623 or 625 between each ridge 601-608, length 611, base width 613, height 615 and/or angle 617 may be configured so that the areas 621 slightly or greatly overlap, or do not overlap. The arrangement of the ridges 601-608 on the crown 110 as shown in of FIGS. 21 and 22 provides overlapping areas 621 of boundary layer turbulence. However, the ridges 601-608 can be configured to have any physical characteristics and spaced apart at any distance 623 or 625. For example, if the ridges have shorter lengths than the length 611 of the ridges 601-608 shown in FIGS. 21 and 22, the distance 623 or 625 can be reduced to ensure overlap of areas 621 downstream of the ridges 601-608. In another example, if the angles 617 of the ridges 601-608 relative to the club face 100 are different than the angle 617 shown in FIGS. 21 and 22, the distance 623 or 625 or the lengths 611 of the ridges 601-608 can be accordingly modified to ensure that areas 621 overlap downstream of the ridges 601-608. In yet another example, multiple rows of ridges can be provided on the crown 110 in tandem or offset relative to each other. Thus, any number of ridges with each ridge having any physical characteristic and distance 609 relative to an adjacent ridge can be provided on the crown 110. For example, in certain application, overlapping of the areas 621 may not be suitable. Accordingly, the ridges 601-608 can be configured to reduce minimize or prevent overlap of the areas 621.

The turbulator 400, 500 or 600 may be constructed from any type of material, such as stainless steel, aluminum, titanium, various other metals or metal alloys, composite materials, natural materials such as wood or stone or artificial materials such as plastic. If the turbulator 400, 500 or 600 is constructed from metal, it may be formed on the club head 100 or simultaneously with the club head 100 by stamping (i.e., punching using a machine press or a stamping press, blanking, embossing, bending, flanging, or coining, casting), injection molding, forging, machining or a combination thereof, or other processes used for manufacturing metal parts. With injection molding of metal or plastic materials, a one-piece or a multi-piece mold can be constructed which has interconnected cavities corresponding to the above-described parts of the club head 100 and/or the turbulator 400, 500 or 600. Molten metal or plastic material is injected into the mold, which is then cooled. The club head 100 and/or the turbulator 400, 500 or 600 is then removed from the mold and may be machined to smooth out irregularities on the surfaces thereof or to remove residual parts. If the turbulator 400, 500 or 600 is manufactured separate from the club head 100, the turbulator 400, 500 or 600 can be fixedly or removably attached to the crown 110 with fasteners, adhesive, welding, soldering, or other fastening methods and/or devices. In one example, the turbulator 400, 500 or 600 may be formed from metallic material. The turbulator 400, 500 or 600 can then be attached to the crown 110 with an adhesive. In another example, the turbulator 400 may include an elongated projection that slides into a correspondingly sized slot on the crown 110 to removably attached the turbulator 400, 500 or 600 to the crown 110. Thus, the turbulators 400, 500 or 600 may include removable connection mechanisms so that each turbulator 400, 500 or 600 can be selectively connected to or removed from the club head 100. The turbulators on the crown 110 are described above to be defined by ridges. However, any one or more of the turbulators may be defined by grooves formed in the crown 110. The turbulators may be formed by cutting grooves in the crown 110 by various methods such machining, laser cutting, or the like.

Figure 27:
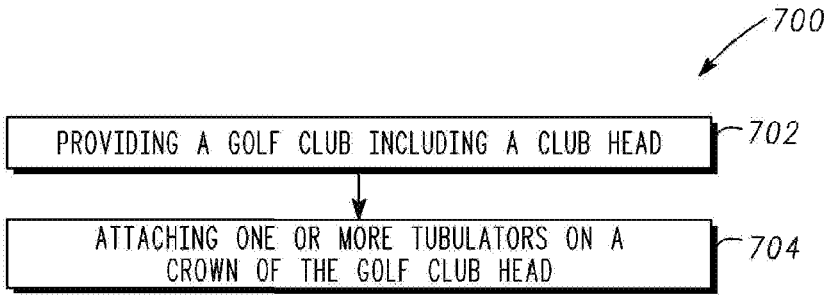
FIG. 27 is a flow chart showing a method of manufacturing a club head with turbulators according to one embodiment.
Figure 28:
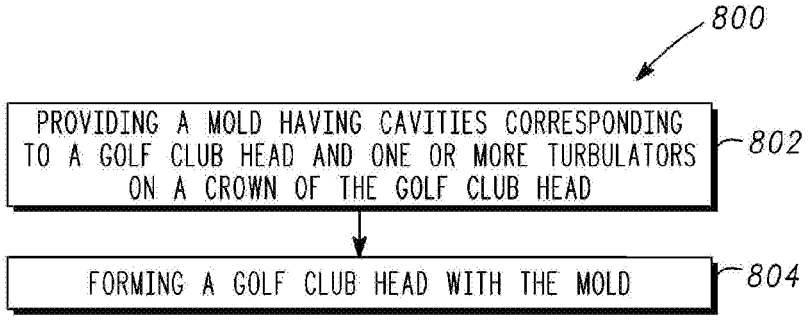
FIG. 28 is a flow chart showing a method of manufacturing a club head with turbulators according to another embodiment.

According to one example shown in FIG. 27, a method 700 of manufacturing a golf club head having turbulators according to various embodiments includes at 702 providing a golf club having a club head, and at 704, attaching one or more turbulators on a crown of the club head. According to another example shown in FIG. 28, a method 800 of manufacturing a golf club head having turbulators according to various embodiments includes at 802 providing a mold having cavities corresponding to a golf club head and one or more turbulators, and at 804, forming the club head and the turbulators with the mold.

Figure 29:
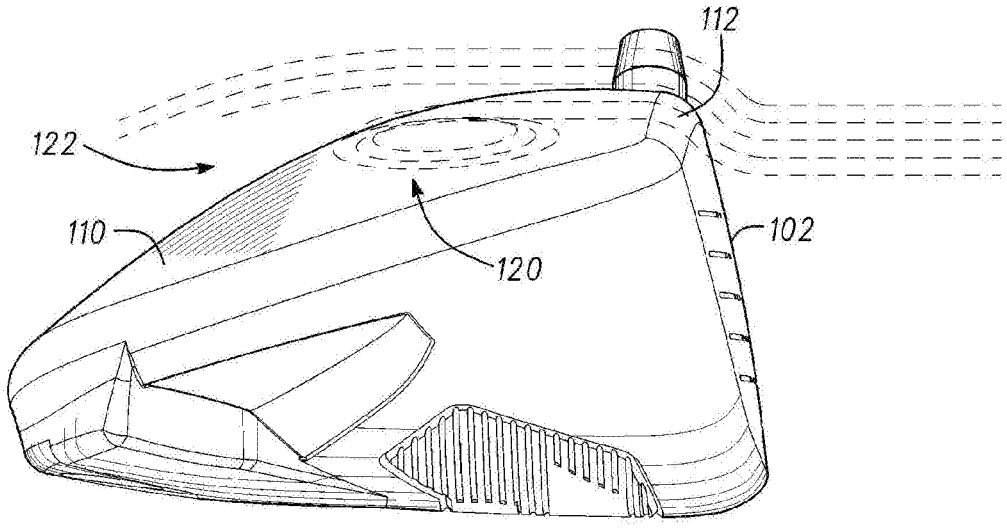
FIG. 29 shows a schematic view based on actual airflow visualization experiments of airflow over a club head without turbulators.
Figure 30:
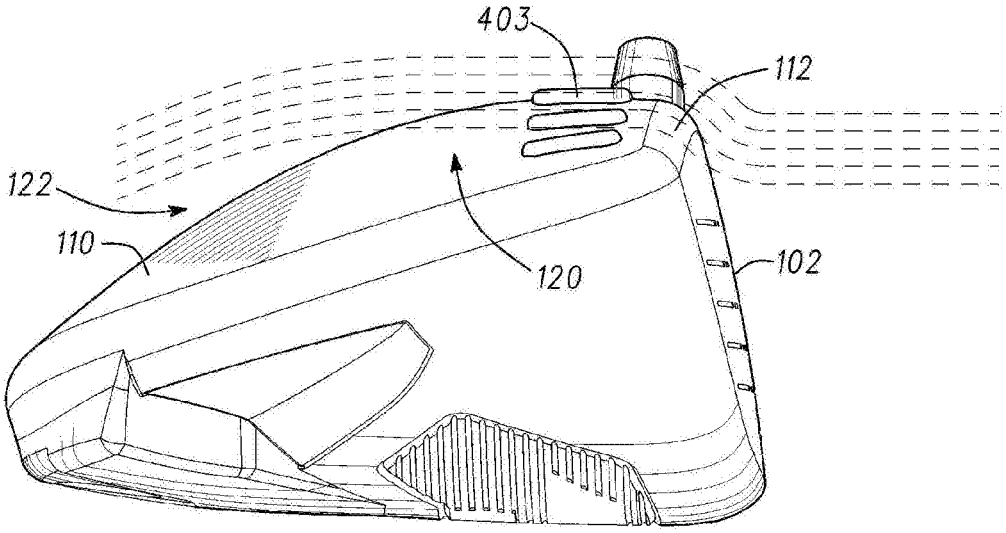
FIG. 30 shows a schematic view based on actual airflow visualization experiments of airflow over the club head of FIG. 29 with turbulators.

FIG. 29 shows a schematic view based on actual airflow visualization experiments of airflow over the club head 100 without turbulators, and FIG. 30 shows a schematic view based on actual airflow visualization experiments of airflow over the same club head with the turbulators 400. In FIG. 29, the streamlines representing airflow approach the club had 100 and are diverted over the club face toward the leading edge. The streamlines traverse over the leading edge 112 and flow over the crown 110. However, the airflow becomes detached from the crown 110 at the separation region 120, and creates a turbulent wake 122 over a substantial section of the crown 110. This turbulent wake 122 increases the drag thereby reducing the speed of the club head 100. Referring to FIG. 30, the ridges 401-408 are positioned downstream of the leading edge 112 and upstream of the separation region 120 of FIG. 29. Accordingly, the flow remains attached on a substantial portion of the crown 110 as is shown by the streamlines in FIG. 30. Therefore, the separation region 120 is moved farther aft on the crown 110.

As described above, any of the physical characteristics of the turbulators 400, 500 or 600; the locations thereof on the crown; and/or the orientations thereof relative to any part of the crown, the centerline 127 and/or the leading edge 112 may be configured to provide a particular boundary layer effect. According to one embodiment, the turbulators may be located a distance Q from the leading edge 112 according to the following relation:

$$Q>0.05DA$$

where DA is the distance from the leading edge 112 to the apex 111 of the crown (i.e., the highest point on the crown). According to another embodiment, the angle γ, which is the angle of each ridge relative to the leading edge 112 may follow the relation:

$$\gamma>\text{Loft}$$

where Loft is the loft angle of the club head 100. According to another embodiment, the distance P, which is the distance between each ridge, may follow the relation:

$$2L\cos(\gamma)>P>0.8L\cos(\gamma)$$

where L is the length of a ridge.

Tables 1 and 2 show experimental results for a golf club head 100 without any turbulators, with the turbulator 300, and with turbulators 400. Table 1 shows measured values of aerodynamic drag expressed in lbs for different orientation angles of the club head 100. The speed of the club head 100 is directly affected by the orientation angle. An increase in orientation angle results in an increase in the speed of the club head 100.

TABLE 1

| Drag Force (lbs) vs. Orientation Angle (degrees) | | | |
|---|---|---|---|
| Angle (in degrees) | Without turbulators | Turbulator 300 | Turbulator 400 |
| 90 | 2.01496256 | 1.507344 | 1.495429 |

TABLE 1-continued

| Drag Force (lbs) vs. Orientation Angle (degrees) | | | |
|---|---|---|---|
| Angle (in degrees) | Without turbulators | Turbulator 300 | Turbulator 400 |
| 60 | 1.30344225 | 1.300062 | 1.293326 |
| 30 | 0.88754571 | 0.905306 | 0.898112 |
| 0 | 0.22323528 | 0.227507 | 0.235375 |

TABLE 2

| Lift Force (lbs) vs. Orientation Angle (degrees) | | | |
|---|---|---|---|
| Angle (in degrees) | Without turbulators | Turbulator 300 | Turbulator 400 |
| 90 | −0.3884699 | 0.061148 | 0.092846 |
| 60 | 0.27763904 | 0.343283 | 0.189739 |
| 30 | 0.6006895 | 0.608558 | 0.560674 |
| 0 | 0.20772346 | 0.205925 | 0.225259 |

Figure 31:
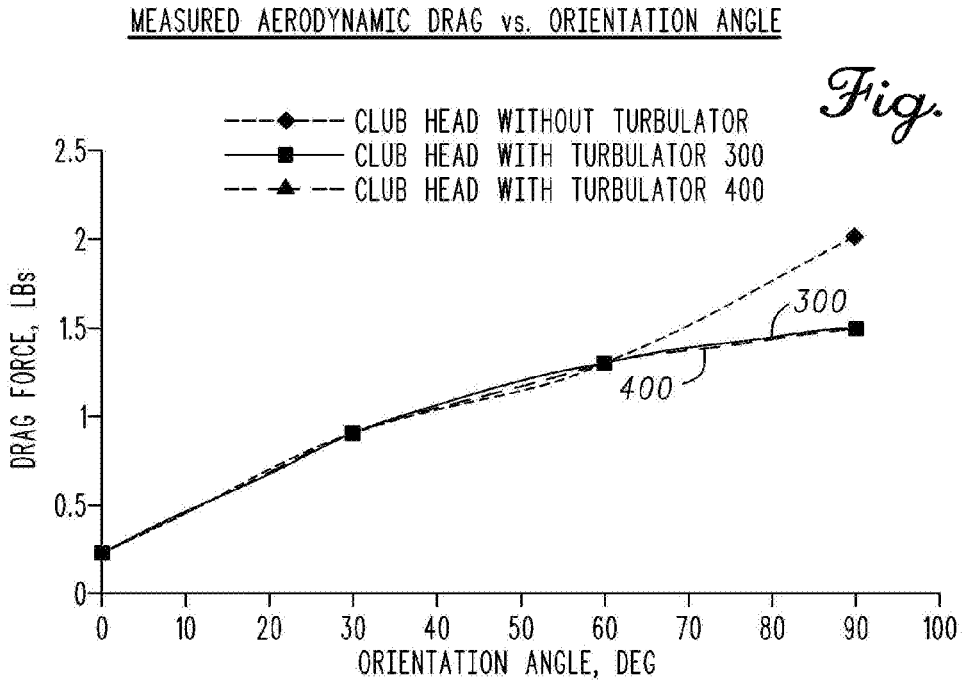
FIG. 31 is a graph showing measurements of drag force vs. orientation angle.

As shown in Table 1, when the club head 100 has an orientation angle of greater than 60°, the aerodynamic drag force on the club head 100 is reduced for the club head 100 having the turbulator 300 or the turbulators 400. The reduction in drag is much greater for an orientation angle of 90°. Referring to FIG. 31, which is a graphical representation of the data in Table 1, the noted reduction in drag for orientation angles of greater than 60° is visually shown. Furthermore, the turbulator 400 (including one or more ridges 401-408) is shown to reduce the drag force on the club head 100 more than the turbulator 300.

Figure 32:
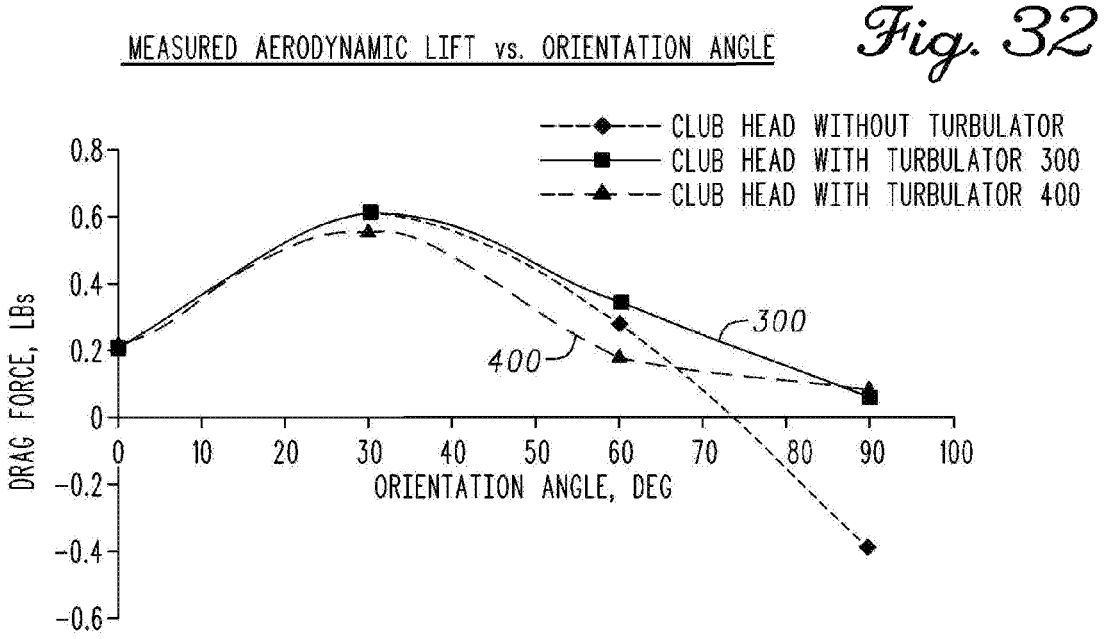
FIG. 32 is a graph showing measurements of lift force vs. orientation angle.

Table 2 shows measured values of lift expressed in lbs for different orientation angles of the club head. When the club head 100 has an orientation angle of greater than 60°, the lift generated by the club head does not drop as sharply for the club head 100 having the turbulator 300 or the turbulators 400 as compared to the club head 100 without any turbulators. Referring to FIG. 32, which is a graphical representation of the data in Table 2, the noted drop in lift for the club head 100 without any turbulators is visually shown. The noted drop in lift is due to the higher pressure differential caused by the earlier boundary layer separation on the crown for the club head 100 without any turbulators as compared to the club head 100 having turbulator 300 or turbulators 400. Thus, Tables 1 and 2 and FIGS. 31 and 32 illustrate the adverse effects of early boundary layer separation on the crown for a golf club head without any turbulators and the effects of delaying the boundary layer separation on drag forces exerted on a golf club head.

Figure 33:
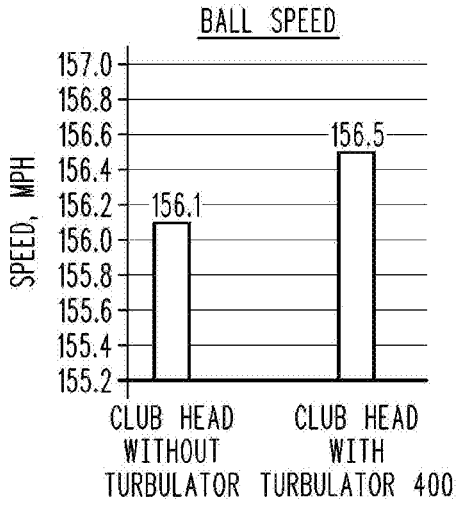
FIG. 33 is a graph showing measurements of ball speed.
Figure 34:
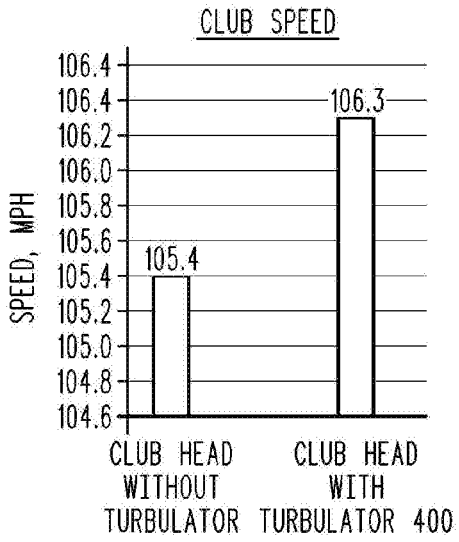
FIG. 34 is a graph showing measurements of club speed.
Figure 35:
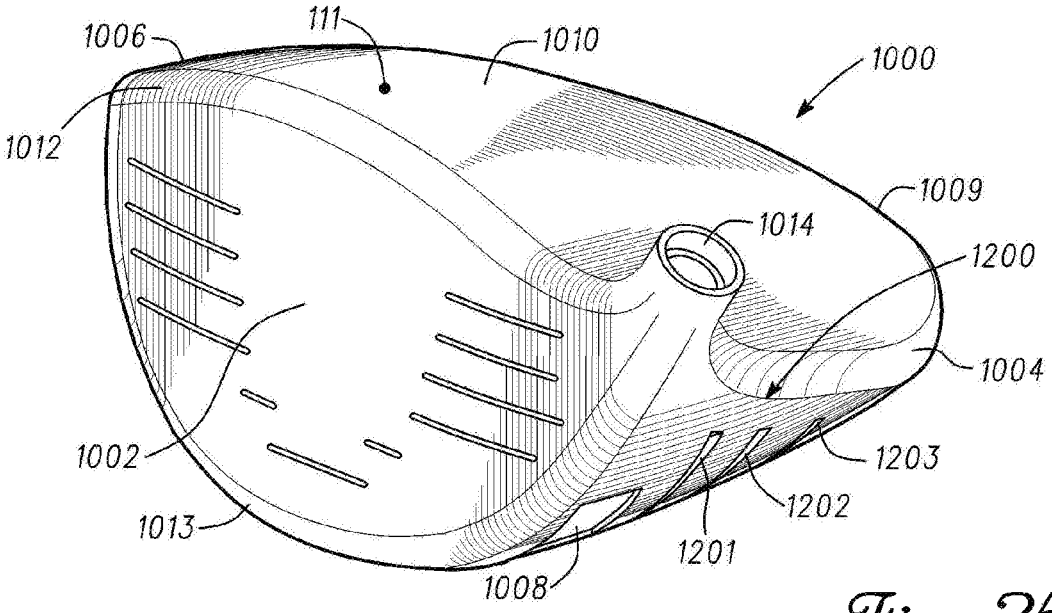

FIGS. 33 and 34 graphically show measured ball speed and club head speed for a golf club head without any turbulators and a golf club head having the turbulators 400. FIG. 33 shows that ball speed is higher when the golf club head includes the turbulators 400. This increase in ball speed is due to the higher club head speed as shown in FIG. 34 due to the turbulators 400 delaying boundary layer separation on the crown, thereby reducing drag forces on the club head.

Referring to FIGS. 35-38, another exemplary golf club head 1000 is shown, which includes a face 1002 that extends horizontally from a heel end 1004 to a toe end 1006 and vertically from a sole 1008 to a crown 1010. The heel end 1004 and the toe end 1006 extend from the face 1002 to the rear 1009 of the club head 1000. A transition region between the face 1002 and the crown 1010 defines an upper leading edge 1012 and a transition region between the face 1002 and the sole defines a lower leading edge 1013. The club head 1000 also include a hosel 1014 for receiving a shaft (not shown). The club head 1000 is shown to be a wood-type club head. However, the present disclosure is not limited to wood-type club heads and applies to any type of golf club head (e.g., a driver-type club head, a fairway wood-type club head, a hybrid-type club head, an iron-type club head, a wedge-type club head, or a putter-type club head).

Figure 38:
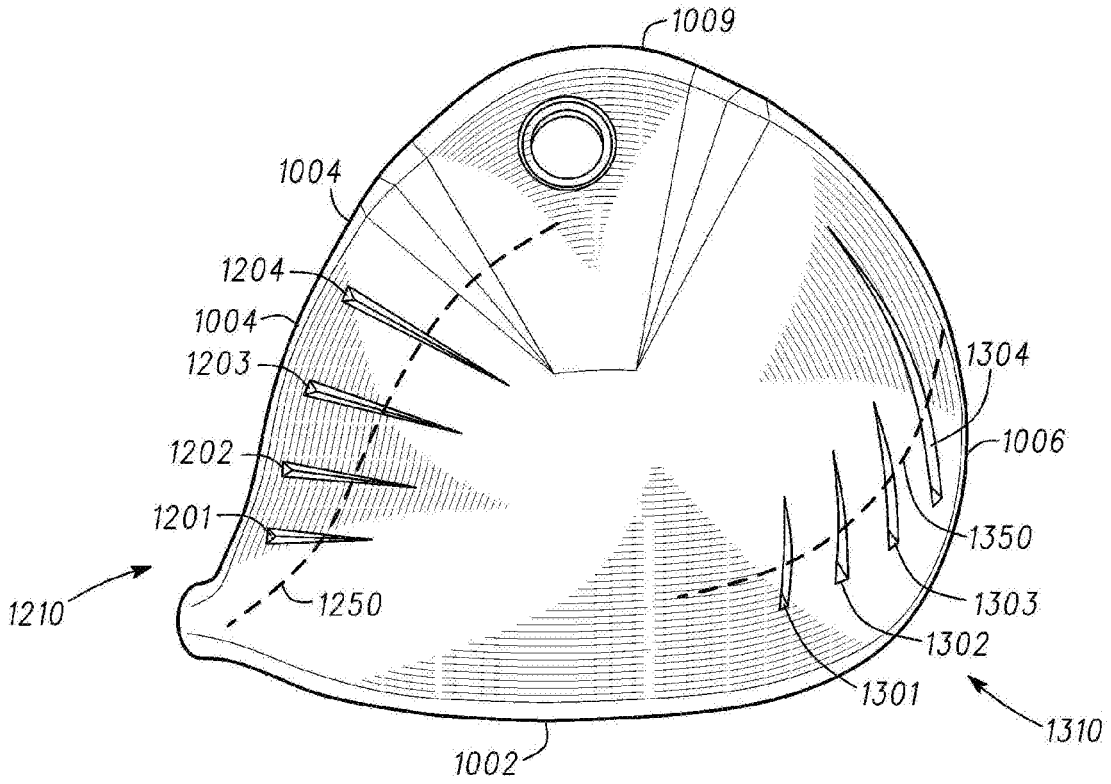

Club head 1000 includes a plurality of turbulators 1201-1204 and 1301-1304 on the sole 1008, which may be generally referred to herein as turbulators 1200 and 1300, respectively. The turbulators 1200 and 1300 energize the boundary layer on the sole 1008 during the downswing, the impact position, and the follow through phases of the golf swing. During the initial part of the downswing, the air that is upstream of the club head 1000 flows generally over the heel 1004 and onto the sole 1008 and the crown 1010. During the intermediate part of the downswing, the air flows generally over the transition area between the heel 1004 and the face 1002 and onto the sole 1008 and the crown 1010. During the final part of the downswing just prior to the impact position, the air flows generally over the face 1002 and onto the sole 1008 and the crown 1010. Arrow 1210 of FIGS. 36 and 38 represents one exemplary direction of airflow during the downswing part of the golf swing. The air flowing over the sole 1008 forms a boundary layer on the sole. The turbulators 1200 energize the boundary layer to delay detachment of the flow downstream of the turbulators 1200. Accordingly, the drag on the club head 1000 is reduced thereby increasing club speed during the downswing.

After the face 1002 strikes the ball in the impact position, the club head 1000 is rotated during the follow through. The air that is upstream of the club head 1000 flows generally over the face 1002 and onto the sole 1008 and the crown 1010 during the initial part of the follow through. During the intermediate part of the follow through, the air flows generally over the transition area between the toe 1006 and the face 1002 and onto the sole 1008 and the crown 1010. During the final part of the follow through, the air may flow generally over the toe 1006 and onto the sole 1008 and the crown 1010. As shown in FIGS. 36 and 38, arrow 1310 represents one exemplary direction of airflow during the follow through part of the golf swing.

FIG. 37 shows x and y coordinate axes for describing the dimensions, locations on the sole 1008, and orientations relative to the face 1002 of the turbulators 1200 and 1300. The x and y coordinate axes have an origin 1240 (i.e., x=0, y=0), which may define a center point of the face 1002. Accordingly, the y axis may define a center line for the club head 1000. As described in detail below, the location of each turbulator 1200 and 1300 on the sole 1009 can be expressed by an x-location and a y-location. Furthermore, the orientations of the turbulators 1200 and 1300 can be expressed relative to the x axis by an angle 1242.

The turbulators 1201-1204 may be defined by grooves that generally extend from near the heel end 1004 in a direction toward the toe end 1006. Each turbulator 1201-1204 has a first end 1211-1214 and a second end 1215-1218, respectively. The first ends 1211-1214 are located near the heel end 1004 and may generally follow the contour of the heel end 1004. Accordingly, the first ends 1211-1214 of the turbulators 1201-1204 may have approximately the same distance from the heel end 1004. However, the first ends 1211-1214 may be located anywhere on the sole 1008 to delay airflow separation on the sole 1008.

The turbulators 1201-1204 may have the same dimensions and extend parallel to each other or may have different dimensions and extend non-parallel to each other. Depending on the position of the airflow separation region during the downswing, which is shown by example with line 1250 in FIG. 38, the configurations of the turbulators 1200 can be varied to energize the airflow upstream of the separation region 1250. For example, the turbulators 1201-1204 progressively increase in length in a direction from the face 1002 to the rear 1009. Accordingly, the second ends 1215-1218 are progressively nearer to the y axis. Thus, the progressive length increase of the turbulators 1201-1204 may follow the contour of the separation region 1250 so as to provide detached flow on the sole 1008 downstream of the turbulators 1201-1204. Similarly, the depth, the width and/or the angle 1242 of each turbulator 1201-1204 may be varied to provide a particular flow pattern. As shown in FIG. 37, the angle 1242 progressively increases in a direction from the face 1002 to the rear 1009. The angle 1242 for each turbulator 1201-1204 may correspond with a particular rotational position of the club head 1000 during the downswing. Accordingly, by varying the angle 1242 in the direction from the face 1002 to the rear 1009, the turbulators 1201-1204 may energize the flow upstream of the separation region 51 for generally all rotation angles of the club head 1000 during the downswing. The angle 1242 may be measured between any reference line on a turbulator and the x or y axis. In the disclosure, the angle 1242 is measured as the angle between the x-axis and a line connecting the ends of a turbulator.

The grooves defining the turbulators 1201-1204 may be wider at the first ends 1211-1214 and narrower at the second ends 1215-1218, respectively. The depth of the grooves may also gradually decrease from the first ends 1211-1214 to the second ends 1215-1218, respectively. The grooves may be formed in any shape on the sole 1008. For example, the grooves can be narrow at the first ends 1211-1214 and the second ends 1215-1218 and then gradually or abruptly widen toward the centers of the grooves 1201-1204. In contrast, the grooves can be wider at the first ends 1211-1214 and the second ends 1215-1218 and then gradually or abruptly narrow toward the centers of the grooves 1201-1204. The depth of the grooves may also vary in any manner, such as according to the variation in width of the grooves.

The width, length, depth, location (i.e., x and y location), angle 1242, and the shapes of the grooves that define the turbulators 1200 can be varied from the face 1002 to the rear 1009 to provide a particular flow pattern for generally all rotation angles of the club head 1000 during the downswing. Furthermore, the number of turbulators 1200 can also be varied to provide a particular flow pattern on the sole 1008. For example, five, six or more turbulators 1200 can be provided on the sole 1008. The turbulators 1200 may be located on the sole 1008 adjacent to each in a direction from the face 1002 to the rear 1009, and/or may be in tandem.

Table 3 below shows exemplary configurations for the turbulators 1201-1204. The x and y locations refer to the x and y locations of the second ends 1215-1218. All of dimensions in Table 3 are expressed in inches. Furthermore, the depth and width of the grooves defining the turbulators 1201-1204 are measured at the first ends 1211-1214 of the turbulators 1201-1204, respectively. Table 3 represents only an example of the turbulators 1201-1204 and in no way limits the properties of the turbulators 1200.

TABLE 3

| Turbulator | Depth | Length | Width | Location-X | Location-Y | Angle 1242° |
|---|---|---|---|---|---|---|
| 1201 | 0.063 | 1.14 | 0.11 | −1.31 | 1.28 | 2.95 |
| 1202 | 0.065 | 1.28 | 0.11 | −1.01 | 1.67 | 7.97 |
| 1203 | 0.066 | 1.41 | 0.11 | −0.68 | 2.05 | 16.98 |
| 1204 | 0.067 | 1.52 | 0.11 | −0.35 | 2.39 | 30 |

The turbulators 1301-1304 may be defined by grooves that generally extend from near a portion of the face that is close to the toe end 1006 toward the rear 1009. The grooves may also extend generally from near a transition area between the face 1002 and the toe end 1006 toward the rear 1009. Additionally, the grooves may extend from near the toe end 1006 toward the rear 1009. Each turbulator 1301-1304 has a first end 1311-1314 and a second end 1315-1318, respectively. The first ends 1311-1314 are located near the face 1002 or the toe end 1006 and may either extend in a direction from the face 1002 toward the rear 1009 or generally follow the contour of the toe end 1006. However, the first ends 1311-1314 may be located anywhere on the sole 1008 to delay airflow separation on the sole 1008.

The turbulators 1301-1304 may have the same dimensions and extend parallel to each other or may have different dimensions and extend non-parallel to each other. Depending on the position of the airflow separation region, which is shown by example with line 1350 in FIG. 38, the dimensional characteristics of the turbulators 1300 can be varied to energize the airflow upstream of the separation region 1350. For example, the turbulators 1301-1304 progressively increase in length in a direction from the face 1002 toward the toe end 1006 and from the toe end 1006 toward the rear 1009. Accordingly, the second ends 1315-1318 are progressively farther from the x axis and the y-axis. The progressive length increase of the turbulators 1301-1304 may follow the contour of the separation region 1350 to provide attached airflow downstream of the turbulators 1301-1304. Similarly, the depth, the width and/or the angle 1242 of each turbulator 1301-1304 may vary to provide a particular flow pattern. As shown in FIG. 37, the angle 1242 progressively decreases in a direction from the face 1002 toward the toe end 1006 and from the toe end toward the rear 1009. The angle 1242 for each turbulator 1301-1304 may correspond with a particular rotational position of the club head 1000 during follow through. Accordingly, by varying the angle 1242 in the direction from the face 1002 toward the toe end 1006 and from the toe end 1006 toward the rear 1009, the turbulators 1301-1304 may energize the flow upstream of the separation region 1350 for generally all rotation angles of the club head 100 during follow through. Further, each of the turbulators 1301-1304 may have a curvature that generally corresponds to the curvature of the toe end 1006, and may represent the general direction of airflow over the sole 1008 during impact position and follow through. The angle 1242 may be measured between any reference line on a turbulator and the x or y axis. In the disclosure, the angle 1242 is measured as the angle between the x-axis and a line connecting the ends of a turbulator.

The grooves defining the turbulators 1301-1304 may be wider at the first ends 1311-1314 and narrower at the second ends 1315-1318, respectively. The depth of the grooves may also gradually decrease from the first ends 1311-1314 to the second ends 1315-1318, respectively. The grooves may be formed in any shape on the sole 1008. For example, the grooves can be narrow at the first ends 1311-1314 and the second ends 1315-1318 and then gradually or abruptly widen toward the centers of the grooves 1301-1304. In contrast, the grooves can be wider at the first ends 1311-1314 and the second ends 1315-1318 and then gradually or abruptly narrow toward the centers of the grooves 1301-1304. The depth of the grooves may also vary in any manner, such as according to the variation in width of the grooves.

The width, length, depth, location (i.e., x and y location), angle 1242, and the shapes of the grooves defining the turbulators 1300 can be varied from the face 1002 toward the toe end 1006 and from the toe end 1006 toward the rear 1009 to provide a particular flow pattern for generally all rotation angles of the club head 1000 during follow through. Furthermore, the number of turbulators 1300 can also be varied to provide a particular flow pattern on the sole 1008. For example, five, six or more turbulators 1300 can be provided on the sole 1008. The turbulators 1300 may be located on the sole 1008 adjacent to each other and/or in tandem.

Table 4 below shows exemplary configurations for the turbulators 1301-1304. The x and y locations refer to the x and y locations of the second ends 1315-1318. All of the dimensions shown in Table 4 are expressed in inches. Furthermore, the depth and width of the grooves defining the turbulators 1301-1304 are measured at the first ends 1311-1314 of the turbulators 1301-1304, respectively. Table 3 is only an exemplary configuration of the grooves 1301-1304 and in no way limits the properties of the turbulators 1300.

TABLE 4

| Turbulator | Depth | Length | Width | Location-X | Location-Y | Angle 1242° |
|---|---|---|---|---|---|---|
| 1301 | 0.05 | 0.80 | 0.12 | 1.60 | 1.60 | 90.09 |
| 1302 | 0.06 | 0.97 | 0.12 | 1.94 | 1.93 | 86.56 |
| 1303 | 0.07 | 1.09 | 0.12 | 2.24 | 2.27 | 83.03 |
| 1304 | 0.08 | 2.29 | 0.12 | 1.91 | 3.54 | 69.02 |

The turbulator 1200 and 1300 are described above to be defined by grooves in the sole 1008. Accordingly, the turbulators 1200 and 1300 may be formed on the golf club 1000 by cutting the grooves into the sole 1008 of the golf club 1000 by various methods such machining, laser cutting, or the like. Alternatively, any one or more of the turbulators 1200 and/or the turbulators 1300 may be defined by ridges or projections on the sole 1008. Such grooves or ridges may be formed simultaneously with the club head 1000 by stamping (i.e., punching using a machine press or a stamping press, blanking, embossing, bending, flanging, or coining, casting), injection molding, forging, machining or a combination thereof, or other processes used for manufacturing metal parts. With injection molding of metal or plastic materials, a one-piece or a multi-piece mold can be constructed which has interconnected cavities corresponding to the above-described parts of the club head 1000 and/or the turbulators 1200 and 1300. Molten metal or plastic material is injected into the mold, which is then cooled. The club head 1000 and/or the turbulators 1200 and 1300 is then removed from the mold and may be machined to smooth out irregularities on the surfaces thereof or to remove residual parts. If the turbulators 1200 and 1300 are in the form of ridges and are to be be manufactured separately from the club head 1000, the turbulator 300 can be fixedly or removably attached to the sole 1008 with fasteners, adhesive, welding, soldering, or other fastening methods and/or devices. In one example, the turbulator 1200 or 1300 may be formed from a strip of material having an adhesive backing.

Accordingly, the turbulators 1200 and 1300 may be attached to the club head 1000 at any location on the sole 1008 with the adhesive backing.

Figure 39:
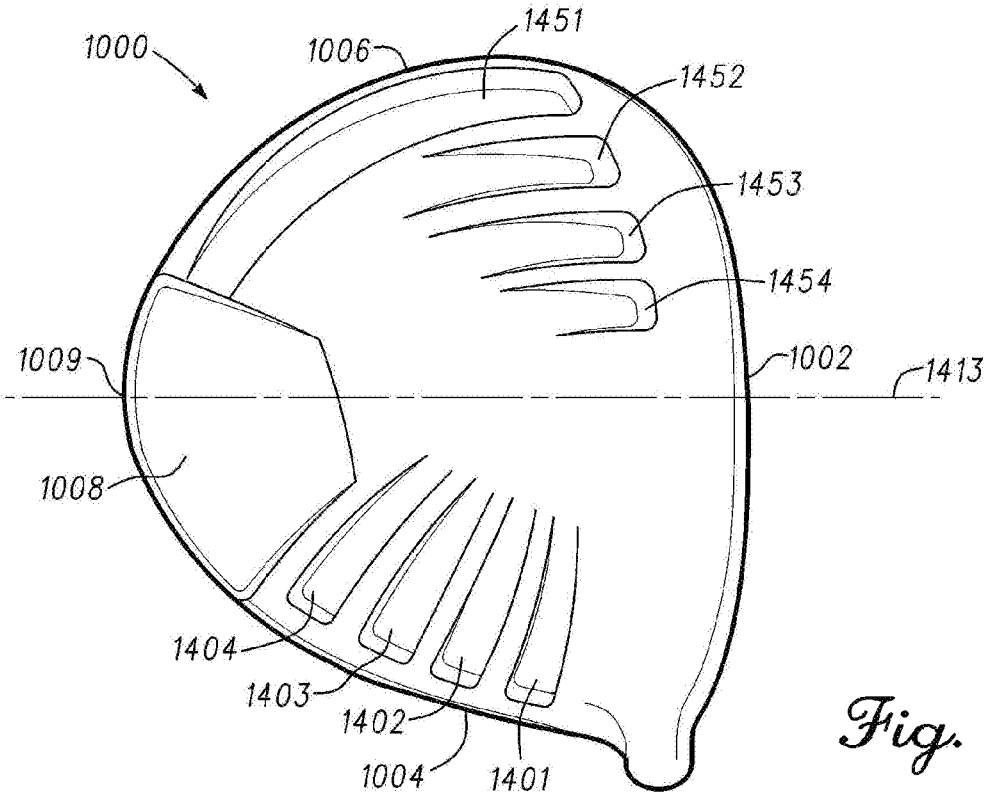
FIG. 39 is a perspective bottom view of a club head having sole turbulators according to one embodiment.

FIG. 39 shows grooves 1401-1404 and 1451-1454 on the sole 1008 of the golf club 1000 according to another embodiment. The grooves 1401-1404 and 1451-1454 may be generally referred to herein as grooves 1400 and 1500, respectively. The grooves 1401-1404 may be located between the centerline 1413 and the heel end 1006 and generally extend from the heel end 1004 toward the face 1002 or toward a region between the toe end 1006 and the face 1002. The centerline 1413 may be defined by a line that extends from a center portion of the face 1002 to the rear 1009 and may generally define a center line of the golf club head. The grooves 1451-1454 may generally extend from near a portion of the sole 1008 that is close to the toe end 1006 toward the rear 1009. The grooves 1451-1454 may also or alternatively extend from near a region between the face 1002 and the toe end 1006 toward the rear 1009. The grooves 1401-1404 and 1451-1454 are formed on the surface of the sole 1008 and may appear as depressions on the surface of the sole 1008.

The grooves 1401-1404 may be arranged adjacent to each other on the sole 1008 along the contour of the heel end 1004. The grooves 1401-1404 may have the same dimensions and extend parallel to each other or may have different dimensions and extend non-parallel to each other. For example, the grooves 1401-1404 are shown in FIG. 39 to progressively increase in length in a direction from the face 1002 to the rear 1009. Each of the grooves 1451-1454 may either extend in a direction from the face 1002 toward the rear 1009 and/or generally follow the contour of the toe end 1006. The grooves 1451-1454 may have the same dimensions and extend parallel to each other or may have different dimensions and extend non-parallel to each other. For example, the grooves 1451-1454 may progressively decrease in length in a direction from the toe end 1006 to the heel end 1004. The grooves 1400 and 1500 may be constructed with similar methods as the disclosed methods for constructing the turbulators 1200 and 1300. Accordingly, a detailed description of methods of manufacturing the grooves 1400 and 1500 is not described for brevity. The grooves 1401-1404 and 1451-1454 may have any shape and/or configuration and are not limited in configuration to the grooves described herein.

Increasing the size of a golf club head may provide a larger golf club face for better face response, allow the center of gravity of the golf club to be lowered and/or moved rearward, and/or allow the moment of inertia of the golf club to be optimized. However, the size of a golf club head may be limited to a particular size. For example, a golf governing body may limit a head of a driver-type golf club to a certain volume, such as 460 cubic centimeters. To increase the size of a golf club head without exceeding a certain volume limitation, the depth, width, length and other characteristics of the grooves 1401-1404 and 1451-1454 may be determined so that a reduction in volume of the club head as a result of providing the grooves is used to increase the size of the club head. For example, if the volume of a golf club head is limited to 460 cubic centimeters, the grooves 1401-1404 and 1451-1454 may be formed to provide a volume reduction of about 20 cubic centimeters in the golf club head. In other words, the volume defined by the grooves 1401-1404 and 1451-1454 may be about 20 cubic centimeters. Accordingly, the golf club head may be constructed to be as large as a golf club head having a volume of 480 cubic centimeters, yet have a volume of 460 cubic centimeters by having the grooves 1401-1404 and 1451-1505. Thus, the grooves 1401-1404 and 1451-1454, or any grooves formed on a golf club head as described herein, allow a golf club head to be made larger without exceeding a certain volume limitation. According to another example, a golf club head may be constructed having a volume of 478 cubic centimeters. By forming the grooves 1401-1404 to define a volume of 4 cubic centimeters and the grooves 1451-1454 to define a volume of 6 cubic centimeters, the volume of the golf club head may be reduced to 468 cubic centimeters and yet have generally the same size as a club head having a volume of 478 cubic centimeters.

Figure 40:
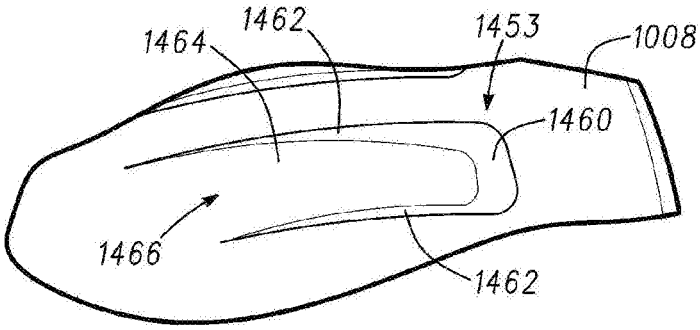
FIG. 40 is a perspective view of a portion of the club head of FIG. 39.

FIG. 40 shows an enlarged view of the groove 1453 to illustrate an exemplary shape of the grooves 1401-1404 and 1451-1454. However, the grooves 1410-1404 and 1451-1454 may be in any configuration. Each groove 1401-1404 and 1451-1454 is defined by an end wall 1460, two side walls 1462 and a bottom 1464. The side walls 1462 diminish in height from the end wall 1460 to a groove tail portion 1466, at which the bottom 1464 transitions to the surface of the sole 1008 of the golf club. Accordingly, the depth of each groove increases from the groove tail portion 1466 to the end wall 1460. The bottom 1464 may have the same width along the length of the groove as shown in the example of FIG. 39. The side walls 1462 may be perpendicular to the bottom 1464 and the end wall 1460. Alternatively, the side walls 1462 may be non-perpendicular relative to the bottom 1464 and the end wall 1460. The side walls 1462 may have similar or dissimilar lengths or depths. The end wall 1460, the side walls 1462 and the bottom 1464 may have any configuration so that a certain groove shape defining a certain volume is provided.

The grooves 1401-1404 and 1451-1454 may increase the rigidity or stiffness of the sole 1008 of a golf club head by functioning as reinforcing ribs. The increased rigidity may be provided by the shape of the grooves as defined by the angled connections between the end wall 1460, the side walls 1462 and the bottom 1464. The increased rigidity of the sole 1008 of a golf club head may prevent denting of the golf club head due to impact with a golf ball, possible impact with the ground, possible impact with an object other than a golf ball, and/or repeated use. Furthermore, the increased rigidity of the sole 1008 may allow the sole 1008 of a golf club head to be constructed with a reduced thickness to reduce the weight of a golf club head without affecting the structural integrity of the golf club head. Changing the thickness of the sole 1008 of a golf club may also affect the sound characteristics of the golf club. For example, the thickness of the sole 1008 may directly affect the frequency and/or the amplitude of the sound wave produced by a golf club head when impacting a ball. A thinner sole 1008 may produce a lower frequency sound, i.e., lower pitch, while a thicker sole 1008 may produce a higher frequency sound, i.e., higher pitch. Accordingly, by providing the grooves 1401-1404, 1451-1454 and/or any of the disclosed grooves on a golf club head, the thickness of the sole 1008 or other portions of the golf club head may be determined so that a certain sound is produced by the golf club head when impacting a golf ball.

The grooves 1401-1404 and/or the grooves 1451-1454 may be configured to provide certain sound characteristics for a golf club head. Changing the width, length and/or depth profile characteristics of one or more of the grooves and/or changing the distance between each groove may change the frequency and/or amplitude of the sound waves produced when the golf club head strikes a golf ball. For example, a plurality of deep and/or wide grooves may produce a lower frequency sound while a plurality of shallow and/or narrow grooves may produce a high frequency sound. In another example, placing the grooves closer together may produce a higher frequency sound while placing the grooves farther apart may produce lower frequency sound. Accordingly, the grooves 1401-1404, 1451-1454 and/or any of the disclosed grooves on a golf club head can be configured so that a certain sound is produced by the golf club head when impacting a golf ball.

Figure 41:
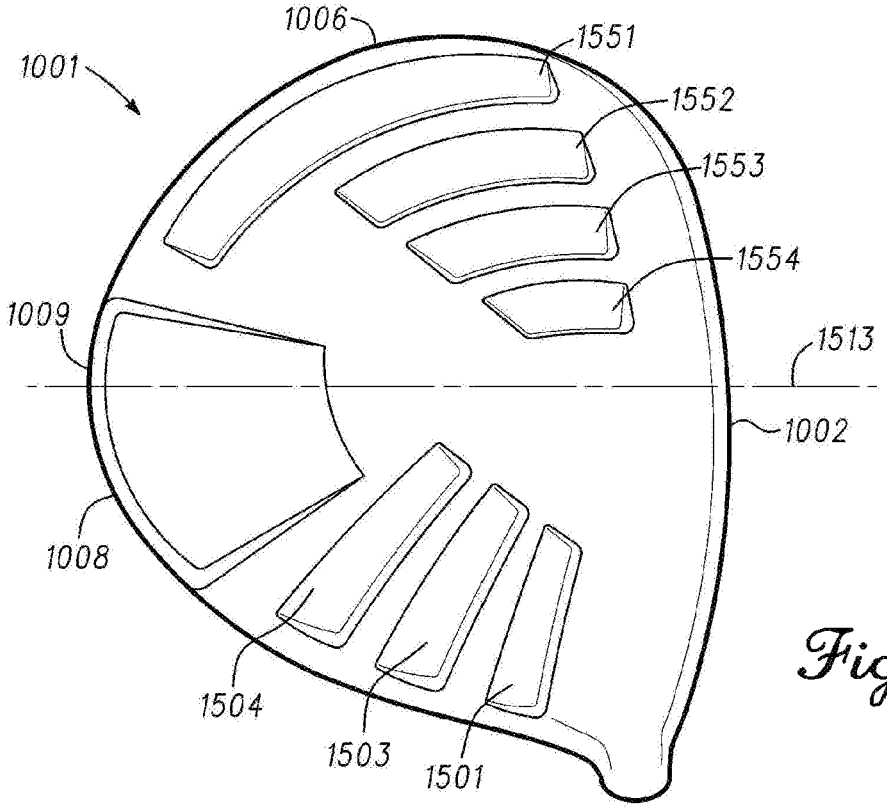
FIG. 41 is a perspective bottom view of a club head having sole turbulators according to one embodiment.

FIG. 41 shows grooves 1501-1503 and 1551-1554 on the sole 1008 of the golf club 1001 according to another embodiment. The grooves 1501-1503 may be located between the centerline 1513 and the heel end 1006 and generally extend from the heel end 1004 toward the face 1002 or toward a region between the toe end 1006 and the face 1002. The centerline 1513 may be defined by a line that extends from a center portion of the face 1002 to the rear 1009 and may generally define a center line of the golf club head. The grooves 1551-1554 may generally extend from near a portion of the sole 1008 that is close to the toe end 1006 toward the rear 1009. The grooves 1551-1554 may also or alternatively extend from near a region between the face 1002 and the toe end 1006 toward the rear 1009. The grooves 1501-1503 and 1551-1554 are formed on the surface of the sole 1008 and may appear as depressions on the surface of the sole 1008.

The grooves 1501-1503 may be arranged adjacent to each other on the sole 1008 along the contour of the heel end 1004. The grooves 1501-1503 may have the same dimensions and extend parallel to each other or may have different dimensions and extend non-parallel to each other. For example, the grooves 1501-1503 are shown in FIG. 41 to progressively increase in length in a direction from the face 1002 to the rear 1009. Each of the grooves 1551-1554 may either extend in a direction from the face 1002 toward the rear 1009 and/or generally follow the contour of the toe end 1006. The grooves 1551-1554 may have the same dimensions and extend parallel to each other or may have different dimensions and extend non-parallel to each other. For example, the grooves 1551-1554 may progressively decrease in length in a direction from the toe end 1006 to the heel end 1004. The grooves 1501-1503 and 1551-1554 may be constructed with similar methods as the disclosed methods for constructing the turbulators 1200 and 1300. Accordingly, a detailed description of methods of manufacturing the grooves 1501-1503 and 1551-1554 is not described for brevity. The grooves 1501-1503 and 1551-1554 may have any shape and/or configuration and are not limited in configuration to the grooves described herein.

Increasing the size of a golf club head may provide a larger golf club face for better face response, allow the center of gravity of the golf club to be lowered and/or moved rearward, and/or allow the moment of inertia of the golf club to be optimized. However, the size of a golf club head may be limited to a particular size. For example, a golf governing body may limit a head of a driver-type golf club to a certain volume, such as 460 cubic centimeters. To increase the size of a golf club head without exceeding a certain volume limitation, the depth, width, length and other characteristics of the grooves 1501-1503 and 1551-1554 may be determined so that a reduction in volume of the club head as a result of providing the grooves is used to increase the size of the club head. For example, if the volume of a golf club head is limited to 460 cubic centimeters, the grooves 1501-1503 and 1551-1554 may be formed to provide a volume reduction of about 20 cubic centimeters in the golf club head. In other words, the volume defined by the grooves 1501-1503 and 1551-1554 may be about 20 cubic centimeters. Accordingly, the golf club head may be constructed to be as large as a golf club head having a volume of 480 cubic centimeters, yet have a volume of 460 cubic centimeters by having the grooves 1501-1503 and 1551-1554. Thus, the grooves 1501-1503 and 1551-1554, or any grooves formed on a golf club head as described herein, allow a golf club head to be made larger without exceeding a certain volume limitation. According to another example, a golf club head may be constructed having a volume of 478 cubic centimeters. By forming the grooves 1501-1503 to define a volume of 4 cubic centimeters and the grooves 1551-1554 to define a volume of 6 cubic centimeters, the volume of the golf club head may be reduced to 468 cubic centimeters and yet have generally the same size as a club head having a volume of 478 cubic centimeters.

Figure 42:
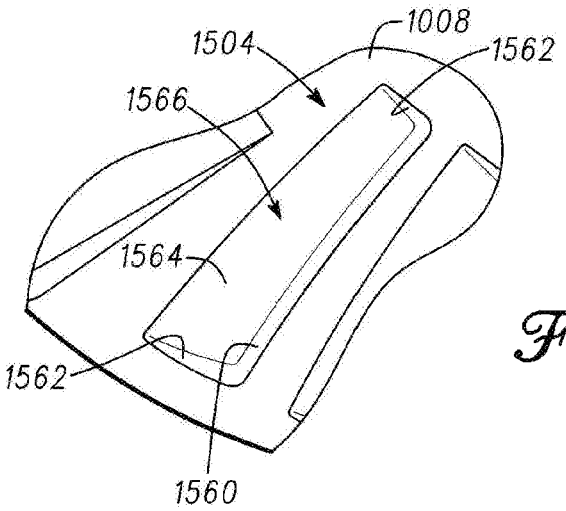
FIG. 42 is a perspective view of a portion of the club head of FIG. 41.

FIG. 42 shows an enlarged view of the groove 1504 to illustrate an exemplary shape of the grooves 1501-1503 and 1551-1554. However, the grooves 1501-1503 and 1551-1554 may be in any configuration. Each groove 1501-1503 and 1551-1554 is defined by an end wall 1560, two side walls 1562 and a bottom 1564. The side walls 1562 diminish in height from the end wall 1560 to a groove side portion 1566, at which the bottom 1564 transitions to the surface of the sole 1008 of the golf club. Accordingly, the depth of each groove increases from the groove side portion 1566 to the end wall 1560. The bottom 1564 may have generally the same width or slightly varying width along the length of the groove as shown in the example of FIG. 42. The side walls 1562 may be perpendicular to the bottom 1564 and the end wall 1560. Alternatively, the side walls 1562 may be non-perpendicular relative to the bottom 1564 and the end wall 1560. The side walls 1562 may have similar or dissimilar lengths or depths. The end wall 1560, the side walls 1562 and the bottom 1564 may have any configuration so that a certain groove shape defining a certain volume is provided. In contrast to the grooves 1401-1404 and 1451-1454, which diminish in depth along the length of the grooves, the grooves 1501-1503 and 1551-1554 diminish in depth along the width of the grooves.

The grooves 1501-1503 and 1551-1554 may increase the rigidity or stiffness of the sole 1008 of a golf club head by functioning as reinforcing ribs. The increased rigidity may be provided by the shape of the grooves as defined by the angled connections between the end wall 1560, the side walls 1562 and the bottom 1564. The increased rigidity of the sole 1008 of a golf club head may prevent denting of the golf club head due to impact with a golf ball, possible impact with the ground, possible impact with an object other than a golf ball, and/or repeated use. Furthermore, the increased rigidity of the sole 1008 may allow the sole 1008 of a golf club head to be constructed with a reduced thickness to reduce the weight of a golf club head without affecting the structural integrity of the golf club head. Changing the thickness of the sole 1008 of a golf club may also affect the sound characteristics of the golf club. For example, the thickness of the sole 1008 may directly affect the frequency and/or the amplitude of the sound wave produced by a golf club head when impacting a ball. A thinner sole 1008 may produce a lower frequency sound, i.e., lower pitch, while a thicker sole 1008 may produce a higher frequency sound, i.e., higher pitch. Accordingly, by providing the grooves 1501-1503 and 1551-1554 and/or any of the disclosed grooves on a golf club head, the thickness of the sole 1008 or other portions of the golf club head may be determined so that a certain sound is produced by the golf club head when impacting a golf ball.

The grooves 1501-1503 and/or the grooves 1551-1554 may be configured to provide certain sound characteristics for a golf club head. Changing the width, length and/or depth profile characteristics of one or more of the grooves and/or changing the distance between each groove may change the frequency and/or amplitude of the sound waves produced when the golf club head strikes a golf ball. For example, a plurality of deep and/or wide grooves may produce a lower frequency sound while a plurality of shallow and/or narrow grooves may produce a high frequency sound. In another example, placing the grooves closer together may produce a higher frequency sound while placing the grooves farther apart may produce lower frequency sound. Accordingly, the grooves 1501-1503, 1551-1554 and/or any of the disclosed grooves on a golf club head can be configured so that a certain sound is produced by the golf club head when impacting a golf ball.

Figure 43:
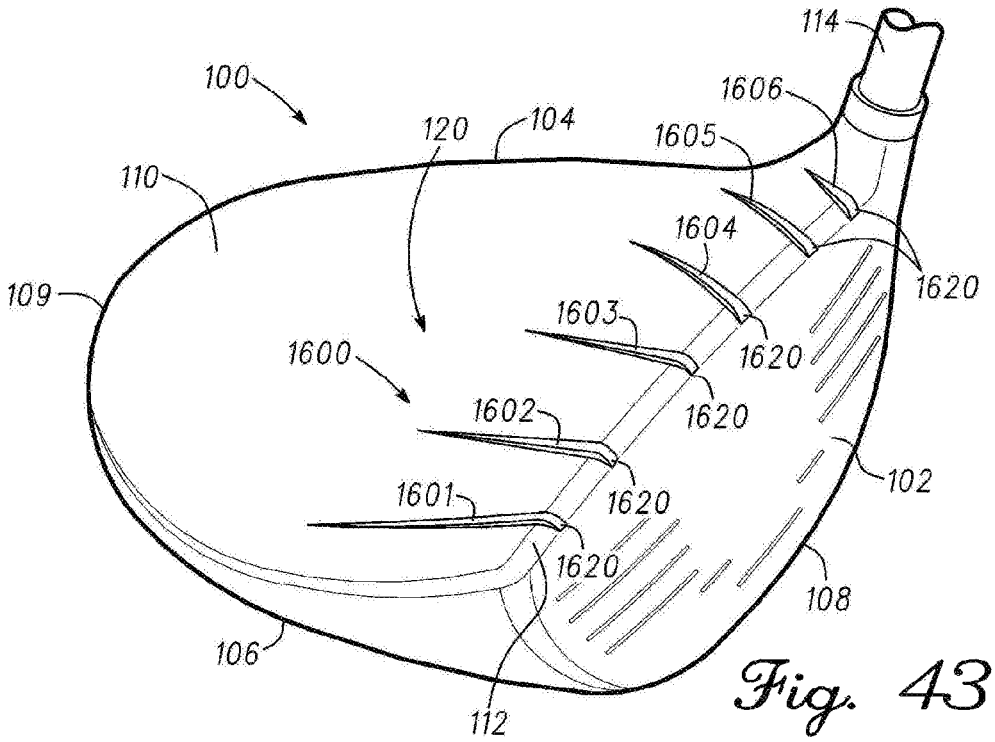
FIGS. 43 and 44 are perspective side and top views, respectively, of a club head having turbulators according to one embodiment.
Figure 44:
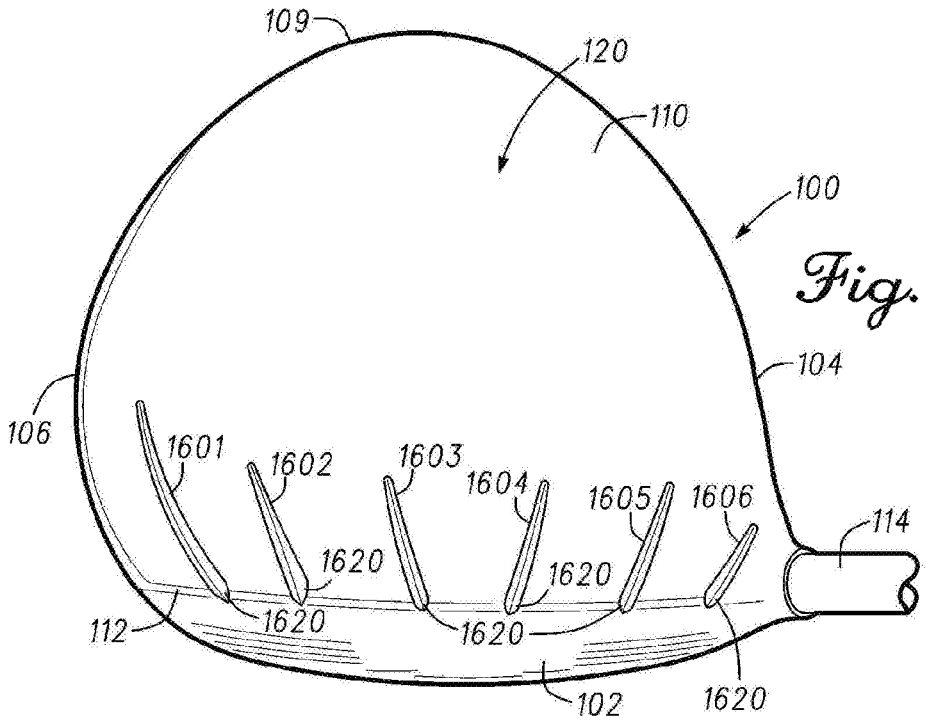

Referring to FIGS. 43 and 44, a golf club head having a plurality of crown turbulators 1600 (e.g., two or more turbulators) according to another example is shown. The golf club head shown in FIGS. 43 and 44 is similar in many respects to the golf club head 100 of FIGS. 9 and 10. Accordingly, except for the turbulators 1600, same parts of the golf club head of FIGS. 43 and 44 and the golf club head 100 of FIGS. 9 and 10 are referred to with the same reference numbers. The turbulators 1600 may be defined by a plurality of ridges 1601-1606 that are positioned at or near the leading edge 112 and extend toward the separation region 120 or toward the rear 109 of the golf club head 100. The ridges 1601-1606 may also be referred to herein as turbulators 1601-1606. The ridges 1601-1606 may extend into the separation region 120. While FIGS. 43 and 44 may depict a particular configuration and number of ridges, the apparatus, methods and articles of manufacture described herein may include different configuration and/or more or less number of ridges.

Figure 45:
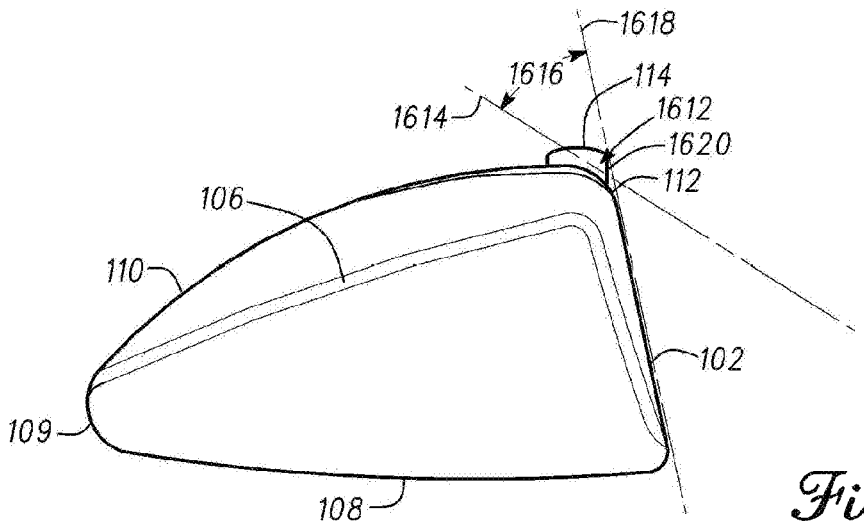
FIG. 45 is a side perspective view of a club head having turbulators according to one embodiment.

Referring also to FIG. 45, any one or all of the ridges 1601-1606 may be positioned on the crown 110 as close as possible to the leading edge 112 or at least partly on the leading edge 112 such that a leading edge portion 1612 of each of the ridges 1601-1606 does not extend beyond a leading edge plane 1614. The leading edge plane 1614 may be defined as a plane that is tangent to a portion of the leading edge 112 of the golf club head 100 or a location on the golf club head 100 where the crown 110 meets the club face 102. The leading edge plane 1614 defines a leading edge angle 1616 relative to a loft plane 1618. The loft plane 1618 may be a plane that defines or is tangent to a geometric center of the club face 102. Any one or all of the ridges 1701-1706 may be at least partly located on the leading edge 112 and extend beyond the leading edge plane 1614 (i.e., at least partly located between the leading edge plane 1614 and the loft plane 1618). The leading edge angle 1616 may range from 0°, which corresponds to the angle of the loft plane 1618, to any angle greater than 0°. For example, the leading edge angle 1616 may be greater than or equal to 30° but less than or equal to 90°, greater than or equal to 45° but less than or equal to 90°, greater than or equal to 60° but less than or equal to 90°, or greater than 75° but less than or equal to 90°.

Each of the ridges 1601-1606 may have any length, width, height and/or cross-sectional profile, such as any profile as described herein. As described above, each ridge 1601-1606 may be positioned at or near the leading edge 112 and may extend toward the separation region 120 or toward the rear 109 of the golf club head. In the example of FIGS. 43 and 44, each ridge 1601-1606 extends from the leading edge 112 toward the rear 109 of the golf club head 100 with a portion of each ridge being located on the leading edge 112. Each of the ridges 1601-1606 may have a greater width and height at the leading edge 112 than other parts of the ridge. Furthermore, the width and height of each of the ridges 1601-1606 may diminish from the leading edge 112 toward the rear 109 of the golf club head. In the examples of FIGS. 43 and 44, each ridge 1601-1606 includes a front surface 1620. The front surface 1620 of each ridge defines the most forward portion or front portion of the ridge. Although the most forward portion of a ridge is referred to herein as a front surface 1620, such a forward portion may be defined by one or more flat continuous or discontinuous surfaces, one or more continuous or discontinuous curved surfaces, one or more blunt or sharp edges, points, or a combination thereof. A portion or the entire front surface 1620 of each ridge may define a portion of the leading edge plane 1614, be spaced apart from but generally parallel to the leading edge plane 1614, or be spaced apart from and generally non-parallel to the leading edge plane 1614. According to one embodiment, the front surface 1620 may be positioned and configured such that any portion of the front surface 1620 may not extend beyond or through the leading edge plane 1614 that corresponds to the ridge defining the front surface 1620. The apparatus, methods, and articles of manufacture described herein are not limited in this regard.

Referring to FIG. 46-49, several examples of configurations, positions and angles of the front surface 1620 relative to the leading edge plane 1614 and/or the loft plane 1618 are shown. A certain leading edge angle 1616 may be required by one or more golf governing bodies. For example, a golf governing body may require that the crown 110 or the leading edge 112 of a golf club head does not include any objects or projections that extend beyond the leading edge plane 1614 having a certain leading edge angle 1616 relative to the loft plane 1618. In the example of FIGS. 46-49, the leading edge plane 1614 forms a leading edge angle 1616 of about 30° with the loft plane 1618. Thus, according to the examples of FIGS. 46-49, any turbulator 1600 located on or near the leading edge 112 may not have any portion thereof extend beyond the leading edge plane 1614. The leading edge angle 1616 may be any angle (e.g., 30°, 45°, 60°, etc.). Accordingly, describing a certain angle for the leading edge angle 1616, such as an angle of about 30° is exemplary and in no way limits the leading edge angle 1616 to a certain angle.

Figure 46:
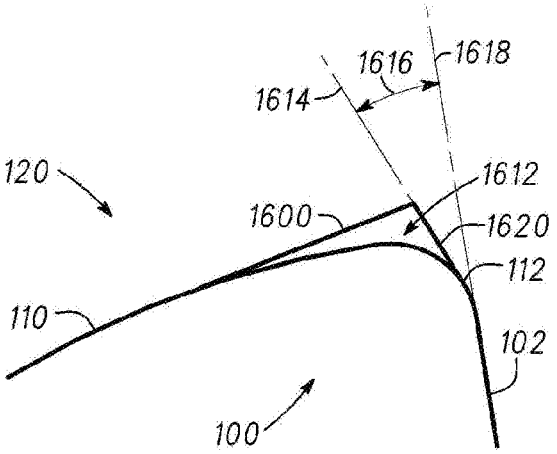
FIGS. 46-49 are schematic diagrams of turbulator configurations according to several embodiments.

Referring to the example of FIG. 46, the front surface 1620 or at least a cross-sectional portion of the front surface 1620 may generally define the leading edge plane 1614. Accordingly, the front surface 1620 is positioned as forward or near the face 102 of the golf club head as possible since any further forward positioning of the front surface 1620 would cause the front surface 1620 to extend beyond the leading edge plane 1614.

Figure 47:
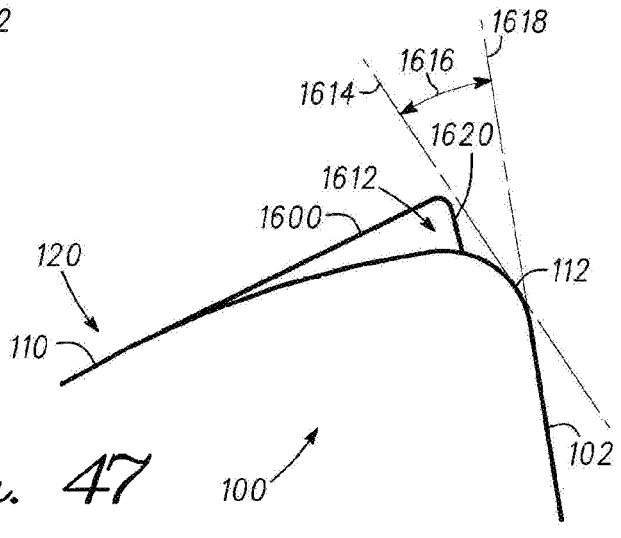

Referring to the example of FIG. 47, the front surface 1620 or at least a cross-sectional portion of the front surface 1620 may be generally parallel to the loft plane 1618. Accordingly, the front surface 1620 may be positioned behind or aft of the leading edge 112 so that no portion of the front surface 1620 extends beyond the leading edge plane 1614.

Figure 48:
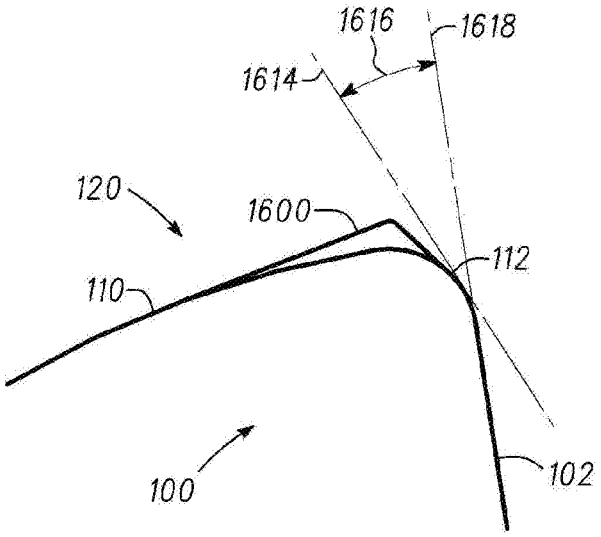

Referring to the example of FIG. 48, the front surface 1620 or at least a cross-sectional portion of the front surface 1620 extends from the leading edge 112 at an angle that is greater than the leading edge angle 1616. As shown in FIG. 48, however, a portion of the front surface 1620 may be tangent to the leading edge plane 1614. In other words, the front surface 1620 may extend from the leading edge 112, or as close to the leading edge 112 as possible, toward the rear 109 of the golf club head 100 at an angle that is greater than the leading edge angle 1616 without extending beyond the leading edge plane 1614.

Figure 49:
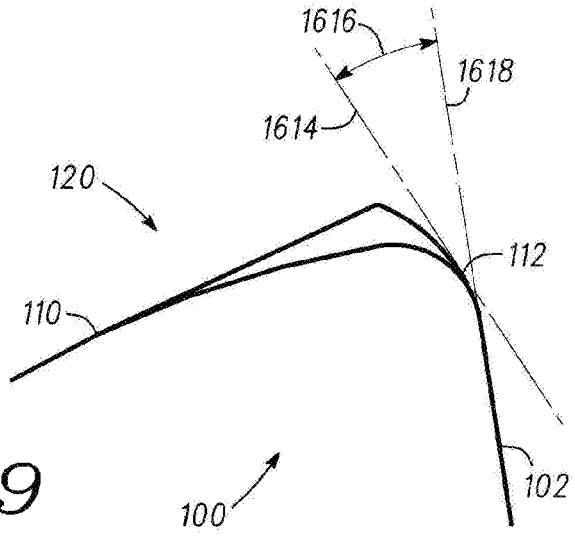

Referring to the example of FIG. 49, the front surface 1620 or at least a cross-sectional portion of the front surface 1620 extends from the leading edge 112 at an angle that is greater than the leading edge angle 1616. As shown in FIG. 47, however, a portion of the front surface 1620 may be tangent to the leading edge plane 1614. In other words, the front surface 1620 may extend from the leading edge 112, or as close to the leading edge 112 as possible, toward the back of the crown 110 at an angle that is greater than the leading edge angle 1616 without extending beyond the leading edge plane 1614. In the example of FIG. 47, at least a portion of the front surface 1620 or a cross section of at least a portion of the front surface 1620 may be curved, i.e., non-planar. The curvature of the front surface 1620 may vary in any direction, such as from the toe end 106 to the heel end 104.

The turbulators 1600 may be positioned at any location on the crown 110 so that a portion of the front surface 1620 of at least one of the turbulators 1600 is tangent to or is positioned aft of a leading edge plane 1614. The leading edge angle 1616 may be within any range, such as 0° to 90°. For example, as shown in the example of FIG. 46, a portion of the front surface 1620 of at least one turbulator 1600 may be located at the leading edge 112 of a golf club head 100. Alternatively, a portion of the front surface 1620 of at least one turbulator 1600 may be located aft of the leading edge 112 of a golf club head 100 as shown in FIGS. 47-49.

The turbulators 1600 may be sized, shaped and/or positioned on the crown 110 to provide any type of air flow properties over the crown 110. Each turbulator may have a certain length, width, height, longitudinal shape, cross-sectional shape, surface properties (i.e., texture or frictional properties), angular orientation, or any other physical characteristics that may provide certain flow characteristics over the crown 110. Examples of turbulator characteristics are provided in FIGS. 11-14. In the example of FIGS. 43 and 44, the ridge 1601 is longer than the ridges 1602-1606. Additionally, the turbulator 1601 has a greater curvature than the turbulators 1602-1606. Furthermore, the lengths and curvatures of the ridges 1601-1603 decrease from the toe end 106 to the center of the crown 110, while the lengths and curvatures of the turbulators 1604-1606 vary from the center of the crown 110 to the heel end 104.

The characteristics of each turbulator may depend on the profile of the separation region and the change in the location and the profile of the separation region during the entire golf club swing. For example, air flow separation may be greatest near the toe end 106 and decrease in a direction from the toe end 106 to the center of the crown 110. Accordingly, as shown in FIG. 44, the configuration of each of the turbulators 1601-1603 may be determined to delay separation along the profile of the separation region from the toe end 106 to the center of the crown 110. Thus, turbulators according to the disclosure may have any physical characteristics and be located at any location on the crown so as to provide delay in airflow separation on the crown for the entire golf swing.

Each ridge 1601-1606 may be oriented generally perpendicular, parallel or oblique relative to the leading edge 112 and/or relative to each other. Each ridge 1601-1606 may be curved, have variable base width along the length of the ridge, have variable cross-sectional shapes, have variable height along the length of the ridge and/or the width of the ridge, have sharp or blunt edges, front surfaces and/or trailing edges, have sharp or blunt tops, have different surface textures, and/or have other physical variations along the length, the width and/or the height of the ridge. The ridges 1601-1606 of the turbulators 1600 may be similar in many respects to other ridges of the turbulators according to the disclosure.

Figure 50:
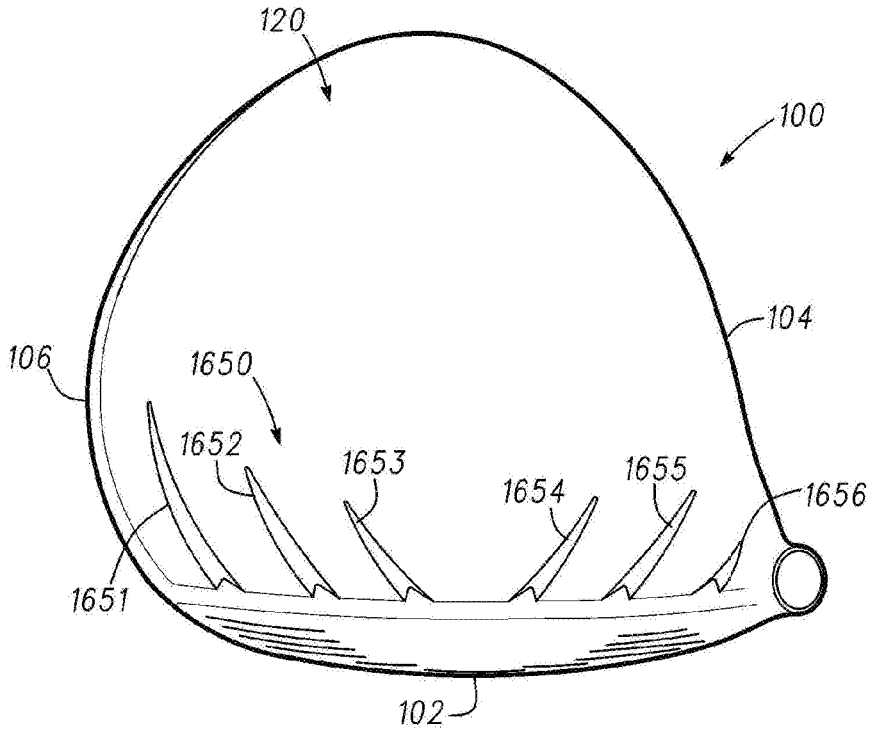
FIG. 50 is a perspective top view of a club head having turbulators according to one embodiment.

Referring to FIG. 50, a golf club head having a plurality of crown turbulators 1650 (e.g., two or more turbulators) according to another example is shown. The golf club head shown in FIG. 50 is similar in many respects to the golf club head 100 of FIGS. 9 and 10. Accordingly, except for the turbulators 1650, same parts of the golf club head of FIG. 50 and the golf club head 100 of FIGS. 9 and 10 are referred to with the same reference numbers. The turbulators 1600 may be defined by a plurality of ridges 1651-1656 that are positioned at or near the leading edge 112 and extend toward the separation region 120 or toward the rear 109 of the golf club head 100. The ridges 1651-1656 are similar in many respects to the ridges 1601-1606 described in detail above. Therefore, a detailed description of the ridges 1651-1656 is not described in detail herein for brevity.

Each ridge 1651-1656 may be oriented generally perpendicular, parallel or oblique relative to the leading edge 112 and/or relative to each other. For example, each ridge 1651-1656 may be oriented at an angle that may in a range of about 20° to about 70° relative to the leading edge 112. In the example of FIG. 50, the ridges 1651-1656 are oriented at an angle of about 70° relative to the leading edge 112. Each ridge 1651-1656 may be curved, have variable base width along the length of the ridge, have variable cross-sectional shapes, have variable height along the length of the ridge and/or the width of the ridge, have sharp or blunt edges, front surfaces and/or trailing edges, have sharp or blunt tops, have different surface textures, and/or have other physical variations along the length, the width and/or the height of the ridge. The ridges 1651-1656 may be similar in many respects to other ridges of the turbulators according to the disclosure.

Figure 51:
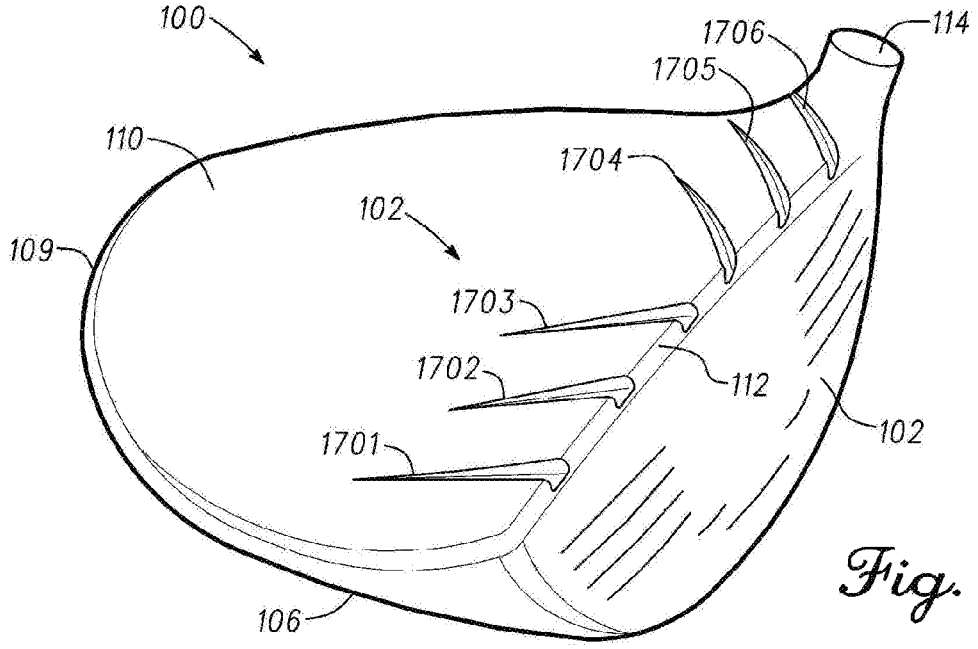
FIGS. 51 and 52 are perspective side and top views, respectively, of a club head having turbulators according to one embodiment.
Figure 52:
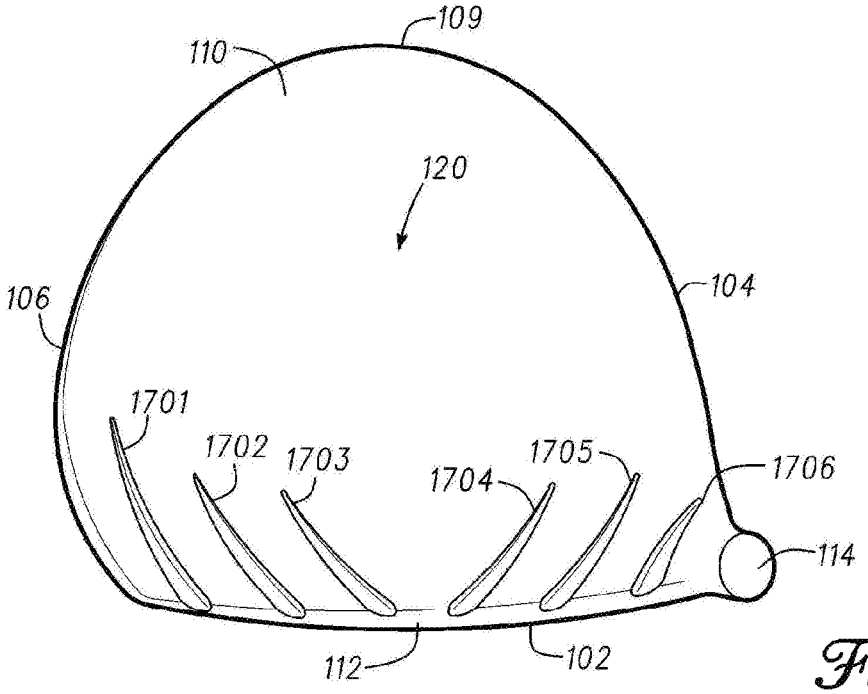

Referring to FIGS. 51 and 52, a golf club head having a plurality of turbulators 1700 according to another example is shown. The golf club head of FIGS. 51 and 52 is similar in many respects to the golf club head 100 of FIGS. 9 and 10. Accordingly, except for the turbulators 1700, same parts of the golf club head 100 of FIGS. 51 and 52 and the golf club head 100 of FIGS. 9 and 10 are referred to with the same reference numbers. The turbulators 1700 are defined by a plurality of grooves 1701-1706 that are positioned at or near the leading edge 112 and extend toward the separation region 120 or toward the rear 109 of the golf club head 100. The grooves 1701-1707 may also be referred to herein as turbulators 1701-1706. The grooves 1701-1706 may extend into the separation region 120. While FIGS. 51 and 52 may depict a particular number of grooves, the apparatus, methods and articles of manufacture described herein may include more or less number of grooves.

Any one or all of the grooves 1701-1706 may be positioned on the crown 110 as close as possible to the leading edge 112 or at least partly on the leading edge 112 such that each groove does not extend beyond the leading edge plane 1614 (shown in FIG. 45). Alternatively, any one or all of the grooves 1701-1706 may be at least partly located on the leading edge 112 and extend beyond the leading edge plane 1614 (i.e., at least partly located between the leading edge plane 1614 and the loft plane 1618). Each of the grooves 1701-1706 may have any length, width, depth and/or cross-sectional profile, such as any profile according to the disclosure. As described above, each groove may be positioned at or near the leading edge 112 and extend toward the separation region 120 or the rear 109 of the golf club head 100. In the example of FIGS. 51 and 52, each groove extends from the leading edge 112 toward the rear 109 of the golf club head 100 with a portion of each groove being located on the leading edge 112. Each of the ridges 1701-1706 may have a greater width and depth at the leading edge 112 than other parts of the grooves. Furthermore, the width and depth of each of the grooves 1701-1706 may diminish from the leading edge 112 toward the rear 109 of the golf club head 100.

The turbulators 1700 may be sized, shaped and positioned on the crown to provide any type of air flow properties over the crown. Each turbulator 1700 may have a certain length, width, depth, longitudinal shape, cross-sectional shape, surface properties (i.e., texture or frictional properties), angular orientation, or any other physical characteristics that may provide certain flow characteristics over the crown. In the example of FIGS. 51 and 52, the turbulator 1701 is longer than the turbulators 1702-1706. Additionally, the turbulator 1701 has a greater curvature than the turbulators 1702-1706. Furthermore, the lengths and curvatures of the turbulators 1701-1703 decrease from the toe end 106 to the center of the crown 110, while the lengths and curvatures of the turbulators 1704-1706 vary from the center of the crown 110 to the heel end 104. The characteristics of each turbulator may depend on the profile of the separation region and the change in the location and the profile of the separation region during the entire golf club swing. For example, air flow separation may be greatest near the toe end 106 and reduce in a direction from the toe end 106 to the center of the crown 110. Accordingly, as shown in FIG. 52, the locations and physical properties of the turbulators 1701-1703 may be determined to delay separation along the profile of the separation region from the toe end 106 to the center of the crown 110. Thus, turbulators according to the disclosure may have any physical characteristics and be located at any location on the crown so as to provide delay in airflow separation on the crown for the entire golf swing.

Each groove 1701-1706 may be oriented generally perpendicular, parallel or oblique relative to the leading edge 112 and/or relative to each other. For example, each groove 1701-1706 may be oriented at an angle between 20° and 70° relative to the leading edge 112. Each groove 1701-1706 may be curved, have variable base width along the length of the grooves, have variable cross-sectional shapes, have variable depth along the length of the groove and/or the width of the groove, have sharp or blunt groove edges, have different surface textures, and/or have other physical variations along the length, the width and/or the depth of the groove.

Figure 53A:
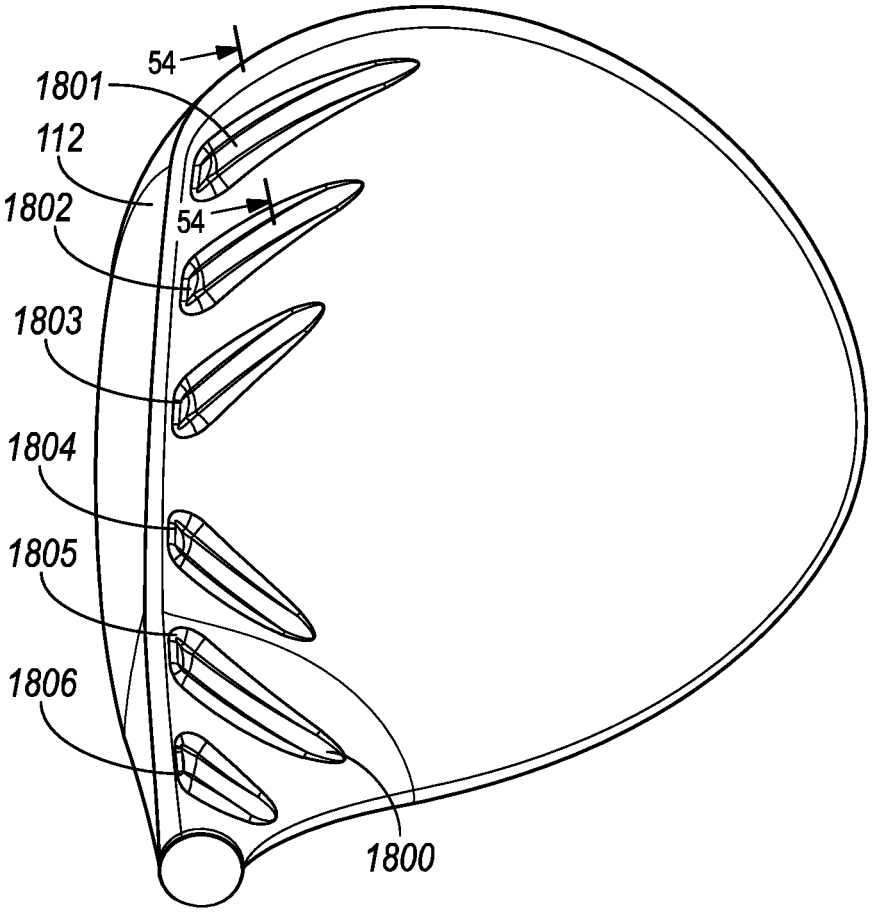
FIG. 53A is a top view of a club head having a turbulator according to one embodiment.
Figure 53B:
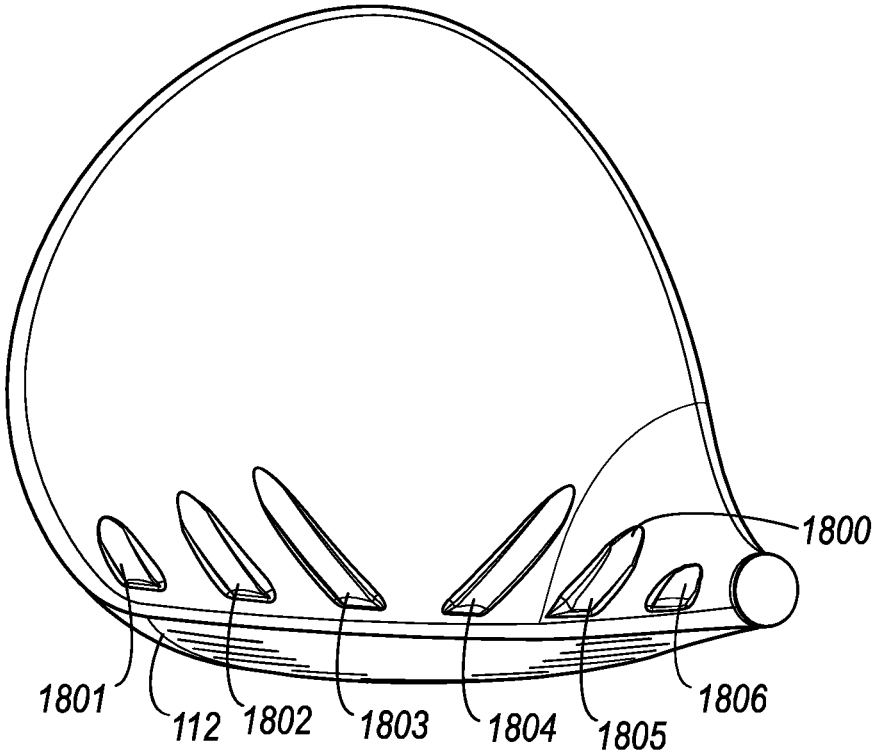
FIG. 53B is a top view of a club head having a turbulator according to another embodiment similar to FIG. 53A.
Figure 53C:
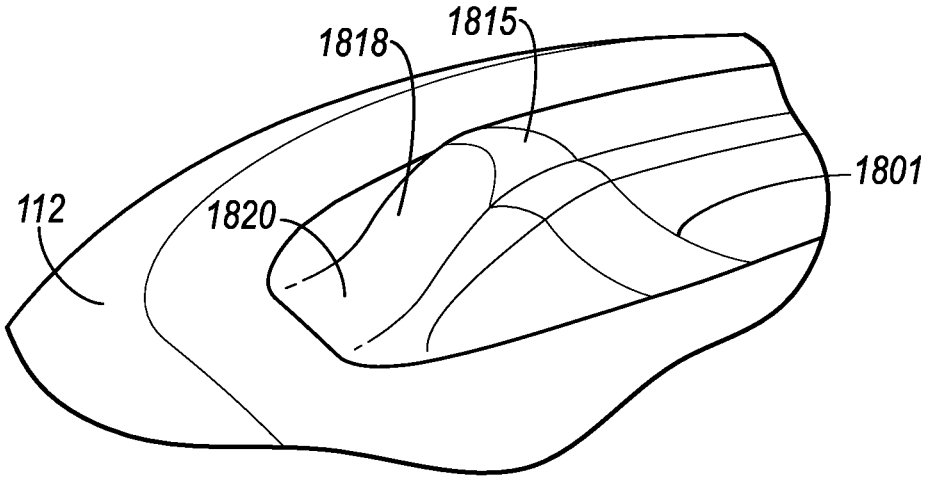
FIG. 53C is a front perspective view of a front surface of the turbulator in FIG. 53*a*.
Figure 54:
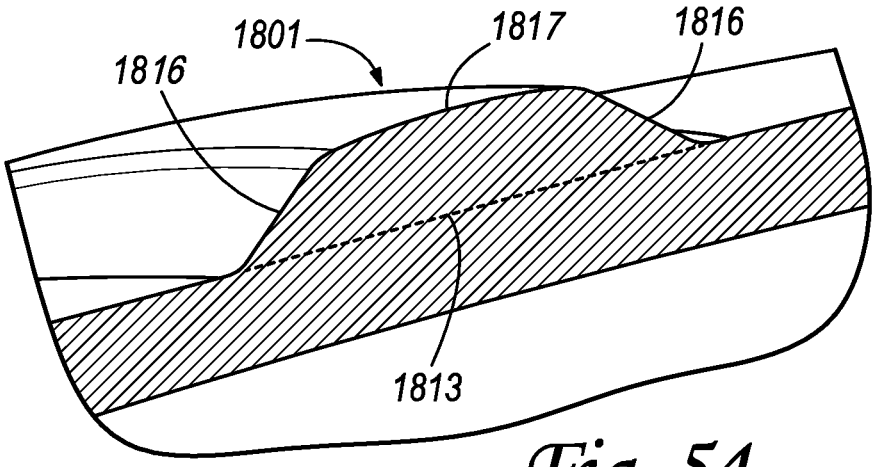
FIG. 54 is a cross-sectional front view of the turbulator in FIG. 53*a*.

As illustrated in FIGS. 53-54 is a golf club head similar in many respects to the golf club head 100 of FIGS. 9 and 10. Further, the leading edge 112 of the golf club head of FIGS. 53-54 are similar in many respects to the leading edge 112 of FIGS. 45-47. Accordingly, except for a turbulator 1800, the same parts of the golf club head of FIGS. 53 and 54 and the golf club head 100 of FIGS. 9 and 10, as well as the same parts of the leading edge 112 of FIGS. 59-61 and the leading edge of FIG. 45-47 can be referred to with the same reference numbers.

The turbulator 1800 in FIGS. 53A, and 53B can comprise a plurality of ridges 1801-1806 positioned at an offset distance from the leading edge 112. The ridges 1801-1806 can comprise a general cross-sectional shape (e.g., triangular, semi-circle, square, rhombus, trapezoidal, pentagonal, or any other appropriate polygonal shape). As illustrated in FIG. 54, the ridge 1801, representing the other ridges 1802-1806 (i.e. same reference numbers), can comprise a trapezoidal cross-sectional shape. From a front cross-sectional view of the ridge 1801, as illustrated in FIG. 54, the ridge comprises a base 1813 positioned directly adjacent to the crown 110, a top surface 1817 opposite the base 1813, and two side walls 1816 extending from the base 1813 to the top surface 1817. From a front perspective view of the ridge 1801, as illustrated in FIG. 53C, the ridge 1801 further comprises a front surface 1820, a ridge apex 1815, and a rear surface (not pictured), wherein the ridge apex 1815 is positioned between the front surface 1820, and the rear surface.

In this exemplary embodiment of FIGS. 53A and 53B, the overall shape of the ridges 1801-1806 illustrated in the turbulator 1800 can present a wider base 1813, a wider top surface 1817, and a more straight-edge transition from the side walls 1816 to the top surface 1817 than previously described turbulators 1600, 1700. For example, in FIG. 53A, each ridge 1801-1806 comprises a base 1813 width, measured perpendicular to the two side walls 1816 in the toe 106 to heel 104 direction, of 0.2 inches, while a width of top surface 1817 of each ridge 1801-1806 is 0.18 inches. In another example as illustrated in FIG. 53B, having wider ridges 1801-1806 than the previous example, the width of the base 1813 of each ridge 1801-1806 is measured to be 0.25 inch, and the width of the top surface 1817 of each ridge 1801-1806 is measured to be 0.225 inch. In other embodiments, each ridge 1801-1806 can comprise a base 1813 and/or top surface 1817 width of between 0.05 to 0.5 inches. In other embodiments, each ridge 1801-1806 can comprise a base 1813 and/or top surface 1817 width of between 0.05 to 0.1 inches, 0.075 to 0.125 inches, 0.1 to 0.15 inches, 0.125 to 0.175 inches, 0.15 to 0.2 inches, 0.140 inches to 0.250 inches, 0.175 to 0.225 inches, 0.2 to 0.25 inches, 0.225 to 0.275 inches, 0.25 to 0.3 inches, 0.200 inches to 0.350 inches, 0.275 to 0.325 inches, 0.3 to 0.35 inches, 0.3 to 0.4 inches, 0.35 to 0.45 inches, or 0.4 to 0.5 inches. In some embodiments, the width of the top surface 1817 can be at least 75% of the width of the base 1813 width. In other embodiments, the width of the top surface 1817 can be at least 40%, at least 50%, at least 60%, at least 70%, at least 80%, at least 90%, or at least 95% of the width of the base 1813. Further, in some embodiment, each of the ridges 1801-1806 has a base 1813 and top surface 1817 having the same width. In other embodiments, the widths of the base 1813 and/or top surface 1817 can vary to other adjacent ridges 1801-1806. Further, the width of the base 1813 and/or top surface 1817 can increase, decrease, remain constant, or any combination thereof along each ridge 1801-1806, moving in a direction from the club face 102 to the rear 109.

Referring again to FIGS. 53A, 53B, 53C and 54, the ridges 1801-1806 can comprise a varying height. The ridges 1801-1806 can comprise the ridge apex 1815 defined as the maximum height of the ridges 1801-1806 measured in a direction perpendicular from the base 1813 of each ridge 180-1806. In the illustrated embodiment, the height of the ridge apex 1815 of the ridges 1801-1806 is 0.06 inches measured perpendicularly from the base 1813. In other embodiments, the height of the ridge apex 1815 can be between 0.02 to 0.4 inches. For example, in some embodiments, the height of the ridge apex 1815 can be between 0.02 to 0.1, 0.05 to 0.15, 0.1 to 0.2, 0.15 to 0.25, 0.2 to 0.3, 0.25 to 0.35, or 0.3 to 0.4 inches. In the illustrated embodiment, the ridge apex 1815 can be positioned closer to the front surface 1820 than to a rear surface 1830 of the ridge 1801-1806. In some embodiments, the ridge apex 1815 can be positioned within the first 50%, the first 40%, the first 30%, the first 20%, the first 10%, the first 5%, or the first 1% of the length of the entire ridge 1801-1806. In other embodiments, the ridge apex 1815 can be positioned within 0.05, within 0.1, within 0.2, within 0.3, within 0.4, within 0.5, within 0.6, within 0.7, within 0.8, within 0.9, or within 1.0 inches of the front surface 1820. In other embodiments, the ridge apex 1815 can be positioned closer to the rear surface 1830 than the front surface 1820 of the ridge 1801-1806.

The front surface 1820 of the ridges 1801-1806 define a portion of the ridges 1801-1806 closest to the club face 102 of the golf club head 100; while the rear surface of the ridges 1810-1806 define a portion of the ridges 1801-1806 closest to the rear 109 of the golf club head 100. The front surface 1820 of the ridges 1801-1806 can be offset from the leading edge 112, and extends from near the faceplate toward the rear 109 of the golf club head. The leading edge 112 can comprise the leading edge plane 1614 forming the leading edge angle 1616 with the loft plane 1618 as described previously, wherein the front surface of the plurality of ridges 2101-2106 being at least partly located between the leading edge plane 1614 and the rear 109, but not extending beyond the leading edge plane 1614.

The front surface 1820 of each ridge 1801-1806 can be positioned at a distance offset from the leading edge and extending towards the back of the crown 110. The offset distance may vary from 0.01 inch to 0.6 inch. For example, the front surface 1820 may be offset from the leading edge 112 by 0.1 inch or 0.2 inch or 0.3 inch or 0.4 inch or 0.5 inch or 0.6 inch. Additionally, the distance between the leading edge 112 and the front surface 1820 may vary for each ridge 1801-1806 from the heel end 104 to the toe end 106 to approximately correspond with the location of the separation line 120. In a specific embodiment, illustrated in FIG. 53A, the front surface 1820 of each ridge 1801-1806 is offset from the leading edge 112 by a distance of 0.1 inch.

Additionally, the ridges 1801-1806 include a height that will increase across their front surface 1820. The height of each ridge 1801-1806 is measured in a direction perpendicular from the base 1813 of each ridge 1801-1806. The height of each ridge 1801-1806 can range from 0.01 to 0.35 inches. For example, the height of each ridge 1801-1806 can be 0.01 inches, 0.05 inches, 0.10 inches, 0.15 inches, 0.20 inches, 0.25 inches, 0.30 inches, or 0.35 inches.

Referring to FIG. 53C, illustrated is an exemplary embodiment of the front surface 1820 of a single ridge 1801 from the turbulator 1800. The front surface 1820 can include a concave curvature, a convex curvature and an inflection point positioned at a point in which the concave curvature transitions into the convex curvature. The radius of the convex and concave curvature may vary from 0.1 inch to 1.6 inch. For example, the front surface 1820 may have a concave or convex curvature of 0.1 inch or 0.4 inch or 0.7 inch or 1 inch or 1.3 inch or 1.6 inch. Additionally, the front surface 1820 may have a length measured from the base 1817 to the ridge apex 1815, ranging from 0.15 inch to 0.35 inch. Further, if the front surface 1820 has a concave and then a convex curvature or a convex and then a concave curvature, the inflection point 1818 may be positioned at any point which can be at least 40% along the length of the front surface 1820.

In a specific embodiment, illustrated in FIG. 53C, the concave curvature (curving toward the crown 110) has a radius of 0.4 inch and extends to the inflection point 1818, whereat the curvature then changes to become convex (curving away from the crown 110) and extends to an apex 1815 or highest or tallest point on the ridge 1801. In other words, the front surface 1820 extends from a position behind the leading edge 112 toward the back of the crown 110 at an angle, which can be greater than the leading edge angle 1616. The angle can decrease until reaching an inflection point 1818, where the angle can then begin to increase in relation to the leading edge angle 1616.

Referring to FIG. 54, an exemplary embodiment of the front view cross-sectional shape of the ridges 1801-1806 is shown. As discussed above, the overall shape of the ridges 1801-1806 has a wider base 1813, a wider top surface 1817, and a more straight-edge transition from the side wall 1816 to the top surface 1817 to a wider top surface 1817 than previously described turbulators 1600, 1700. The base width may vary from 0.05 inch to 0.5 inch while the width of the top surface 1817 will vary to stay smaller than the base 1813 width. In other embodiments, the width of the top surface 1817 can be the same or greater than the base 1813 width.

In a specific embodiment, illustrated in FIG. 54, the cross sectional shape of the ridges 1801-1806 can take the form of a trapezoid. The trapezoid includes the base 1813 having a width of 0.20 inches and the two side walls 1816. The two side walls 1816 extend from the base 1813 to the top surface 1817 and are tapered at an angle of 80°. In other embodiments, the two side walls 1816 can be tapered at an angle of at least 85°, at least 80°, at least 70°, at least 60°, at least 50°, at least 40°, or at least 30°. The top surface 1817 extends between side walls 1816, having a top surface 1817 width of 0.184 inches.

In some embodiments, the transition between the side walls 1816 and the top surface 1817 can comprise a round or a fillet or a chamfer. For example, the transition between the side walls 1816 and the top surface 1817 can comprise a round having a radius of between 0.01 and 0.1 inches. In other embodiments, the transition between the side wall 1816 and the top surface 1817 can comprise a round having a radius of between 0.01 to 0.03, 0.02 to 0.04, 0.03 to 0.05, 0.04 to 0.06, 0.05 to 0.07, 0.06 to 0.08, 0.07 to 0.09, or 0.08 to 0.1 inches. Further, in some embodiments, the transition between the side walls 1816 and the crown 110 can also comprise a round or a fillet or a chamfer. For example, the transition between the side walls 1816 and the crown 110 can comprise a round having a radius of between 0.05 and 1.0 inches. In other embodiments, the transition between the side wall 1816 and the crown 110 can comprise a round having a radius of between 0.05 to 0.15, 0.1 to 0.2, 0.2 to 0.3, 0.3 to 0.4, 0.4 to 0.5, 0.5 to 0.6, 0.6 to 0.7, 0.7 to 0.8, 0.8 to 0.9, or 0.9 to 1.0 inches.

In the illustrated embodiment, the top surface 1817 can have a curved surface extending between the side walls 1816. In other embodiments, the top surface 1817 can comprise a planar surface extending between the side walls 1816 creating a flatter profile than the turbulator 1800 illustrated. The top surface 1817 can further comprise a top surface radius as the measure of curvature from between the side walls 1816. The top radius can be at least 0.2 degrees or greater. As illustrated in FIG. 54B, the top radius of the top surface 1817 is 0.4 degrees.

Each ridge 1801-1806 can be curved, can have a variable base width 1813 along the length, can have a variable cross-sectional shapes, can have a variable height along the length and/or the base width 1813, can have a different surface textures, and/or can have a other physical variations along the length, the base width 1813 and/or the height. The length of each ridge can vary from the heel end 104 to the toe end 106 to approximately correspond with the location of the separation line 120 on the crown 110. Further, the length of each ridge can be substantially greater than the base width. In many embodiments, the turbulator 1800 is shown to comprise 6 ridges 1801-1806. In other embodiments, the turbulator 1800 can include more or less than 6 turbulators 1800.

Club Heads with Protrusions

Figure 55:
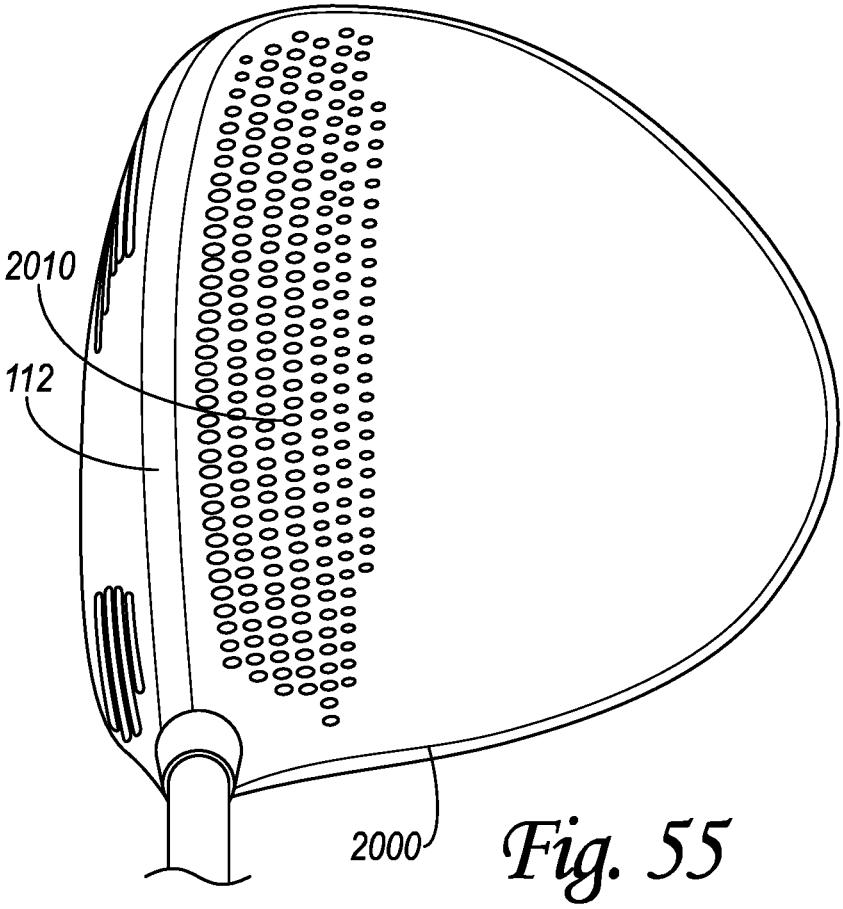
FIG. 55 is a top view of a club head having a plurality of protrusions according to one embodiment.
Figure 56:
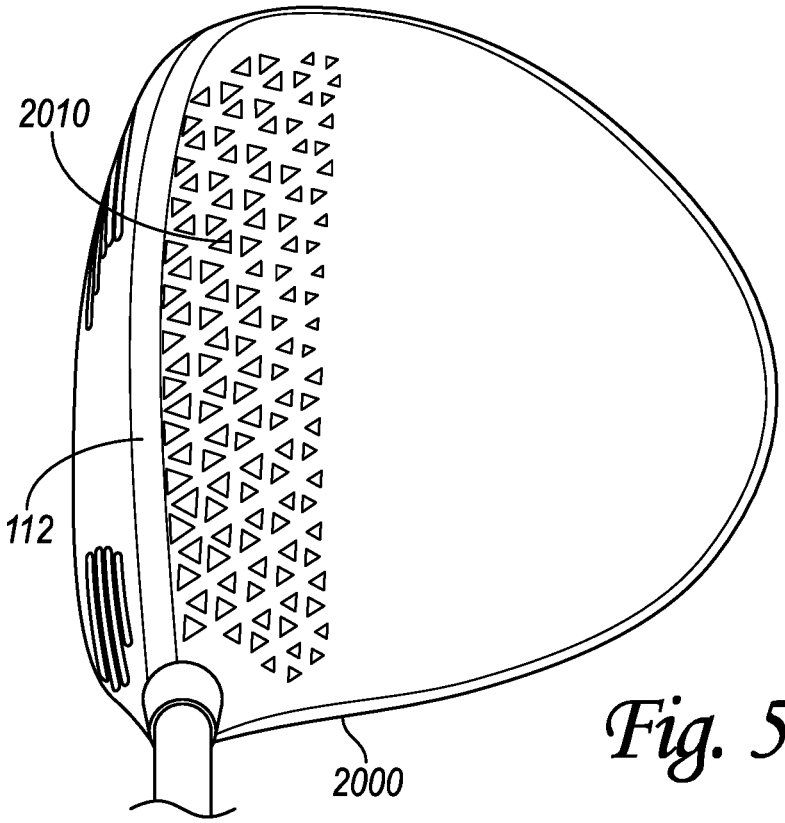
FIG. 56 is a top view of a club head having a plurality of protrusions according to another embodiment.

FIGS. 55-56 illustrate a golf club head comprising a plurality of protrusions on a crown of the golf club head, wherein the positioning of the plurality of protrusions can effect aerodynamics. Referring to FIGS. 55 and 56, a plurality of protrusions 2010 is displayed on the crown 110 of the golf club head 100. The golf club heads shown in FIGS. 55 and 56 are similar in many respects to the golf club head 100 of FIGS. 9 and 10. Accordingly, except for the plurality of protrusions 2010, the same parts of the golf club head of FIGS. 55 and 56, and the golf club head 100 of FIGS. 9 and 10 can be referred to with the same reference numbers. Each protrusion 2010 extends outwardly from the crown 110 of the club head 100.

The protrusion 2010 can be located in a region beginning adjacent to the leading edge 112 of the club head 100 and extending toward the rear end of the club head 100. In many embodiments, from a front to rear 109 of the golf club head 100, ⅓ of the crown 110 can comprise the protrusions 2010. In other embodiments, from a front to rear 109 of the golf club head 100, 25%, 50%, 75%, or 100% of the crown 110 can comprise the protrusions 2010.

In specific embodiments illustrated in FIGS. 55 and 56, the protrusions 2010 begin adjacent to the leading edge 112 and extend the first ⅓ of the crown towards the rear of the club head. The protrusions can be positioned such that they form a pattern of lines extending from the heel end 104 to the toe end 106 of the club head 100. In other embodiments, the protrusions may be positioned to create any pattern along the crown 110 of the club head.

The protrusions 2010 may comprise various geometries. Each protrusion 2010 includes a height extending outward from the outer surface of the crown 110. In many embodiments, the height of the protrusions can be less than approximately 0.02 inch. However, the height of each protrusion 2010 can range from 0.005 inch to 0.04 inch. When viewed from above, the protrusions can comprise any shape. For example the protrusions can be circular, elliptical, triangular, trapezoidal or any other suitable geometric shape. In the illustrated embodiments of FIGS. 55 and 56, the height and shape of the protrusions 2010 can remain constant across the plurality of protrusions, while the size decrease as the protrusions 2010 extend towards the rear of the club head 100. In other embodiments, the shape, size, height and/or number of the protrusions 2010 can vary in any direction or according to any profile.

The plurality of protrusion 2010 can form any pattern across the surface of the club head. For example, the protrusions 2010 can create a linear pattern running in any direction, a checkered pattern, a zigzag pattern or any other suitable pattern. Further, the protrusion 2010 can be positioned in a non-uniform manner with the goal to improve the aerodynamics of the club head. In specific examples, FIG. 55 illustrates the protrusions 2010 can have an elliptical shape while FIG. 56 illustrates the protrusion 2010 can have a triangular shape and alternating orientation (rotating 180°) with each neighboring protrusion 2010 from the toe 104 to the heel 106 of the club head 100.

The protrusions 2010 can comprise any suitable material. In many embodiments, the protrusions can comprise a polymer based paint that can include other powdered materials to add structural integrity. The protrusions can be applied to the club head 100 by layered screen printing, or by any other suitable method.

Club Heads with Turbulators and Protrusions

Figure 57:
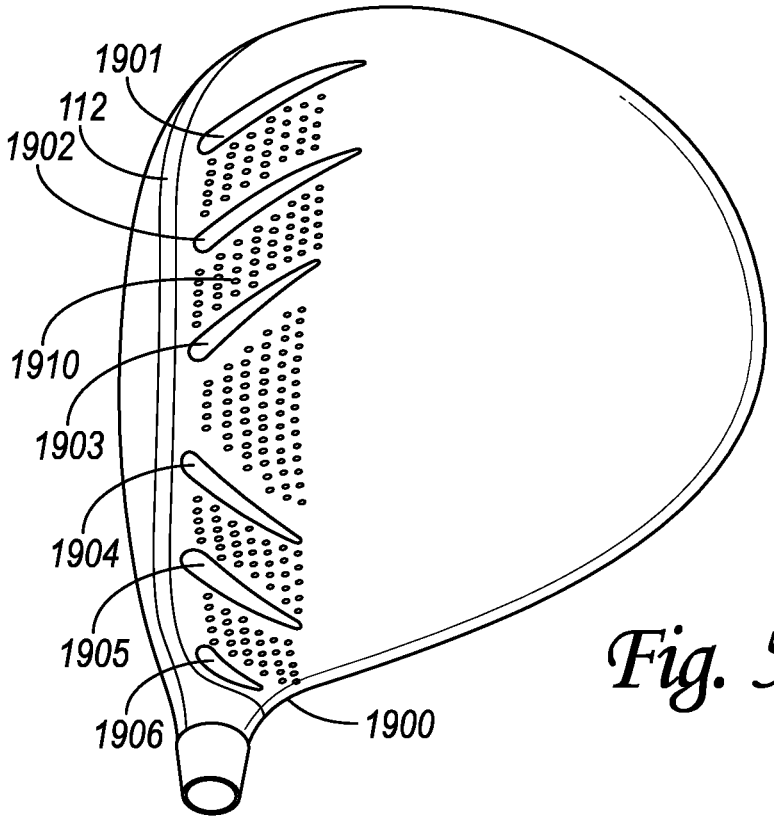
FIG. 57 is a top view of a club head having a plurality of protrusions and turbulators according to one embodiment.
Figure 58:
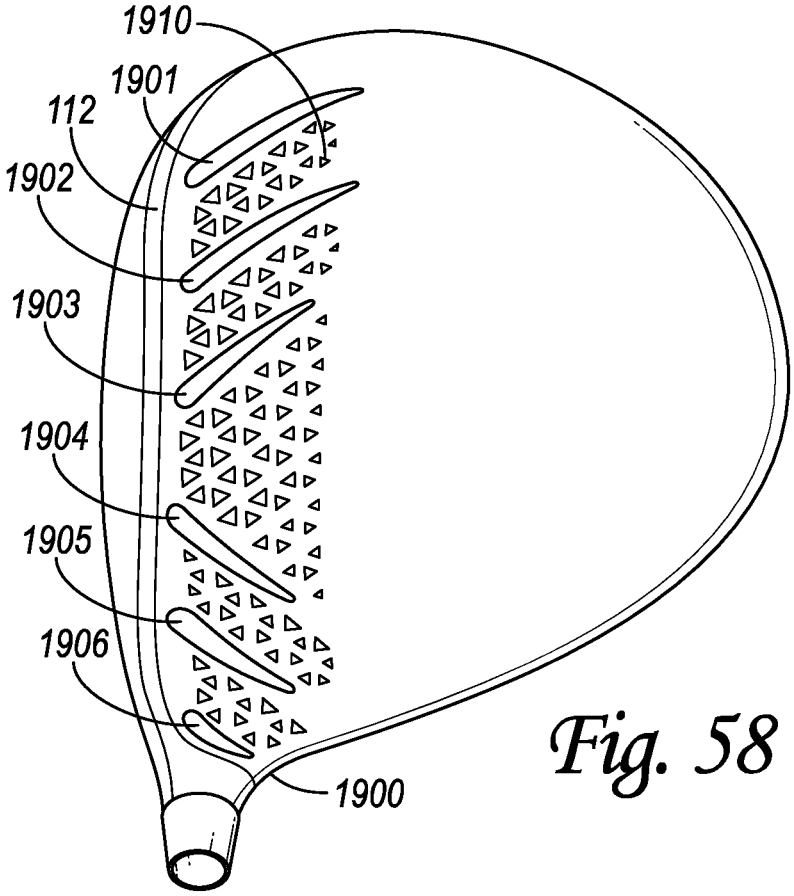
FIG. 58 is a top view of a club head having a plurality of protrusions and turbulators according to another embodiment.

FIGS. 57-58 illustrate a golf club head comprising a plurality of protrusions, and a turbulator, both positioned on a crown of the golf club head. The plurality of protrusions and turbulator positioned on the crown can effect aerodynamics of the golf club head. Referring to FIGS. 57 and 58, a plurality of protrusion 1910 is shown on the crown 110 of a golf club head. The golf club head shown in FIGS. 57 and 58 can be similar in many respects to the golf club head 100 of FIGS. 9 and 10. Accordingly, except for the turbulator 1900 and the plurality of protrusions 1910, the same parts of the golf club head of FIGS. 57 and 58 and the golf club head 100 of FIGS. 9 and 10 can be referred to with the same reference numbers. The turbulator 1900 can be defined by a plurality of ridges 1901-1906 that can be positioned at or near the leading edge 112 and extend toward the separation region 120 or toward the rear 109 of the golf club head 100. The ridges 1901-1906 can comprise the design of any of the previously discussed turbulators. The golf club head can further comprises a plurality of protrusions 1910 positioned in the areas between the ridges 1901-1906. The protrusions 1910 can extend in an outward fashion from the crown 110 of the club head 100.

Referring to FIG. 57, an exemplary embodiment of a turbulator 1900 including a plurality of ridges 1901-1906 is shown. Each ridge 1901-1906 having a front surface 1920 can be positioned at a distance offset from the leading edge and extending towards the back of the crown 110. The offset distance may vary from 0.01 inch to 0.6 inch. For example, the front surface 1820 can be offset from the leading edge 112 by 0.1 inch or 0.2 inch or 0.3 inch or 0.4 inch or 0.5 inch or 0.6 inch. Additionally, the distance between the leading edge 112 and the front surface 1820 can vary for each ridge 1801-1806 from the heel end 104 to the toe end 106 to approximately correspond with the location of the separation line 120. In a specific embodiment, illustrated in FIG. 53A, the front surface 1820 of each ridge 1801-1806 can be offset from the leading edge 112 by a distance of 0.1 inch.

The ridges 1901-1906 can have any cross-sectional shape. For example, the ridges 1901-1906 can have a cross-sectional shape in the form of a square, a triangle, a half-circle or any other suitable geometric shape. Additionally, the ridges 1901-1906 can include a height that can increase across their front surface 1920. Further, the height of the ridges 1901-1906 can increase, decrease or remain the same from the apex point 1915 towards the rear of the club head 100. The ridges 1901-1906 can comprise a wider base 1913 and/or top surface 1917 similar to the widths described above corresponding to the ridges 1801-1806. In other embodiments, the ridges 1901-1906 can comprise a narrower top surface 1917 similar to the shape of the turbulators 1600, 1700.

Each ridge 1901-1906 can be curved, can have a variable base width along the length, can have a variable cross-sectional shapes, can have a variable height along the length and/or the base width, can have a different surface textures, and/or can have other physical variations along the length, the base width and/or the height. The length of each ridge can vary from the heel end 104 to the toe end 106 to approximately correspond with the location of the separation line 120 on the crown 110. Further, the length of each ridge can be substantially greater than the base width. In many embodiments the turbulator 1900 can comprise 6 ridges 1901-1906. In other embodiments the turbulator 1800 can comprise more or less than 6 ridges (1 ridge, two ridges, three ridges, four ridges, five ridges, six ridges, seven ridges, or eight ridges).

The protrusions 1910 are located in a region beginning adjacent to the leading edge 112 of the club head 100 and extending toward the rear end of the club head 100. In many embodiments, from the club face 102 to the rear 109, ⅓ of the crown can comprise the protrusions 1910 In other embodiments, from the club face 102 to the rear 109, any percent of the surface area of the crown 110, such as 25%, 50%, 75%, or 100% can comprise the protrusions 1910. The protrusions 1910 are positioned between the plurality of ridges 1901-1906.

The protrusions 1910 can comprise various geometries. Each protrusion 1910 includes a height extending outward from the outer surface of the crown 110. In many embodiments, the height of the protrusions can be less than approximately 0.02 inch. However, the height of each protrusion 1910 can range from 0.005 inch to 0.04 inch. When viewed from above, the protrusions can comprise any shape. For example, the protrusions can be circular, elliptical, triangular, trapezoidal or any other suitable geometric shape. In the illustrated embodiments of FIGS. 57 and 58, the height and shape of the protrusions 1910 can remain constant across the plurality of protrusions, while the size can decrease as the protrusions 1910 extend towards the rear of the club head 100. In other embodiments, the shape, size, height and/or number of the protrusions 1910 can vary in any direction or according to any profile.

The plurality of protrusion 1910 can form any pattern across the surface of the club head. For example, the protrusions 1910 can create a linear pattern running in any direction, a checkered pattern, a zigzag pattern or any other suitable pattern. Further, the protrusion 1910 can be positioned in a non-uniform manner with the goal to improve the aerodynamics of the club head. In specific examples, FIG. 57 illustrates the protrusions 1910 can have an elliptical shape, while FIG. 58 illustrates the protrusion 1910 can have a triangular shape and alternating orientation (rotating 180°) with each neighboring protrusion 1910 from the toe 104 to the heel 106 of the club head 100.

The protrusions 1910 can comprise any suitable material. In many embodiments, the protrusions can comprise a polymer based paint that can include other powdered materials to add structural integrity. The protrusions can be applied to the club head 100 by layered screen printing, or by any other suitable method.

Reverse Turbulators

Figure 59:
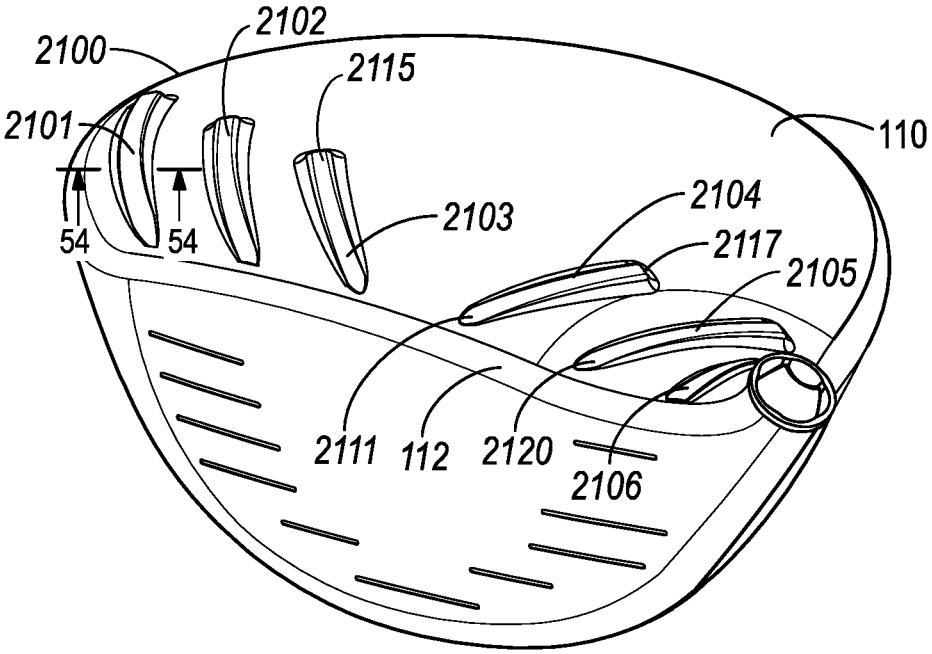
FIG. 59 is a top view of a club head having a turbulator according to another embodiment.
Figure 60:
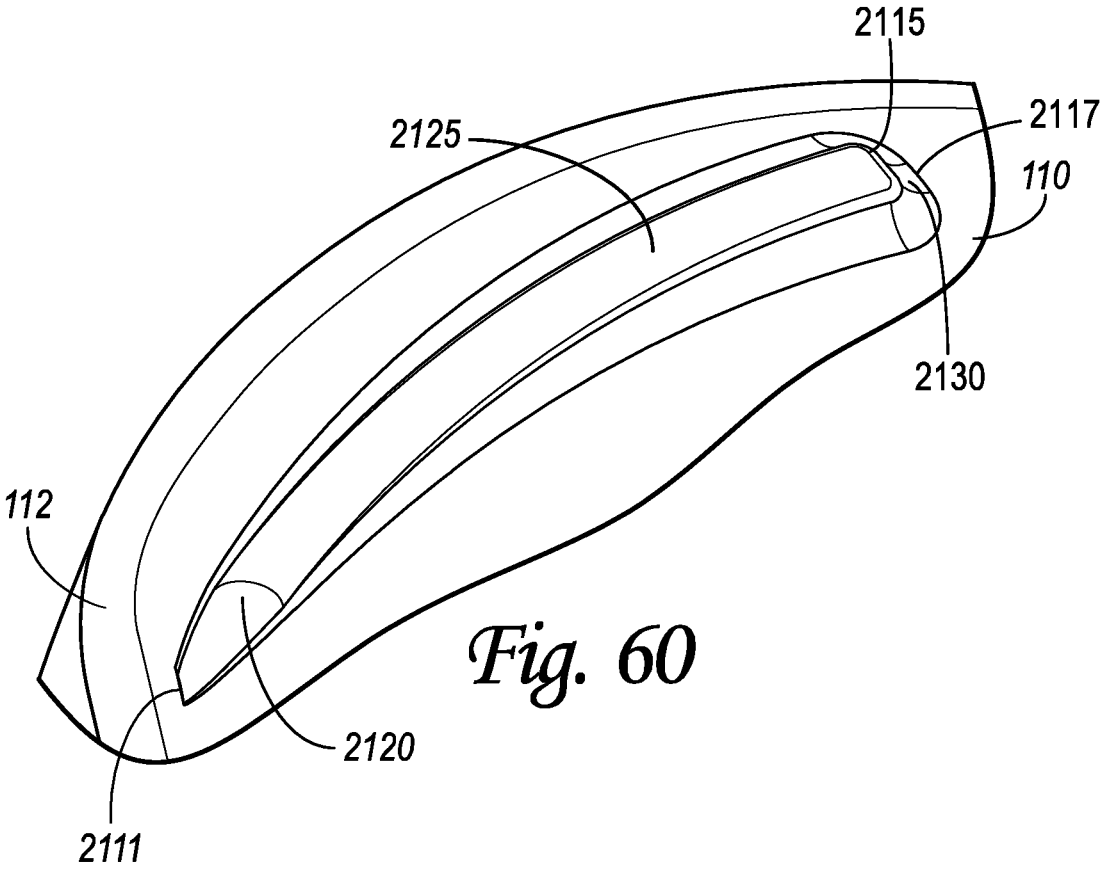
FIG. 60 is a top perspective view of a front surface of the turbulator in FIG. 44.
Figure 61:
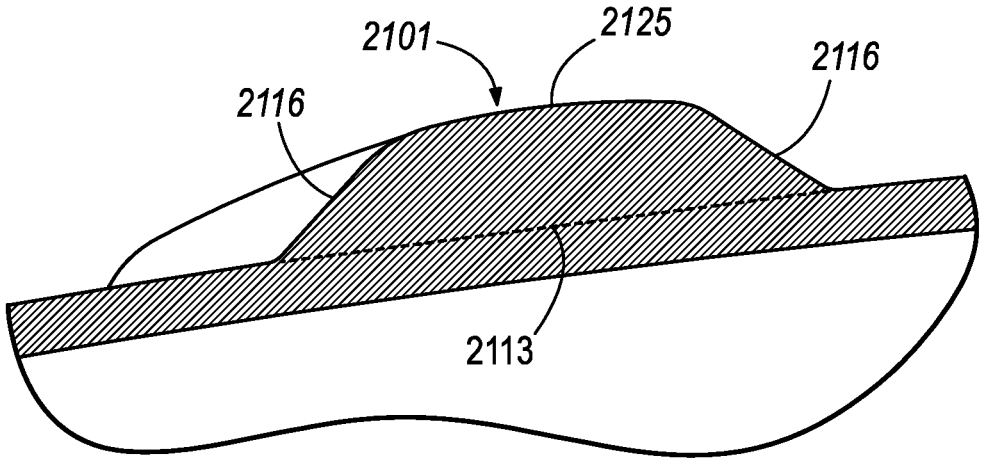
FIG. 61 is a cross-sectional front view of the turbulator in FIG. 44.

FIGS. 59-61 illustrate a golf club head comprises a turbulator similar to the turbulator of FIGS. 53-54, but in a reverse (180 degree rotation) orientation; wherein a height of the turbulator increase as the turbulator extends from in a direction from the front to the rear of the golf club head. Illustrated in FIGS. 59-61 is a crown 110 of a golf club head comprising a turbulator 2100. The crown 110 of golf club head shown in FIGS. 59-61 can be similar in many respects to the crown 110 of golf club head 100 of FIGS. 9 and 10, and can comprising a leading edge 112 similar in many respects to FIGS. 45-47. Accordingly, except for the turbulator 2100, the same parts of the golf club head of FIGS. 59-61 and the golf club head 100 of FIGS. 9 and 10, as well as the same parts of the leading edge 112 of FIGS. 59-61 and the leading edge of FIG. 45-47 can be referred to with the same reference numbers. The turbulator 2100 can include a plurality of ridges 2101-2106 comprising a front edge 2111 that can be positioned at least partially on or at an offset distance from the leading edge 112. The leading edge 112 can comprise the leading edge plane 1614 forming the leading edge angle 1616 with the loft plane 1618 as described previously, wherein the front surface of the plurality of ridges 2101-2106 can be at least partly located between the leading edge plane 1614 and the rear 109, but not extending beyond the leading edge plane 1614.

In the illustrated embodiment, the overall shape of the ridges 2101-2106 can be similar to the overall shape of the ridges 1801-1806 of the turbulator 1800, can comprise a wider base 2113 and wider top surface 2125. However, in contrast to the ridges 1801-1806, the ridges 2101-2106 can comprise a ridge apex 2115 which can be positioned closer to a rear surface 2130 or a rear end (second end) 2117 of the ridge 2101-2106 than it is to a front surface 2120 or a front end (first end) 2111 of the ridges 2101-2106.

Referring now to FIG. 60, as discussed above, each ridge 2101-2106 comprises the front edge 2111 that can be positioned on or offset from the leading edge 112. In the illustrated embodiment, ridges 2101-2106 can comprise the front edge 2111 that can be offset from the leading edge 112 by 0.1 inches. In other embodiments, the offset distance can vary from 0.01 to 0.6 inches. For example, the front edge 2111 can be offset from the leading edge 112 by 0.1 or 0.2 or 0.3 or 0.4 or 0.5 or 0.6 inches. Additionally, the distance between the leading edge 112 and the front edge 2111 can vary for each ridge 2101-2106 from the heel end 104 to the toe end 106 to approximately correspond with the location of the separation line 120. In other embodiments, the front edge 2111 of at least one of the ridges 2101-2106 can be positioned at least partially on the leading edge 112. For example, in some embodiments, the front edge 2111 of 1, 2, 3, 4, 5, or 6 of the ridges 2101-2106 can be positioned at least partially on the leading edge 112.

Referring again to FIG. 60, each ridge 2102-2106 can comprises the front surface 2120 defined as the portion of each ridge 2102-2106 closest to the club face 102, extending from the front edge 2111 to a top surface 2125 of the ridge 2102-2106. In comparison, each ridge 2101-2106 can further comprise a rear surface 2130 defined as the portion of each ridge 2101-2106 closest to the rear 109 of the golf club head 100. In the illustrated embodiment, the front surface 2120 can comprise a curved surface which can extend from the front edge 2111 to the top surface 2125. For example, the front surface 2120 can comprise a concave curvature with respect to the crown 110, or the front surface 2120 can comprise a convex curvature with respect to the crown 110. In some embodiments, the radius of curvature of the front surface 2120 can vary from 0.1 to 1.6 inches. For example, the front surface 2120 can have a concave or convex curvature including a radius of 0.1 to 0.4, 0.3 to 0.7, 0.5 to 0.9, 0.7 to 1.1, 0.9 to 1.3, 1.1 to 1.5, or 1.3 to 1.6 inches. In other embodiments, the front surface 2120 can comprise a planar surface which extends from the front edge 2111 to the top surface 2125. Further, the front surface 2120 can have a length extending away from the front edge 2111 within the range of 0.01 to 2.0 inches. For example, in some embodiments, the front surface 2120 can have a length of 0.01-0.1, 0.05-0.15, 0.1-0.2, 0.15-0.25, 0.2-0.3, 0.25-0.35, 0.3-0.6, 0.4-0.7, 0.5-0.8, 0.6-0.9, 0.7-1.0, 0.8-1.1, 0.9-1.2, 1.0-1.3, 1.1-1.4, 1.2-1.5, 1.3-1.6, 1.4-1.7, 1.5-1.8, 1.6-1.9, or 1.7-2.0 inches.

Referring now to FIGS. 59 and 60, the top surface 2125 of the ridges 2101-2106 can extend from the front surface 2120 to the ridge apex 2115. The ridge apex 1815 can be defined as the maximum height or tallest point of the ridge 2101-2106 measured in a direction perpendicular from the base 2113. In the illustrated embodiment, the height of the ridge apex can be 0.06 inches. In other embodiments, the height of the ridge apex 2115 can be between 0.02 to 0.4 inches. For example, in some embodiments, the height of the ridge apex 2115 can be between 0.02 to 0.1, 0.05 to 0.15, 0.1 to 0.2, 0.15 to 0.25, 0.2 to 0.3, 0.25 to 0.35, or 0.3 to 0.4 inches. In the illustrated embodiment, the ridge apex 2115 can be positioned closer to the rear end 2117 than to the front end 2111 of the ridge 2101-2106. In some embodiments, the ridge apex 2115 can be positioned within the last 50%, the last 40%, the last 30%, the last 20%, the last 10%, the last 5%, or the last 1% of the length of the entire ridge 2101-2106. In other embodiments, the ridge apex 2115 can be positioned within 0.05, within 0.1, within 0.2, within 0.3, within 0.4, within 0.5, within 0.6, within 0.7, within 0.8, within 0.9, or within 1.0 inches of the rear end 2117. In other embodiments, the ridge apex 2115 can be positioned closer to the front end 2111 than to the rear end 2117 of the ridge 2101-2106. Further, the top surface 2125 can comprise a length measured as the distance from the front surface 2120 to the ridge apex 2115. In many embodiments, the length of the top surface 2125 can vary from 0.1 to 3.0 inches. For example, the top surface 2125 can have a length of 0.1-0.5, 0.3-0.8, 0.5-1.0, 0.8-1.3, 1.0-1.5, 1.25-1.75, 1.5-2.0, 1.75-2.25, 2.0-2.5, 2.25-2.75, or 2.5-3.0 inches. Further, each ridge 2101-2106 can comprise a rear surface 2130 extending from the ridge apex 2115 to the rear end 2117 of the ridge 2101-2106. The rear surface 2130 can comprise a curved surface, or the rear surface 2130 can comprise a planar surface.

As illustrated in FIG. 61 is a cross-sectional shape of the ridges 2101-2106. In the illustrated embodiments, the overall shape of the ridges 2101-2106 can be similar to ridges 1801-1806, can have a wider base 2113, can have a wider top surface 2125, and can have a more straight-edge transition from the side wall 2116 to the top surface 2125 compared to previously described ridges 1601-1606. The base 2113 width can vary from 0.05 inch to 0.5 inch while the width of the top surface 2125 can vary to stay smaller than the base 2113 width. In other embodiments, the width of the top surface 2125 can be greater than or equal to the base 2113 width. In some embodiments, the transition between the side walls 2116 and the top surface 2125 can comprise a round or a fillet or a chamfer. For example, the transition between the side walls 2116 and the top surface 2125 can comprise a round having a radius of between 0.01 and 0.1 inches. In other embodiments, the transition between the side wall 2116 and the top surface 2125 can comprise a round having a radius of between 0.01 to 0.03, 0.02 to 0.04, 0.03 to 0.05, 0.04 to 0.06, 0.05 to 0.07, 0.06 to 0.08, 0.07 to 0.09, or 0.08 to 0.1 inches. Further, in some embodiments, the transition between the side walls 2116 and the crown 110 can also comprise a round or a fillet or a chamfer. For example, the transition between the side walls 2116 and the crown 110 can comprise a round having a radius of between 0.05 and 1.0 inches. In other embodiments, the transition between the side wall 2116 and the crown 110 can comprise a round having a radius of between 0.05 to 0.15, 0.1 to 0.2, 0.2 to 0.3, 0.3 to 0.4, 0.4 to 0.5, 0.5 to 0.6, 0.6 to 0.7, 0.7 to 0.8, 0.8 to 0.9, or 0.9 to 1.0 inches. In the illustrated embodiment, the top surface 2125 can have a curved surface extending between the side walls 2116. In other embodiments, the top surface 2125 can comprise a planar surface extending between the side walls 2116 creating a flatter profile than the turbulator 2100 illustrated. In other embodiments, the ridges 2101-2106 can have any cross-sectional shape. For example, the ridges 2101-2106 can have a cross-sectional shape in the form of a square, a triangle, a half-circle or any other suitable geometric shape.

In a specific embodiment, illustrated in FIG. 61, the cross sectional shape of the ridges 2101-2106 can have the form of a trapezoid. The trapezoid can comprise a base 2113 having a width of 0.20 inches and two side walls 2116. The two side walls 2116 extend from the base 2113 to the top surface 2125 and arcan taper toward the top surface 2125 at an angle of 80°. In other embodiments, the two side walls 2116 can be tapered at an angle of at least 85°, at least 80°, at least 70°, at least 60°, at least 50°, at least 40°, or at least 30°. The top surface 2125 extends between the two side walls 2116 having a width of 0.184 inches. In the illustrated embodiment, the top surface 2125 can have a curved surface extending between the two side walls 2116. In other embodiments, the top surface 2125 can comprise a planar surface extending between the two side walls 2116 creating a flatter profile than the turbulator 2100 illustrated.

Further, each ridge 2101-2106 can extend in a planar or curved manner from the front end 2111 to the rear end 2117 of the ridges 2101-2106. The base 2113, and/or top surface 2125 widths can increase, decrease, or remain constant along the length of each ridge 2101-2106. Further, the height of each ridged 2101-2106 can increase, decrease or remain constant across both the length and the width of the ridge 2101-2106. Each ridge 2101-2106 can have the same cross-sectional shape or the ridges 2101-2106 can have different cross-sectional shapes. Additionally, the cross-sectional shapes of each ridge can change across the length of the ridge. In some embodiments, the surface texture can remain the same or can vary across the length and or width of the ridges 2101-2106. Further, each individual ridge 2101-2106 can have the same surface texture or each ridge 2101-2106 can have a different surface texture.

In some embodiments, the length of each ridge 2101-2106 of the turbulator 2100 can vary from the heel end 104 to the toe end 106 of the club head, to approximately correspond with the location of the separation line 120 on the crown 110. Further, the length of each ridge 2101-2106 can be substantially greater than the base 2113 width. In other embodiments, the length of each ridge 2101-2106 can be substantially less than its base 2113 width. Further, in many embodiments the turbulator 2100 can comprise 6 ridges 2101-2106. In other embodiments the turbulator 2100 may include more or less than 6 ridges 2101-2106.

Tables 5-7 show experimental results for a golf club head with the turbulator 1800 (having the ridge apex 1815 positioned closer to the front surface 1820 than to the rear surface 1830) and a golf club head with the turbulator 2100 (having the ridge apex 2115 positioned closer to the front edge 2111 than to the rear edge 2117). Table 5 shows measured values of the aerodynamic drag expressed in lbf for different orientation angles of the club head at 80 mph. The orientation angles are measured with respect to a club head which is square to the ball at impact. Therefore the orientation angles of 0°, 20° and 40° represent different points in a swing. The 0° face angle is considered to be at the point of impact. The 20° and 40° face angles are considered to be at points in the swing wherein the club head 100 is behind the point of impact.

TABLE 5

| Orientation Angle | Turbulator 1800 | Turbulator 2100 |
|---|---|---|
| 0° Face Angle | 0.5105 | 0.4385 |
| 20° Open Face Angle | 0.6813 | 0.7070 |
| 40° Open Face Angle | 0.7680 | 0.7041 |

Table 6 shows measured values of the aerodynamic drag expressed in lbf for different orientation angles of the club head at 100 mph.

TABLE 6

| Orientation Angle | Turbulator 1800 | Turbulator 2100 |
|---|---|---|
| 0° Face Angle | 0.7867 | 0.7065 |
| 20° Open Face Angle | 1.1128 | 1.1235 |
| 40° Open Face Angle | 1.1248 | 1.1454 |

Table 7 shows measured values of the aerodynamic drag expressed in lbf for different orientation angles of the club head at 110 mph.

TABLE 7

| Orientation Angle | Turbulator 1800 | Turbulator 2100 |
|---|---|---|
| 0° Face Angle | 0.9316 | 0.8234 |
| 20° Open Face Angle | 1.3984 | 1.2019 |
| 40° Open Face Angle | 1.3894 | 1.4329 |

Generally, the golf club head should address the ball at 0° (or "be square to the ball") during impact with the golf ball. Therefore, it is important that the club head have the greatest speed and least drag at this point. Tables 5-7 show that at speeds of 80 mph, 100 mph, and 110 mph when the club head is at the 0° orientation angle (at impact with the ball) the turbulators 2100 can reduced the drag force by as much as approximately 20% when compared to the turbulator 1800. This can result in a golf club head 100 which comprises the turbulators 2100 having increased club head speeds at the point of impact resulting in increased ball speed and longer ball trajectories.

A club head may include one or a combination of the turbulators 300, 400, 500, 600, 1200, 1300, 1600, 1700, 1800, 1900 and/or 2100; and/or grooves 1400 and 1500; and/or protrusions 2010. For example, a club head may include the turbulators 400 on the crown and turbulators 1200 on the sole. In another example, a club head may include the turbulators 500 and protrusion 2010 on the crown and turbulators 1200 and 1300 on the sole. Thus, any combination of turbulators and/or protrusions according to the disclosure may be provided on the crown and/or the sole to provide a particular flow pattern on the club head. Furthermore, any combination of turbulators as described herein may be provided with the grooves on the sole 1008 of the golf club head according to the examples of FIGS. 39 and 40. Additionally, any combination of the protrusions as described herein may be provided with turbulators and/or grooves on the golf club head according to example of FIGS. 57 and 58. Any or a combination of the methods described herein for forming ridges or grooves may be used to form any of the ridges or grooves according to the disclosure.

Other Turbulator Embodiments

Further, a club head may include any of the turbulators 300, 400, 500, 600, 1200, 1300, 1600, 1700, 1800, 1900 and/or 2100 in any turbulator configuration or arrangement. Referring to FIGS. 62-70, a plurality of exemplary turbulator arrangements are illustrated.

Figure 62:
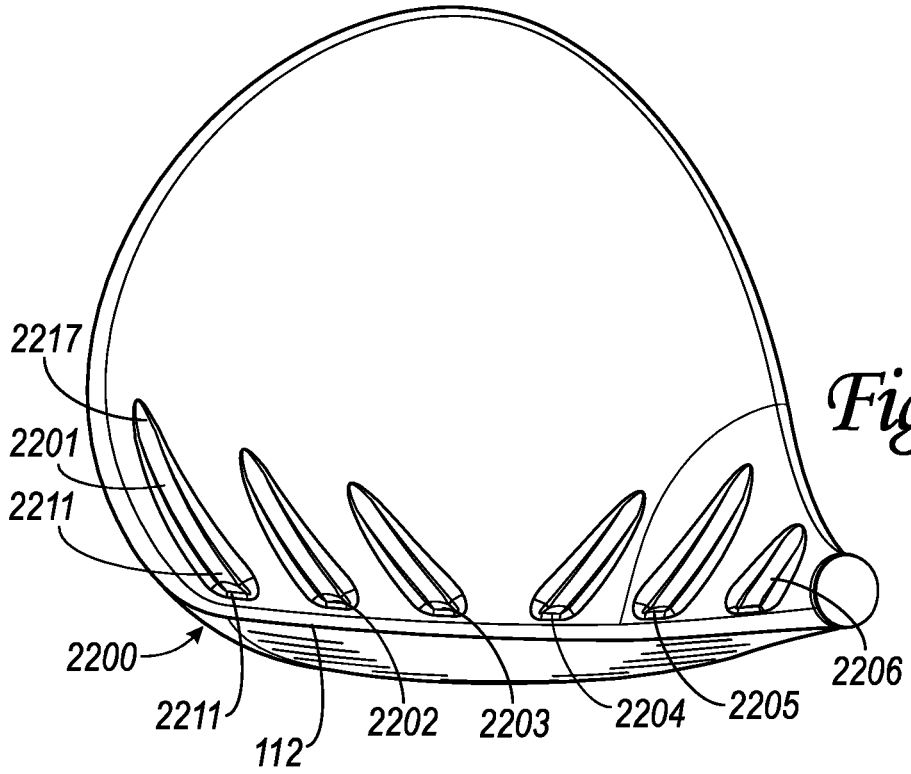
FIG. 62 is a top view of a club head having a turbulator according to one embodiment.

FIG. 62 illustrates a golf club head comprising a turbulator similar to the turbulator of FIGS. 53-54; wherein a height of the turbulator decreases as the turbulator extends from in a direction from the front to the rear of the golf club head. Turning to FIG. 62, a club head is illustrated comprising an exemplary turbulator arrangement 2200 having 6 ridges 2201-2206. In the illustrated embodiment, the ridges 2201-2206 can be disposed on the crown 110 of the club head. The ridges 2201-2206 can have a front end 2211 positioned on or near the leading edge 112 spaced apart from the heel end 104 to the toe end 106. Three of the ridges 2201-2203 can be positioned on a toe half between the centerline 127 of the club head and the toe end 106 and three of the ridges 2204-2206 can be positioned on a heel half between the centerline 127 and the heel end 104 of the club head. The ridges 2201-2203 on the toe half of the crown 110 can follow the contour of the toe end 106 of the club head as they extend towards the rear of the club head, such that a second end 2217 of the ridge 2201-2203 is positioned further from the club head centerline 127 than the first end 2211. Further, the ridges 2204-2206 on the heel half of the crown 110 can follow the contour of the heel end 104 of the club head as they extend towards the rear of the club head, such that a second end 2217 of the ridge 2204-2206 can be positioned further from the club head centerline 127 than the first end 2211 of the ridges 2204-2206. Further, in the illustrated embodiment, the ridges 2201-2206 can have a varying length. The ridges 2201-2206 positioned closest to the toe and heel ends 104, 106 can generally have the greatest length and the ridges 2201-2206 positioned closest the center of the club have the smallest length, with the exception of the ridge 2206 positioned closet to the heel end 104 being smaller than the adjacent ridge 2205. Further, in the illustrated embodiment, the ridges 2201-2206 can be similar to the ridges 1801-1806 of the turbulator 1800 described above. In other embodiments, the ridges 2201-2206 of the turbulator arrangement 2200 can be similar to any of the ridges of the turbulators 300, 400, 500, 600, 1200, 1300, 1600, 1700, 1800, 1900 and/or 2100. For example, turning to FIG. 63, the turbulator arrangement 2200 is again illustrated, however, in this embodiment, the ridges 2201-2206 can be similar in shape and configuration to the ridges 2101-2106 of the turbulator 2100 described above.

Figure 63:
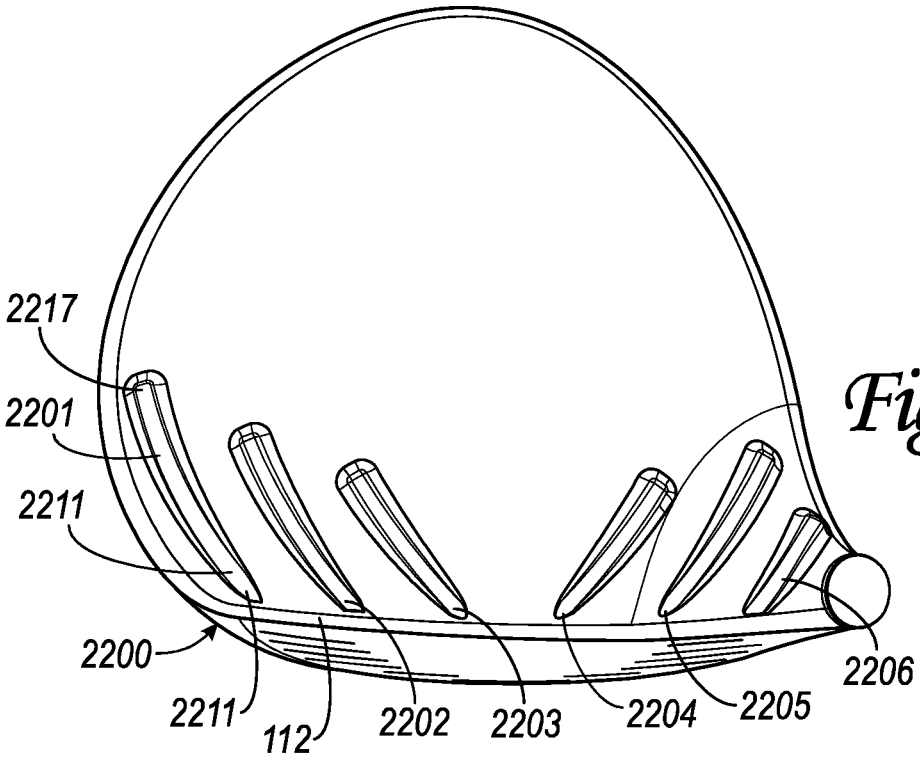
FIG. 63 is a top view of a club head having a turbulator according to another embodiment.
Figure 64:
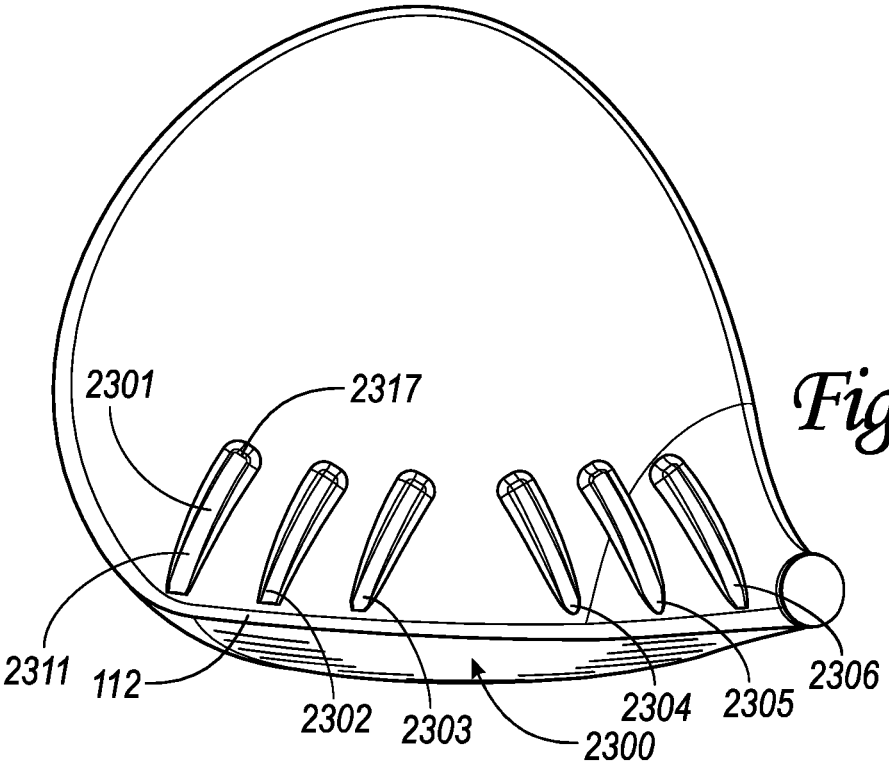
FIG. 64 is a top view of a club head having a turbulator according to another embodiment.

FIG. 64 illustrates a golf club head comprising a turbulator similar to the turbulator of FIG. 63; wherein a height of the turbulator increase as the turbulator extends from in a direction from the front to the rear of the golf club head. From a front to rear of the golf club head, the turbulators can be oriented wherein the turbulator extend toward a center of the golf club head. Referring now to FIG. 64, a club head is illustrated comprising an exemplary turbulator arrangement 2300. Similar to the turbulator arrangement 2200 the turbulator arrangement 2300 can comprise a first 3 ridges 2301-2303 on a toe half of the crown 110 and second three ridges 2404-2406 on a heel half of the crown, all having a front end 2311 that can be positioned at or near the leading edge 112. However, in contrast to the turbulator arrangement 2200, the rear end 2317 of the ridges 2301-2306 of the turbulator arrangement 2300 can be positioned closer to the club head centerline 127 than the first end 2311. Further, each of the ridges 2301-2306 of the turbulator arrangement 2300 can comprise an equal length. In other embodiments, any of the above described ridges 400, 300, 500, 600, 1600, 1700, 1800, 1900, 2100 can be positioned in an arrangement which is the same or similar to the turbulator arrangement 2300.

Figure 65:
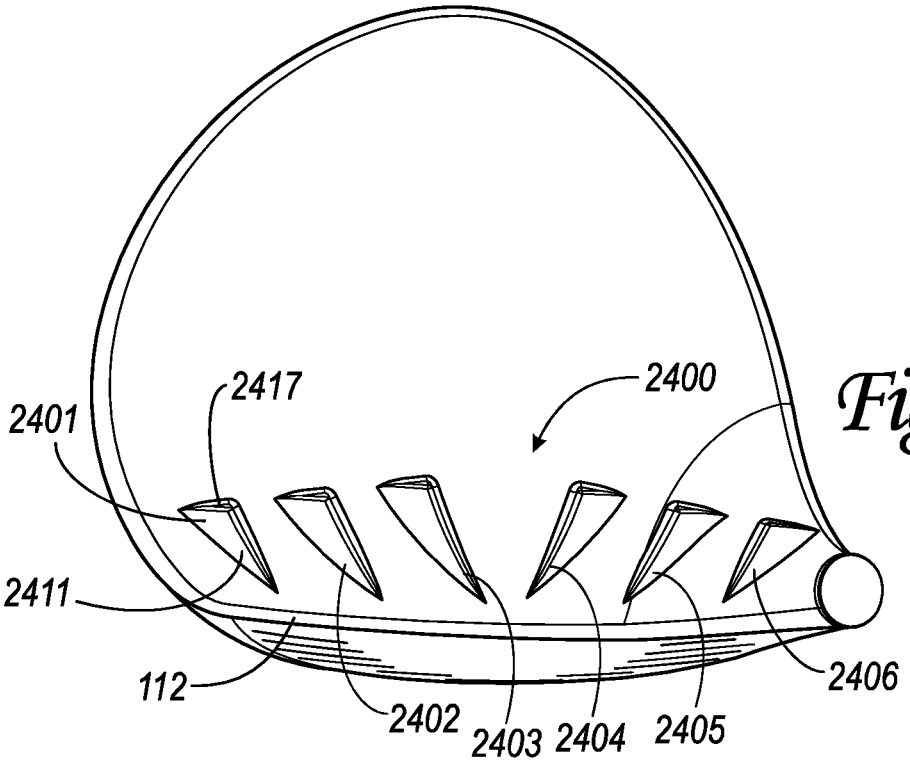
FIG. 65 is a top view of a club head having a turbulator according to another embodiment.

Referring now to FIG. 65, a club head is illustrated comprising an exemplary turbulator arrangement 2400. Similar, to the turbulator arrangement 2200, the turbulator arrangement 2400 can comprise a triangular cross-section. The turbulator arrangement 2200 comprises 6 ridges each having a front end 2411 that can be positioned at or near the leading edge 112 and a rear end 2417 can be positioned further from the club head centerline 127 than the front end 2411. Further, the ridges 2401-2403 can be positioned on the toe end 106 of the club head can follow the contour of the toe end 106 of the club head and the ridges 2404-2406 can be positioned on the heel end 106 of the club head can follow the contour of the heel end 104 of the club head. However, in contrast to the turbulator arrangement 2200, the ridges 2401-2406 of the turbulator arrangement 2400 can have a smallest length at the toe and heel end 104, 106 (ridges 2401, 2406) and can increase in length towards the ridges 2403-2404 closest to the centerline 127. Further, the ridges 2401-2406 can have a width which increases from the front end 2411 to the rear end 2417. In other embodiments, any of the above described ridges 400, 300, 500, 600, 1600, 1700, 1800, 1900, 2100 can be positioned in an arrangement which is the same or similar to the turbulator arrangement 2300.

Figure 66:
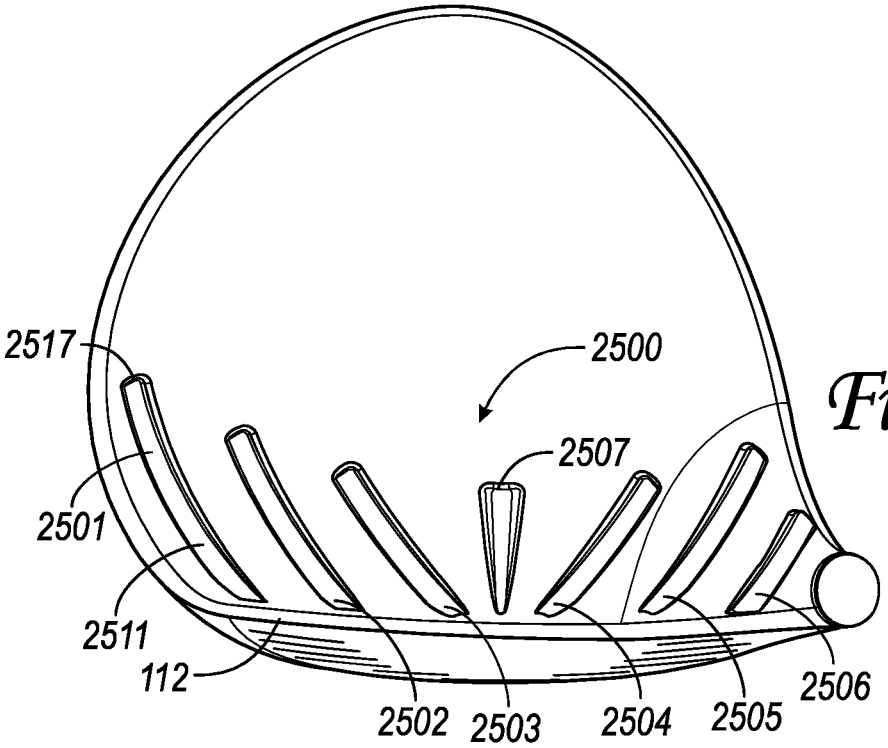
FIG. 66 is a top view of a club head having a turbulator according to another embodiment.

Referring now to FIG. 66, a club head having is illustrated comprising an exemplary turbulator arrangement 2500. The turbulator arrangement 2500 can be similar to the turbulator arrangement 2200, however the turbulator arrangement 2500 comprises 7 ridges 2501-2507. Including 6 ridges 2501-2506 can be similar in position to the ridges 2201-2206 and a seventh ridge 2507 can be positioned between ridges 2503 and 2504. The ridge 2507 can be disposed on or near the centerline 127 of the club head and extends parallel with the centerline towards the rear end of the club head. In the illustrated embodiment, the ridge 2507 can have a smaller length than any of the ridges 2501-2506. In other embodiments, the ridge 2507 can have an equal or greater length than any of the ridges 2501-2506. Further, in the illustrated embodiment, the ridges 2501-2507 can be similar in shape and configuration to the ridges 2101-2106 described above. In other embodiments, any of the above described ridges 400, 300, 500, 600, 1600, 1700, 1800, 1900, 2100 can be positioned in an arrangement which is the same or similar to the turbulator arrangement 2500.

Figure 67:
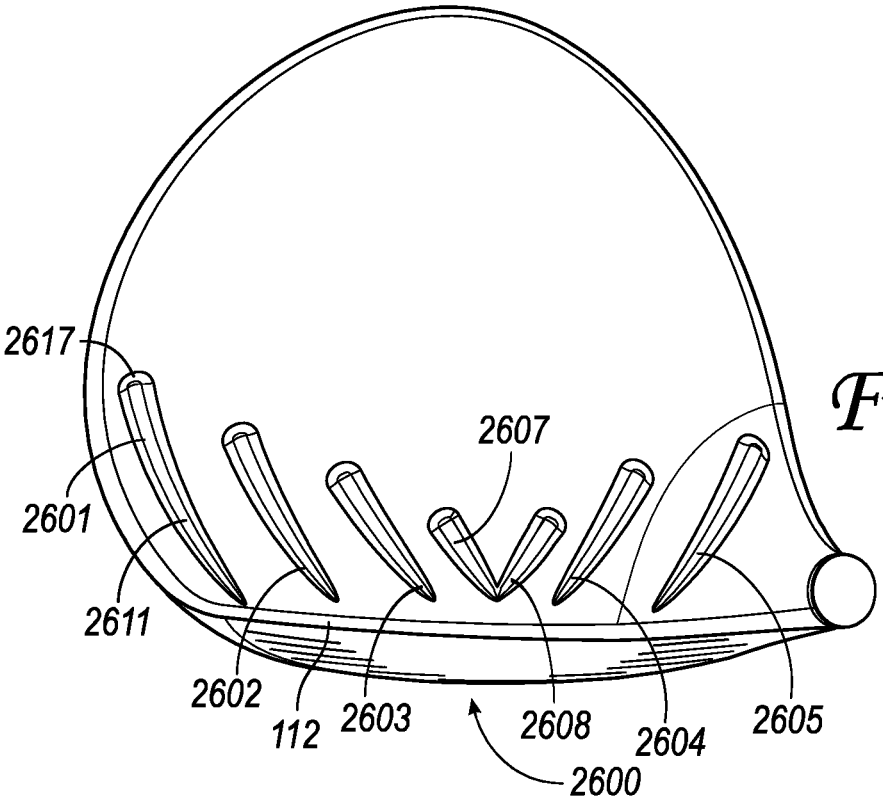
FIG. 67 is a top view of a club head having a turbulator according to another embodiment.

Referring to FIG. 67, a club head is illustrated comprising an exemplary turbulator arrangement 2600. The turbulator arrangement 2600 can be similar to the turbulator arrangements 2200, except the turbulator arrangement 2600 comprises 8 ridges 2601-2608. Including 6 ridges 2601-2606 can be similar in position to the ridges 2201-2206 and a seventh and eighth ridge 2607, 2608 can be positioned between the ridges 2603 and 2604. Ridge 2607 can be extend into the toe half of the club head and can follow the contour of the toe end 106 of the club head. Ridge 2608 can extend into the heel half of the club head and can follow the contour of the heel end 104 of the club head, such that both of the ridges 2607, 2608 can have a first end 2611 positioned on or near the centerline 127 and a second end 2617 positioned further from the centerline 127 than the first end 2611 forming a V-type shape. In the illustrated embodiment, the ridges 2601-2608 can be similar in shape and configuration to the ridges 2101-2106 described above. In other embodiments, any of the above described ridges 400, 300, 500, 600, 1600, 1700, 1800, 1900, 2100 can be positioned in an arrangement which is the same or similar to the turbulator arrangement 2600.

Figure 68:
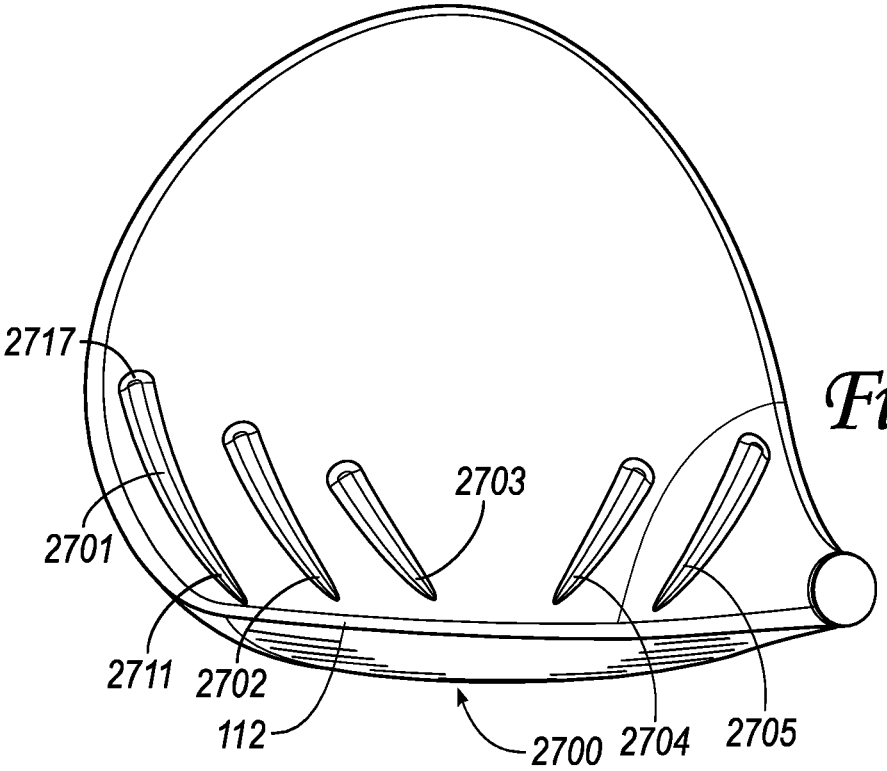
FIG. 68 is a top view of a club head having a turbulator according to another embodiment.

Referring to FIG. 68, a club head is illustrated comprising an exemplary turbulator arrangement 2700. The turbulator arrangement 2700 can be similar to the turbulator arrangement 2200, except the turbulator arrangement 2700 can comprises only 5 ridges 2601-2605. In the illustrated embodiment, the heel end of the club head only comprises 2 ridges, such that the turbulator arrangement 2700 comprises ridges 2701-2705 similar in position to the ridges 2101-2105. Further, the spacing between the ridges 2703 and 2704 nearest the centerline 127 can be greater than the similar ridges 2203, 2204 of the turbulator arrangement 2200. Thus, creating a larger area in the center of the club head void of any turbulator ridges 2701-2705. In the illustrated embodiment, the ridges 2701-2705 can be similar in shape and configuration to the ridges 2101-2106. In other embodiments, any of the above described ridges 400, 300, 500, 600, 1600, 1700, 1800, 1900, 2100 can be positioned in an arrangement which is the same or similar to the turbulator arrangement 2700.

Figure 69:
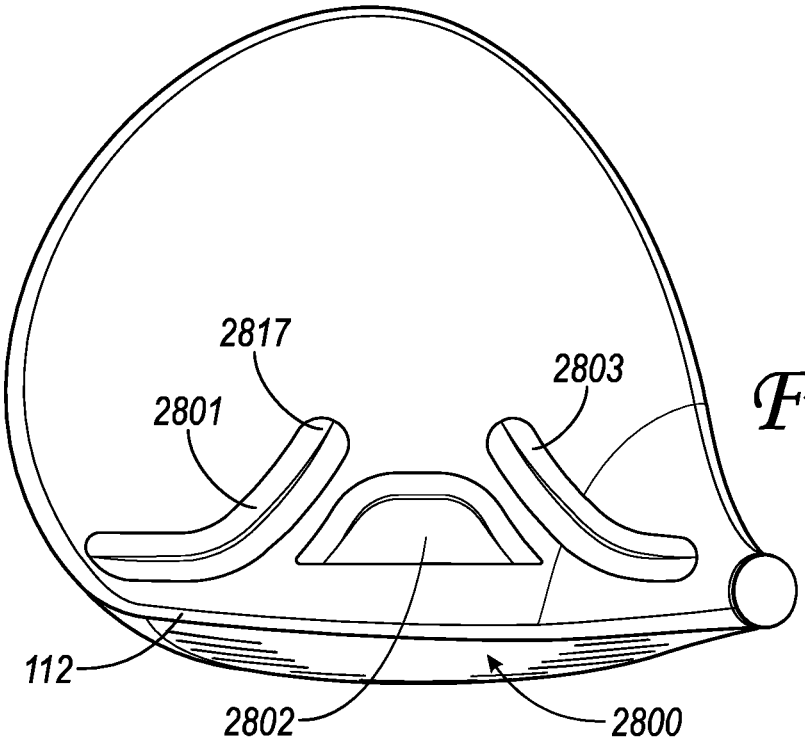
FIG. 69 is a top view of a club head having a turbulator according to another embodiment.

Referring now to FIG. 69, a club head is illustrated comprising an exemplary turbulator arrangement 2800. In the illustrated embodiment, the turbulator arrangement 2800 comprises 3 turbulator ridges 2801-2803. A first ridge 2801 can have a front end 2811 positioned adjacent the toe end 106 and at or near the leading edge 112. The first ridge 2801 can extend from the toe end 106 parallel to the leading edge 112 for a portion and then angles towards the rear and centerline 127, such that a rear end 2817 of the first ridge 2801 can be positioned closer to the centerline 127 than the front end 2811. A third ridge 2803 can have a front end 2811 positioned adjacent the heel end 104 and at or near the leading edge 112. The third ridge 2803 can extend from the heel end 104 parallel to the leading edge 112 for a portion and then angles towards the rear and centerline 127, such that a rear end 2817 of the third ridge 2803 can be positioned closer to the centerline 127 than the front end 2811. Finally, a second ridge 2802 can have a step-type profile being centered on the centerline 127 of the club head. The second ridge 2802 can have a front end 2811 at or near the leading edge and a rear end 2817 positioned to the rear of the first end 2811. Such that, the second ridge 2801 can be symmetric about the centerline 127. The step-type profile of the second ridge 2802 can comprise a smallest height at or near the leading edge 112 and can increase in height towards the rear end 2817. Further, the width of the second ridge 2802 can decrease from the front end 2811 to the second end 2817. In other embodiments, any of the above described ridges 400, 300, 500, 600, 1600, 1700, 1800, 1900, 2100 can be positioned in an arrangement which is the same or similar to the turbulator arrangement 2800.

Figure 70:
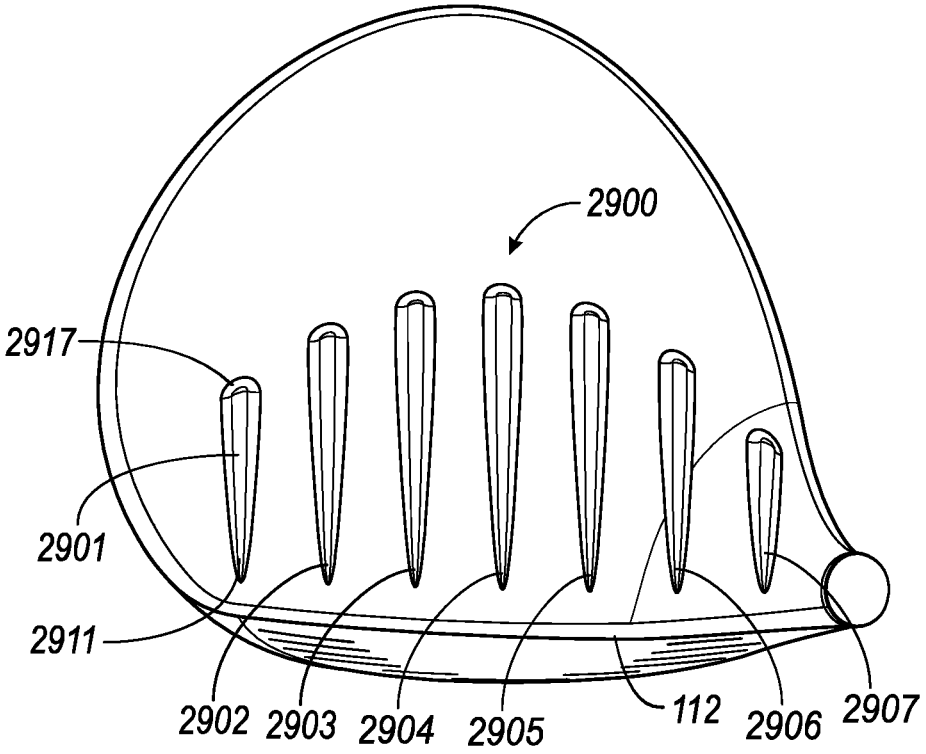
FIG. 70 is a top view of a club head having a turbulator according to another embodiment.

Referring now to FIG. 70, a club head is illustrated comprising an exemplary turbulator arrangement 2900. In the illustrated embodiment, the turbulator arrangement 2900 comprises 7 ridges 2901-2907 all extending parallel to the centerline 127. The ridges 2901-2907 can be spaced equally from the heel end 104 to the toe end 106. Each of the ridges 2901-2907 can comprise a front end 2911 positioned at or near the leading edge 112 and a rear end 2917 positioned directly to the rear of the front end 2911. Such that, each of the ridges 2901-2907 can extend substantially perpendicular to the leading edge 112. Further, the ridges 2901-2907 can be positioned near on or near the centerline 127 have the greatest length and the ridges 2901-2907 can gradually decrease in length near the heel or toe end 104, 106. In the illustrated embodiment, the ridges 2901-2907 can be similar in shape and configuration to the ridges 2101-2106. In other embodiments, any of the above described ridges 400, 300, 500, 600, 1600, 1700, 1800, 1900, 2100 can be positioned in an arrangement which can be the same or similar to the turbulator arrangement 2900.

Angled Ridge Turbulator Embodiments

As illustrated in FIGS. 71-75, a golf club head can comprise a turbulator having angled ridges as opposed to ridges with planar flat surfaces as described above. In some embodiments, the turbulator having angled ridges can comprise a smoother front surface transition than the planar flat surfaces as described above. The golf club head can be similar in many respects to the golf club head 100 of FIGS. 9 and 10. Further, the leading edge 112 of the golf club head of FIGS. 71-74 can be similar in many respects to the leading edge 112 of FIGS. 45-47. Accordingly, except for a turbulator 3000, the same parts of the golf club head of FIGS. 71-74 and the golf club head 100 of FIGS. 9 and 10, as well as the same parts of the leading edge of FIG. 45-47 can be referred to with the same reference numbers.

Figure 71:
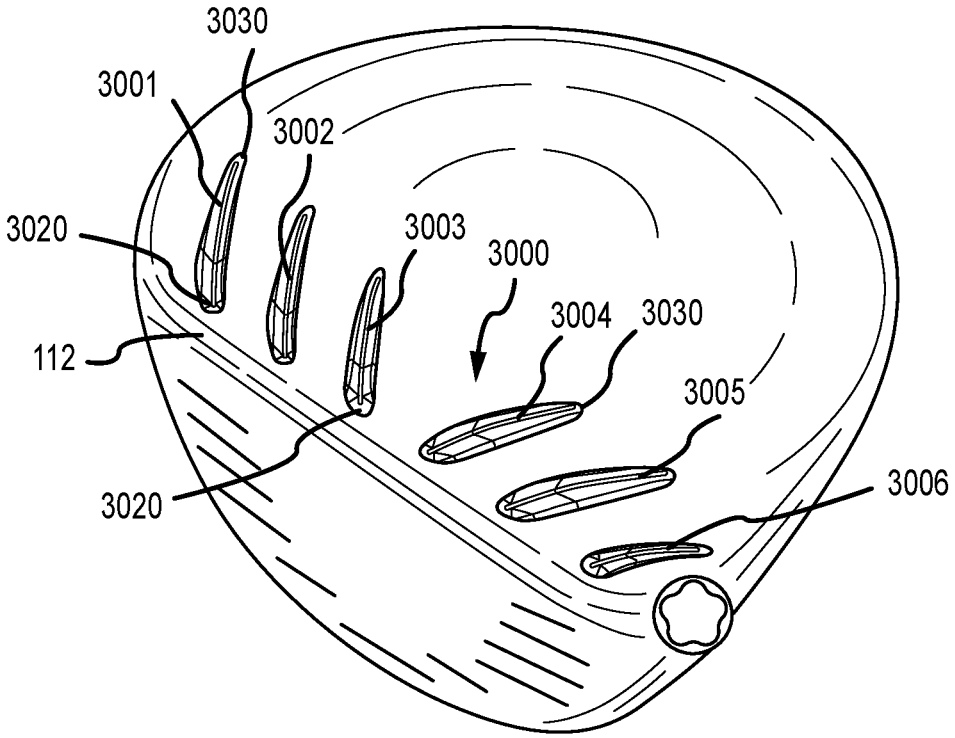
FIG. 71 is a front perspective view of a club head having a turbulator according to another embodiment.
Figure 72:
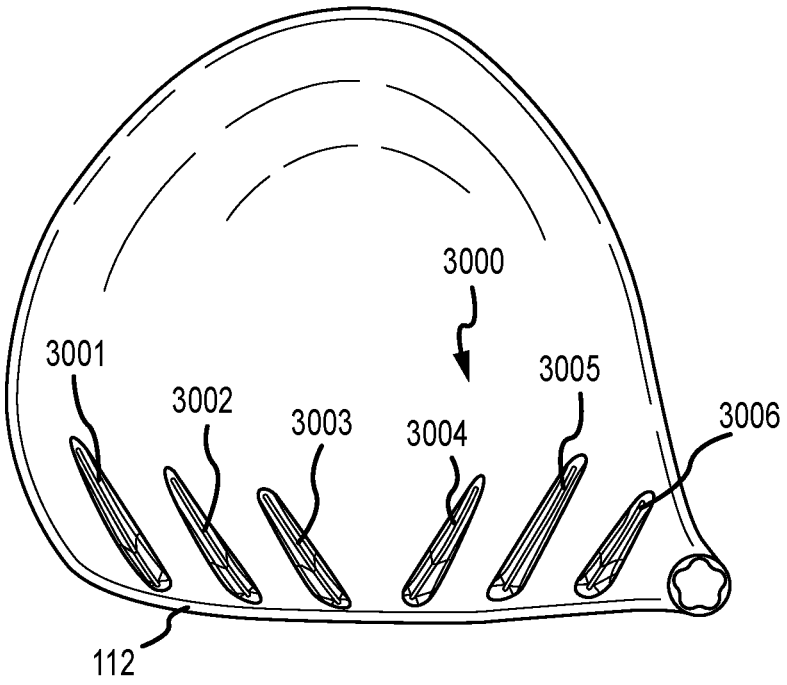
FIG. 72 is a top view of the club head having the turbulator of FIG. 71.

The turbulator 3000 as illustrated in FIGS. 71 and 72 can comprise a plurality of ridges 3001-3006 similar to the plurality of ridges of the turbulators described above (e.g., 1600, 1700, 1800, 1900, 2100, 2200, 2300, 2400, 2500, 2600, 2700, 2800, and 2900), but having a more angled structure. In some embodiments, the ridges 3001-3096 of the turbulator 3000 can be positioned on the crown 110 at an offset distance from the leading edge 112. In some embodiments as illustrated in FIGS. 71 and 72, the turbulator 3000 can comprise 6 ridges 3001-3006. In other embodiments, the turbulator 3000 can comprise any number of ridges (e.g., 1 ridge, 2 ridges, 3 ridges, 4 ridges, 5 ridges, 6 ridges, 7 ridges, 8 ridges, 9 ridges, or 10 ridges). In other embodiments, the turbulator 3000 can comprise at least 1 ridge, 2 ridges, 3 ridges, 4 ridges, 5 ridges, 6 ridges, 7 ridges, 8 ridges, 9 ridges, or 10 ridges.

In some embodiments, the ridges 3001-3006 of the turbulator 3000 can be equidistant from one another. In other embodiments, the ridges 3001-3006 can be positioned at any distance from one another. The ridges 3001-3006 can have a minimum distance from one another ranging from 0.20 inch to 0.40 inch, 0.25 inch to 0.30 inch, 0.30 inch to 0.35 inch, 0.35 inch to 0.40 inch, or 0.25 inch to 0.35 inch. For example, the minimum distance between each of the ridges 3001-3006 can be 0.20 inch, 0.24 inch, 0.28 inch, 0.32 inch, 0.36 inch, or 0.40 inch.

Figure 73:
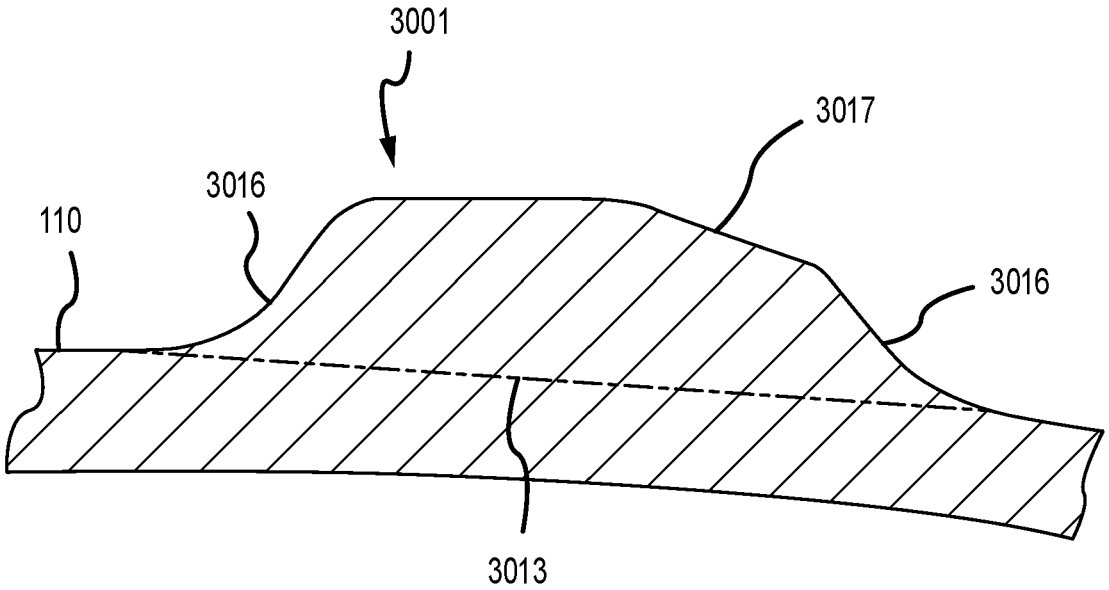
FIG. 73 is a front perspective cross-sectional view of the turbulator of FIG. 71.

The ridges 3001-3006 can comprise a general cross-sectional shape (e.g., triangular, semi-circle, square, rhombus, trapezoidal, pentagonal, or any other appropriate polygonal shape). In some embodiments, the ridge 3001, representing the other ridges 3002-3006 (i.e. same reference numbers), can comprise a pentagonal cross-sectional shape. From a front cross-sectional view of the ridge 3001 as illustrated in FIG. 73, the ridge 3001 can comprise a base 3013 positioned directly adjacent to the crown 110, a top surface 3017 opposite the base 3013, and two side walls 3016 extending from the base 3013 to the top surface 3017. As illustrated in FIG. 73, the top surface 3017 can be an angled surface, forming an edge pointing in a direction away from the crown 110.

In some embodiments, the top surface 3017 of the ridge 3001 can be a planar surface. In other embodiments as illustrated in FIGS. 71-73, the top surface 3017 of the ridge 3001 can be an angled surface. More specifically, the top surface 3017 of the ridge 3001 can be an angled planar surface. In some embodiments, the top surface 3017 can comprise at least one, two, three, four, or five angled planar surfaces. In other embodiments, the top surface 3017 can comprise one, two, three, four, or five angled planar surfaces. For example, the top surface 3017 can comprise two angled planar surfaces. In many embodiments, the angled surface of the top surface 3017 can form an edge. In some embodiments, the edge formed by the angled top surface 3017 can be angled in a direction directed away from the crown 110 as illustrated in FIG. 73. In other embodiments, the edge formed by the angled top surface 3017 can be angled in a direction directed toward the crown 110 forming a "V" shape (not shown).

In many embodiments, the angled top surface edge 3017 can comprise an angle. The angle of the angled top surface edge 3017 can be measured between adjacent planar surfaces. In many embodiments, the angle of the angled top surface edge 3017 can range from 20 to 180 degrees. In some embodiments, the angle of the angled top surface edge 3017 can range from 20 to 60 degrees, 60 to 100 degrees, 100 to 140 degrees, or 140 to 180 degrees. In some embodiments, the angle of the angled top surface edge 3017 can range from 20 to 40 degrees, 40 degrees to 60 degrees, 60 degrees to 80 degrees, 80 degrees to 100 degrees, 100 degrees to 120 degrees, 140 degrees to 160 degrees, or 160 degrees to 180 degrees. For example, the angle of the angled top surface edge 3017 can be 20 degrees, 30 degrees, 40 degrees, 50 degrees, 60 degrees, 70 degrees, 80 degrees, 90 degrees, 100 degrees, 110 degrees, 120 degrees, 130 degrees, 140 degrees, 150 degrees, 153 degrees, 156 degrees, 159 degrees, 162 degrees, 165 degrees, 166 degrees, 167 degrees, 168 degrees, 169 degrees, 170 degrees, 171 degrees, 174 degrees, 177 degrees, or 180 degrees.

In the illustrated embodiment, the top surface 3017 can have a curved surface extending between the side walls 3016. The top surface 3017 can further comprise a top surface radius as the measure of curvature from between the side walls 3016. The top radius can be at least 0.2 degrees or greater. In some embodiments, the top radius of the top surface 3017 can be 0.2 degrees to 1.5 degrees, 0.2 degrees to 0.5 degrees, 0.5 degrees to 0.8 degrees, 0.8 degrees to 1.1 degrees, 1.1 degrees to 1.4 degrees, 1.2 degrees to 1.5 degrees, 0.3 degrees to 0.9 degrees, or 0.9 degrees to 1.4 degrees. For example, the top radius of the top surface 3017 can be 0.2 degrees, 0.4 degrees, 0.6 degrees, 0.8 degrees, 1.0 degrees, 1.2 degrees, 1.4 degrees, or 1.5 degrees.

The side walls 3016 of the ridge 3001 can taper toward the top surface 3017 from the base 3013, forming an angle. The angle of the side walls 3016 is measured from the base 3013 of the ridge 3001 to the side walls 3016. The angle of the side walls 3016 can range from 70 degrees to 90 degrees, 70 degrees to 80 degrees, 80 degrees to 90 degrees, or 75 degrees to 85 degrees. For example, the angle of the side walls 3016 relative to the base 3013 can be 70 degrees, 73 degrees, 76 degrees, 79 degrees, 82 degrees, 85 degrees, 88 degrees, or 90 degrees. In some embodiments, the angle of one side wall 3016 can be equal to the angle of the opposite side wall 3016. In other embodiments, the angle of one side wall 3016 can be less than, or greater than the angle of the opposite side wall 3016.

In this exemplary embodiment of FIGS. 71 and 72 the overall shape of the ridges 3001-3006 illustrated in the turbulator 3000 can present a wider base 3013 and a wider top surface 3017 than previously described turbulators 1600, 1700. Each ridge 3001-3006 comprises a base 3013 width, measured perpendicular between the two side walls 3016 in the toe 106 to heel 104 direction, and a top surface 3017 width of each ridge 3001-3006 measured perpendicular between the two side walls 3016 in the toe 106 to heel 104 direction.

As illustrated in FIGS. 71-74 of one example having wider ridges 3001-3006 than the previous examples, a width of the base 3013 of each ridge 3001-3006 can be 0.357 inch, and a width of the top surface 3017 of each ridge 3001-3006 can be 0.237 inch. In another example, a width of the base 3013 of each ridge 3001-3006 can be 0.281 inch, and a width of the top surface 3017 of each ridge 3001-3006 can be 0.119 inch. In other embodiments, each ridge 3001-3006 can comprise a base 3013 and/or top surface 3017 width of between 0.05 to 0.5 inch. In other embodiments, each ridge 3001-3006 can comprise a base 3013 and/or top surface 3017 width of between 0.09 to 0.15 inch, 0.125 to 0.175 inch, 0.15 to 0.20 inch, 0.140 to 0.250 inch, 0.175 to 0.225 inch, 0.20 to 0.25 inch, 0.225 to 0.275 inch, 0.25 to 0.30 inch, 0.20 to 0.350 inch, 0.275 to 0.325 inch, 0.30 to 0.35 inch, 0.30 to 0.40 inch, 0.35 to 0.45 inch, or 0.40 to 0.50 inch. For example, each ridge 3001-3006 can comprise a base 3013 and/or top surface 3017 width of 0.09, 0.10, 0.125, 0.15, 0.175, 0.20, 0.225, 0.25, 0.275, 0.30, 0.325, 0.35, 0.375, 0.40, 0.425, 0.45, 0.475, or 0.50 inch.

In many embodiments, the width of the top surface 3017 can be less than the width of the base 3013. In some embodiments, the width of the top surface 3017 can be at least 75% of the width of the base 3013. In other embodiments, the width of the top surface 3017 can be at least 40%, at least 50%, at least 60%, at least 70%, at least 80%, at least 90%, or at least 95% of the width of the base 3013. In other embodiments, the width of the top surface 3017 can range between 40-95% of the width of the base 3013. In some embodiments, the width of the top surface 3017 can range between 40-50%, 40-60%, 40-70%, 40-90%, 40-95%, 50-70%, 50-90%, or 50-95% of the width of the base 3013. Further, in some embodiments, each of the ridges 3001-3006 can have a base 3013 and top surface 3017 comprising the same width. In other embodiments, the width of the base 3013 and/or top surface 3017 can vary between adjacent ridges 3001-3006. Further, the width of the base 3013 and/or top surface 3017 can increase, decrease, remain constant, or any combination thereof along the length of each ridge 3001-3006, moving in a direction from the club face 102 to the rear 109.

Figure 74:
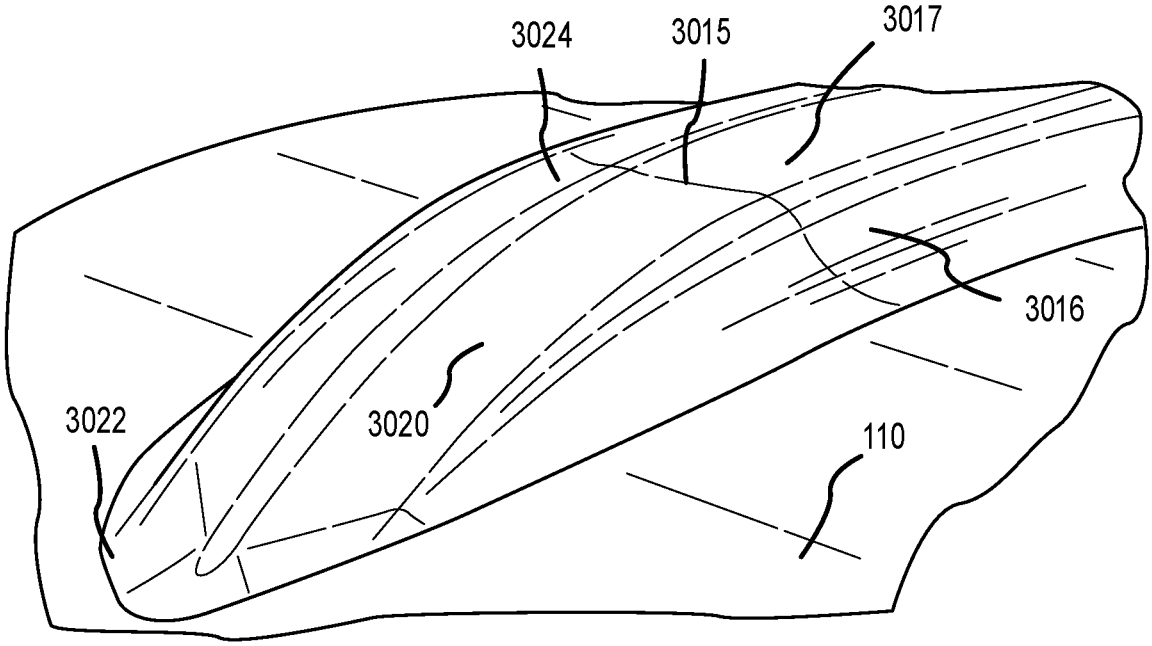
FIG. 74 is a front perspective view of a club head having the turbulator of FIG. 71.
Figure 75:
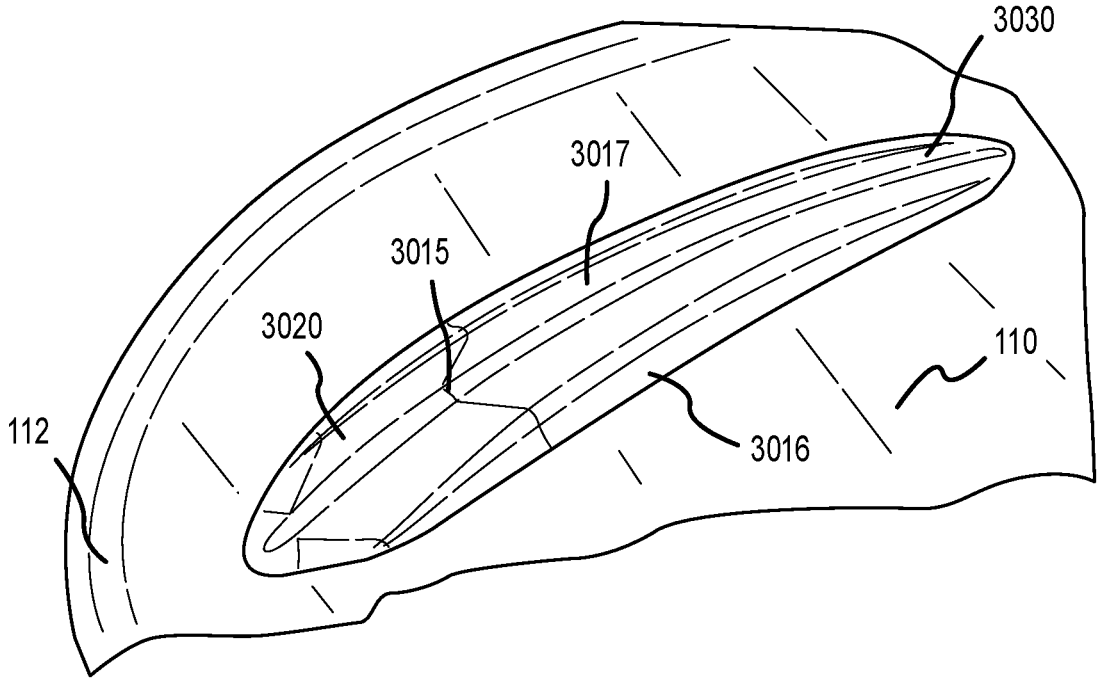
FIG. 75 is a top perspective view of the turbulator of FIG. 71.

From a front perspective view of the ridge 3001, as illustrated in FIGS. 74 and 75, the ridge 3001 can further comprise a front surface 3020, a rear surface 3030, and a ridge apex 3015 positioned between the front surface 3020 and the rear surface 3030. As illustrated in FIG. 74, the front surface 3020 can have an angled surface, forming an edge pointing in a direction toward the leading edge 112.

The front surface 3020 of the ridges 3001-3006 can define a portion of the ridges 3001-3006 closest to the club face 102 of the golf club head 100; while the rear surface of the ridges 3010-3006 can define a portion of the ridges 3001-3006 closest to the rear 109 of the golf club head 100. More specifically, the front surface 3020 can comprise a first end 3022 positioned closest to the club face 102 and a second end 3024 positioned closest to the ridge apex 3015. In some embodiments, the first end 3022 of the front surface 3020 of the ridges 3001-3006 can be offset from the leading edge 112. The leading edge 112 can comprise the leading edge plane 1614 forming the leading edge angle 1616 with the loft plane 1618 as described previously, wherein the first end 3022 of the front surface 3020 of the plurality of ridges 3001-3006 can be at least partly located between the leading edge plane 1614 and the rear 109, but not extending beyond the leading edge plane 1614. In other embodiments, the first end 3022 of the front surface 3020 can be positioned on the leading edge 112.

The first end 3022 of the front surface 3020 of each ridge 3001-3006 can be positioned at a distance offset from the leading edge. In many embodiments, the offset distance can range from 0 to 0.60 inch. In some embodiments, the offset distance can range from 0 to 0.30 inch, or 0.30 to 0.60 inch. In some embodiments, the offset distance can range from 0 to 0.10 inch, 0.10 to 0.20 inch, 0.20 to 0.30 inch, 0.30 to 0.40 inch, 0.40 to 0.50 inch, or 0.50 to 0.60 inch. For example, the front surface 3020 may be offset from the leading edge 112 by 0, 0.01, 0.05, 0.10, 0.15, 0.20, 0.25, 0.30, 0.35, 0.40, 0.45, 0.50, 0.55, or 0.60 inch. Additionally, the distance between the leading edge 112 and the front surface 3020 may vary for each ridge 3001-3006 from the heel end 104 to the toe end 106 to approximately correspond with the location of the separation line 120. In one embodiment, as illustrated in FIGS. 71 and 72, the front surface 3020 of each ridge 3001-3006 can be offset from the leading edge 112 by a distance of 0.10 inch.

In some embodiments, the front surface 3020 of the ridge 3001 can be a planar surface. In other embodiments as illustrated in FIGS. 71, 72, 74, and 75, the front surface 3020 of the ridge 3001 can be an angled surface. More specifically, the front surface 3020 of the ridge 3001 can be an angled planar surface. In other embodiments, the front surface 3020 can comprise at least one, two, three, four, or five angled planar surfaces. In other embodiments, the front surface 3020 can comprise one, two, three, four, or five angled planar surfaces. For example, the front surface 3020 can comprise two angled planar surfaces. In many embodiments, the angle surface of the front surface 3020 can form an edge. The edge formed from the angled front surface 3020 can be angled toward the leading edge 112 as illustrated in FIGS. 71, 72, and 74. In other embodiments, the edge formed from the angled front surface 3020 can be angled toward the rear surface 3030 (not shown). In some embodiments, the edge formed from the angled front surface 3020 can be located centered between the two side walls 3016 of the ridge 3001. In other embodiments, the edge formed from the angled front surface 3020 can be located closer to the side wall 3016 on the heel end 104, or closer to the sidewall 3016 on the toe end 106.

In many embodiments, the front surface 3020 can comprise an angle. The angle of the front surface 3020 can be measured from the loft plane 1618 or the leading edge plane 1614. In many embodiments, the angle of the front surface 3020 can range from 20 to 180 degrees. In some embodiments, the angle of the front surface 3020 can range from 20 to 60 degrees, 60 to 100 degrees, 87 to 100 degrees, 100 to 140 degrees, or 140 to 180 degrees. In some embodiments, the angle of the front surface 3020 can range from 20 degree to 40 degrees, 40 degrees to 60 degrees, 60 degrees to 80 degrees, 80 degrees to 100 degrees, 100 degrees to 120 degrees, 140 degrees to 160 degrees, or 160 degrees to 180 degrees. For example, the angle of the front surface 3020 can be 20 degrees, 30 degrees, 40 degrees, 50 degrees, 60 degrees, 70 degrees, 80 degrees, 87 degrees, 89 degrees, 90 degrees, 91 degrees, 92 degrees, 93 degrees, 94 degrees, 95 degrees, 96 degrees, 97 degrees, 98 degrees, 99 degrees, 100 degrees, 110 degrees, 120 degrees, 130 degrees, 140 degrees, 150 degrees, 160 degrees, 170 degrees, or 180 degrees.

In other embodiments, the front surface 3020 can comprise a curved surface. More specifically, the front surface 3020 can comprise a convex curvature (curving away from crown 110). In many embodiments, the convex curvature of the front surface 3020 can extend from the first end 3022 to the second end 3024 of the front surface 3020. The convex curvature can extend to the highest point of the top surface 3017 or the ridge apex 3015.

In many embodiments, the radius of the convex curvature of the front surface 3020 can range from 0.10 to 1.60 inch. In some embodiments, the radius of the convex curvature of the front surface 3020 can range from 0.10 to 0.40 inch, 0.40 to 0.80 inch, 0.80 to 1.20 inch, or 1.20 to 1.60 inch. For example, radius of the convex curvature of the front surface 3020 can be 0.10, 0.40, 0.70, 1.0, 1.30, 1.60 inch.

Additionally, the front surface 3020 of the ridges 3001-3006 can comprise a height. The height of the front surface 3020 of each ridge 3001-3006 is measured in a direction perpendicular from the base 3013. In many embodiments, the height of the front surface 3020 can increase from the base 3013 of the ridge toward the top surface 3017 in a club face 102 to rear 109 direction. In other embodiments, the height of the front surface 3020 of the ridges 3001-3006 can vary. In some embodiments, the height of the front surface 3020 can increase linearly, and/or exponentially.

Additionally, the front surface 3020 can have a length measured perpendicularly from the first end 3022 to the second end 3024. The length of the front surface 3020 can range from 0.09 inch to 0.13 inch. In other embodiments, the length of the front surface 3020 can range from 0.09 inch to 0.10 inch, 0.10 inch to 0.11 inch, 0.11 inch to 0.12 inch, 0.12 inch to 0.13 inch, 0.095 inch to 0.115 inch, or 0.115 inch to 0.125 inch. For example, the length of the front surface 3020 can be 0.09 inch, 0.095 inch, 0.10 inch, 0.105 inch, 0.11 inch, 0.115 inch, 0.12 inch, 0.125 inch, or 0.13 inch. In some embodiments, the front surface 3020 of the ridge 3001 can comprise a uniform length. In other embodiments as illustrated in FIG. 74, the front surface 3020 of the ridge 3001 can comprise a length that varies from one side wall 3016 to the opposite side wall 3016.

In other embodiments, the length of the front surface 3020 can range from 0.20 to 0.50 inch. In some embodiments, the length of the front surface 3020 can range from 0.20 to 0.2 inch, 0.25 to 0.30 inch, 0.30 to 0.35 inch, 0.35 to 0.40 inch, 0.40 to 0.45 inch, or 0.45 to 0.50 inch. For example, the length of the front surface 3020 can be 0.20, 0.23, 0.26, 0.29, 0.32, 0.35, 0.38, 0.41, 0.44, 0.47, or 0.50 inch.

In many embodiments, the rear surface 3030 of the ridge 3001 can be a planar surface. In other embodiments, as illustrated in FIGS. 71 and 75, the rear surface 3030 of the ridge 3001 can be an angled surface. More specifically, the rear surface 3030 of the ridge 3001 can be an angled planar surface. In other embodiments, the rear surface 3030 can comprise at least one, two, three, four, or five angled planar surfaces. In other embodiments, the rear surface 3030 can comprise one, two, three, four, or five angled planar surfaces. For example, the rear surface 3030 can comprise two angled planar surfaces. In many embodiments, the angled surface of the rear surface 3030 can form an edge. The edge formed from the angled rear surface 3030 can be angled away from the leading edge 112. In other embodiments, the edge formed from the angled rear surface 3030 can be angled toward the leading edge 112 (not shown). In some embodiments, the edge formed from the angled rear surface 3030 can be located centered between the two side walls 3016 of the ridge 3001. In other embodiments, the edge formed from the angled rear surface 3030 can be located closer to the side wall 3016 on the heel end 104, or closer to the sidewall 3016 on the toe end 106.

As illustrated in FIGS. 74 and 75, the ridges 3001-3006 can further comprise the ridge apex 3015. The ridge apex 3015 can be located on the top surface 3017 of the ridges 3001-3006 and can be defined as a maximum height of the ridges 3001-3006. The ridge apex 3015 is measured in a direction perpendicular from the base 3013 of each ridge 3001-3006. In the illustrated embodiment, the height of the ridge apex 3015 of the ridges 3001-3006 can be 0.12 inches measured perpendicularly from the base 3013. In other embodiments, the height of the ridge apex 3015 can be between 0.02 to 0.40 inch. In other embodiments, the height of the ridge apex 3015 can be between 0.02 to 0.10 inch, 0.05 to 0.15 inch, 0.10 to 0.20 inch, 0.15 to 0.25 inch, 0.20 to 0.30 inch, 0.25 to 0.35 inch, or 0.30 to 0.40 inch. For example, the height of the ridge apex 3015 can be 0.02 inch, 0.08 inch, 0.14 inch, 0.20 inch, 0.26 inch, 0.32 inch, 0.38 inch, or 0.40 inch.

In some embodiments, the ridge apex 3015 can be positioned closer to the front surface 3020 than to the rear surface 3030 of the ridge 3001-3006. In other embodiments, the ridge apex 3015 can be positioned closer to the rear surface 3030 than the front surface 3020 of the ridge 3001-3006. In some embodiments, the ridge apex 3015 can be positioned within the first 50%, the first 40%, the first 30%, the first 20%, the first 10%, the first 5%, or the first 1% of the length of the entire ridge 3001-3006. In other embodiments, the ridge apex 3015 can be positioned within 0.05 inch, within 0.1 inch, within 0.2 inch, within 0.3 inch, within 0.4 inch, within 0.5 inch, within 0.6 inch, within 0.7 inch, within 0.8 inch, within 0.9 inch, or within 1.0 inch from the first end 3022 of the front surface 3020.

In many embodiments, the ridge apex 3015 can be positioned a distance from the leading edge 112. In some embodiments, a portion of the ridge apex 3015 can be positioned on the leading edge 112. The distance of the ridge apex 3015 from the leading edge 112 can be measured as the perpendicular distance from the leading edge 112 to the ridge apex 3015 in the club face 102 to the rear 109 direction. The distance of the ridge apex 3015 from the leading edge 112 can range from 0 to 1.0 inch. In some embodiments, the distance of the ridge apex 3015 from the leading edge 112 can range from 0 to 0.50 inch, or 0.50 to 1.0 inch. In some embodiments, the distance of the ridge apex 3015 from the leading edge 112 can range from 0 to 0.20 inch, 0.20 to 0.40 inch, 0.40 to 0.60 inch, 0.60 to 0.80 inch, or 0.80 to 1.0 inch. For example, the distance of the ridge apex 3015 from the leading edge 112 can be 0, 0.10, 0.15, 0.20, 0.25, 0.30, 0.35, 0.40, 0.45, 0.50, 0.55, 0.60, 0.65, 0.70, 0.75, 0.80, 0.85, 0.90, 0.95, or 1.0 inch.

Referring again to FIGS. 71-75, the ridges 3001-3006 can comprise a varying height. As stated above, the ridges 3001-3006 comprise the ridge apex 3015 defined as the maximum height of the ridges 3001-3006 ranging from 0.02 to 0.40 inch. The height of the ridge can range from 0 inch to 0.40 inch, wherein the height of the ridges 3001-3006 can decrease from the ridge apex 3015 toward the rear surface 3030, or the height of the ridges 3001-3006 can decrease from the ridge apex 3015 toward the first end 3022 of the front surface 3020.

In many embodiments, the height of each ridge 3001-3006 can range from 0 to 0.40 inch. In some embodiments, the height of each ridge 3001-3006 can range from 0 to 0.15 inch, or 0.15 to 0.35 inch. In other embodiments, the height of each ridge 3001-3006 can range from 0 to 0.1 inch, 0.1 to 0.25 inch, or 0.25 to 0.35 inch. For example, the height of each ridge 3001-3006 can be 0 inch, 0.01 inch, 0.05 inch, 0.10 inch, 0.15 inch, 0.20 inch, 0.25 inch, 0.30 inch, or 0.35 inch.

The ridge 3001 can further comprise a transition region between the front surface 3020 and the top surface 3017. The transition region between the front surface 3020 and the top surface 3017 can comprise a round, a fillet, or a chamfer. As illustrated in FIG. 74, the transition region between the front surface 3020 and the top surface 3017 can have a radius of 0.054 inch. In other embodiments, the transition between the front surface 3020 and the top surface 3017 can have a radius ranging from 0.010 inch to 0.20 inch, 0.010 inch to 0.030 inch, 0.030 inch to 0.050 inch, 0.050 inch to 0.070 inch, 0.070 inch to 0.090 inch, 0.090 inch to 0.110 inch, 0.110 inch to 0.130 inch, 0.130 inch to 0.150 inch, 0.150 inch to 0.170 inch, or 0.170 in to 0.200 inch. For example, the transition region between the front surface 3020 and the top surface 3017 can have a radius of 0.02 inch, 0.05 inch, 0.08 inch, 0.11 inch, 0.14 inch, 0.17 inch, or 0.20 inch.

In other embodiments, the transition region between the front surface 3020 and the top surface 3017 can have a radius ranging from 0.20 to 1.60 inches. In some embodiments, the transition region between the front surface 3020 and the top surface 3017 can have a radius ranging from 0.20 to 0.40 inch, 0.40 to 0.60 inch, 0.60 to 0.08 inch, 0.08 to 1.00 inch, 1.00 to 1.20 inches, 1.20 to 1.40 inches, or 1.40 to 1.60 inches. For example, the transition region between the front surface 3020 and the top surface 3017 can have a radius of 0.20, 0.30, 0.40, 0.50, 0.60, 0.65, 0.70, 0.80, 0.90, 1.00, 1.20, 1.30, 1.40, 1.50, or 1.60 inches.

In many embodiments, the ridge 3001 can further comprise a transition region between the front surface 3020 and each of the side walls 3016. The transition region between the front surface 3020 and each of the side walls 3016 can comprise a round, a fillet, or a chamfer. In many embodiments, the transition region between the front surface 3020 and each of the side walls 3016 can have a radius ranging from 0.05 to 0.5 inch. In some embodiments, the transition region between the front surface 3020 and each of the side walls 3016 can have a radius ranging from 0.05 to 0.25 inch, or 0.25 to 0.50 inch. In some embodiments, the transition region between the front surface 3020 and each of the side walls 3016 can have a radius ranging from 0.05 to 0.10 inch, 0.10 to 0.20 inch, 0.20 to 0.30 inch, 0.30 to 0.40 inch, or 0.40 to 0.50 inch. For example, the transition region between the front surface 3020 and each of the side walls 3016 can have a radius of 0.05, 0.10, 0.11, 0.12, 0.13, 0.14, 0.15, 0.16, 0.17, 0.18, 0.19, 0.20, 0.25, 0.30, 0.35, 0.40, 0.45, or 0.50 inch.

In many embodiments, the ridge 3001 can comprise a transition region between each side wall 3016 and the top surface 3017. The transition between each side wall 3016 and the top surface 3017 can comprise a round, a fillet, or a chamfer. For example, the transition region between each side wall 3016 and the top surface 3017 can have a radius ranging between 0.01 and 0.1 inch. In other embodiments, the transition region between each side wall 3016 and the top surface 3017 can have a radius ranging between 0.01 to 0.03 inch, 0.02 to 0.04 inch, 0.03 to 0.05 inch, 0.04 to 0.06 inch, 0.05 to 0.07 inch, 0.06 to 0.08 inch, 0.07 to 0.09 inch, or 0.08 to 0.10 inch. For example, the transition region between each side wall 3016 and the top surface 3017 can have a radius of 0.01, 0.02, 0.03, 0.04, 0.05, 0.06, 0.07, 0.08, 0.09, or 0.10 inch.

Further, in some embodiments, the ridge 3001 can comprise a transition region between each side wall 3016 and the crown 110. The transition region between each side wall 3016 and the crown 110 can also comprise a round, a fillet, or a chamfer. For example, the transition region between each side wall 3016 and the crown 110 can have a radius ranging from 0.05 and 1.0 inch. In other embodiments, the transition region between each side wall 3016 and the crown 110 can have a radius ranging from 0.05 to 0.15 inch, 0.1 to 0.2 inch, 0.2 to 0.3 inch, 0.3 to 0.4 inch, 0.4 to 0.5 inch, 0.5 to 0.6 inch, 0.6 to 0.7 inch, 0.7 to 0.8 inch, 0.8 to 0.9 inch, or 0.9 to 1.0 inch. For example, the transition region between each side wall 3016 and the crown 110 can have a radius of 0.05, 0.10, 0.20, 0.30, 0.40, 0.50, 0.60, 0.70, 0.80, 0.90, or 1.0 inch.

Referring to FIG. 73, the front view cross-sectional shape of the ridges 3001-3006 is shown. As discussed above, the overall shape of the ridges 3001-3006 can have a wider base 3013, a wider top surface 3017, a greater ridge apex 3015 height, and a smoother transition from the side wall 3016 to the wider top surface 3017 than previously described turbulators (e.g., 1600, 1700). Further, the front surface 3020 of the ridges 3001-3006 can have a smoother transition towards the top surface 3017. In one embodiment, the cross sectional shape of the ridges 3001-3006 can take the form of a pentagon. The pentagon shape of the ridges 3001-3006 can comprise the base 3013, two side walls 3016, and the top surface 3017, wherein the top surface 3017 can have an angled surface. In one embodiment, the base 3013 can have a width of 0.327 inches; the two side walls 3016 extending from the base 3013 to the top surface 3017 can be tapered at an angle ranging from 78.59 degrees to 86.15 degrees; the top surface 3017 can have a width of 0.237 inch; and the angle of the angled top surface 3017 can be 167.26 degrees. In another embodiment, the base 3013 can have a width of 0.282 inches; the two side walls 3016 extending from the base 3013 to the top surface 3017 can be tapered at an angle ranging from 78.59 degrees to 86.15 degrees; the top surface 3017 can have a width of 0.119 inch; and the angle of the angled top surface 3017 can be 167.26 degrees. Further, from a front perspective view, the ridges 3001-3006 can comprise the front surface 3020 having an angled surface, where the front surface 3020 can comprise an angle of 94.67 degrees.

The angled surface of the front surface 3020, the top surface 3017, or the rear surface 3030 of the ridges 3001-3006 can comprise at least two angled planar surfaces. The at least two angled planar surfaces of the front surface 3020, the top surface 3017, or the rear surface 3030 can extend the entire length of the ridges 3001-3006 from the club face 102 to the rear 109. Further, as illustrated in FIGS. 71, 72, and 75, the at least two angled planar surfaces of the front surface 3020, the top surface 3017, or the rear surface 3030 of the ridges 3001-3006 can form an edge. The edge can extend the entire length of the ridges 3001-3006 from the club face 102 to the rear 109.

The edge of the at least two angled planar surfaces of the front surface 3020, the top surface 3017, or the rear surface 3030 can comprise a round, a fillet, or a chamfer. In many embodiments, the edge of the front surface 3020, the top surface 3017, or the rear surface 3030 of the ridges 3001-3006 can have a radius ranging from 0.01 to 0.10 inch. In some embodiments, the edge of the front surface 3020, the top surface 3017, or the rear surface 3030 of the ridges 3001-3006 can have a radius ranging from 0.01 to 0.05 inch, or 0.05 to 0.10 inch. In some embodiments, the edge of the front surface 3020, the top surface 3017, or the rear surface 3030 of the ridges 3001-3006 can have a radius ranging from 0.01 to 0.02 inch, 0.02 to 0.03 inch, 0.03 to 0.04 inch, 0.04 to 0.05 inch, 0.05 to 0.06 inch, 0.06 to 0.07 inch, 0.07 to 0.08 inch, 0.08 to 0.09 inch, or 0.09 to 0.10 inch. For example, the edge of the front surface 3020, the top surface 3017, or the rear surface 3030 of the ridges 3001-3006 can have a radius of 0.01, 0.015, 0.02, 0.025, 0.03, 0.035, 0.04, 0.045, 0.05, 0.055, 0.060, 0.065, 0.07, 0.075, 0.08, 0.085, 0.09, 0.095, or 0.10 inch.

Each ridge 3001-3006 can be curved, can have a variable base width 3013 along the length, can have a variable cross-sectional shapes, can have a variable height along the length and/or the base width 3013, can have a different surface textures, and/or can have a other physical variations along the length, the base width 3013 and/or the height. The length of each ridge can vary from the heel end 104 to the toe end 106 to approximately correspond with the location of the separation line 120 on the crown 110. Further, the length of each ridge can be substantially greater than the base width. In many embodiments, the turbulator 3000 is shown to comprise 6 ridges 3001-3006. In other embodiments, the turbulator 3000 can include more or less than 6 turbulators 3000.

Tables 8-10 show experimental results comparing a golf club head devoid of turbulators (hereinafter "CH1"), a golf club head comprising the turbulator arrangement 2200 having ridges 2201-2206 similar to the ridges 1801-1806 (FIG. 62—having the ridge apex 1815 positioned closer to the front surface 1820 than to the rear surface 1830) (hereinafter "CH2"), a golf club head comprising the turbulator arrangement 2200 including ridges similar to the ridges 2101-2106 (FIG. 63—having the ridge apex 2115 positioned closer to the rear edge 2117 than to the front edge 2111) (hereinafter "CH3"), and a golf club head comprising the turbulator arrangement 2300 and ridges similar to the ridges 2101-2106 (FIG. 64—having the ridge apex 2115 positioned closer to the rear edge 2117 than to the front edge 2111 with the front surface 2120 farther from 127 than the rear surface 2130) (hereinafter "CH4"). To simulate the swinging motion of a golf club, each club head was tested at orientation angles of 0 degrees (closed face), and 20 degrees. The angle is measured against a plane wherein the club face 102 of the club head is square or flat to a golf ball. Therefore, the 0 degree tests are simulating the club head at the point of impact while the 20 degree test simulates the club head during a portion of a swing. Finally, each of the club heads were tested at each of the above mentioned angles at different speeds (80 mph, 100 mph, 120 mph) to consider the different speeds at which users are able to swing the clubs. To ensure accuracy each of the tests were run in the same wind tunnel under the same controls and constraints.

Table 8 shows measured values of the aerodynamic drag expressed in lbf for the different orientation angles of the club head at 80 mph.

TABLE 8

| Orientation Angle | CH1 | CH2 | % Drag Reduction CH1-CH2 | CH3 | % Drag Reduction CH1-CH3 | CH4 | % Drag Reduction CH1-CH4 |
|---|---|---|---|---|---|---|---|
| 0° Face Angle | 0.674 | 0.440 | 42% | 0.557 | 19% | 0.360 | 61% |
| 20° Open Face Angle | 0.653 | 0.410 | 46% | 0.640 | 2% | 0.640 | 2% |

As can be seen from the results in table 8, at swing speeds of 80 mph, club heads including turbulators experience reduced drag force through the swinging motion compared to club heads devoid of turbulators. The greater the reduction in drag force, the less force required by the user to achieve or increase the club head speed which can result in increased swing speeds and longer ball travel distances. From table 8 it should be noted that at a closed face angle the turbulators of CH2, CH3 and CH4 drastically reduce the drag force experienced by the club heads. Specifically, the turbulators of CH2, CH3 and CH4 reduce the drag forces on the club head by 42%, 19% and 61%, respectively. Further, it should be noted, that at the 20 degree face angle and 80 mph, the turbulator of CH2 reduces the drag force on the club head by 46%, while the turbulators of CH3 and CH4 reduce the drag force on the club head by 2%.

Table 9 shows measured values of the aerodynamic drag expressed in lbf for the different orientation angles of the club head at 100 mph.

TABLE 9

| Orientation Angle | CH1 | CH2 | % Drag Reduction CH1-CH2 | CH3 | % Drag Reduction CH1-CH3 | CH4 | % Drag Reduction CH1-CH4 |
|---|---|---|---|---|---|---|---|
| 0° Face Angle | .964 | .571 | 51% | .830 | 15% | .493 | 65% |
| 20° Open Face Angle | 1.190 | .520 | 78% | 1.030 | 14% | 0.621 | 63% |

As can be seen from the results in table 9, at swing speeds of 100 mph, club heads including turbulators experience reduced drag force through the swinging motion compared to club heads devoid of turbulators. The greater the reduction in drag force, the less force required by the user to achieve or increase the club head speed which can result in increased swing speeds and longer ball travel distances. From table 9, it should be noted that at a closed face angle the turbulators of CH2, CH3 and CH4 drastically reduce the drag force experienced by the club heads. Specifically, the turbulators of CH2, CH3 and CH4 reduce the drag forces on the club head by 51%, 15% and 65%, respectively. Further, it should be noted, that contradicting to the results shown in table 8 at 80 mph, at the 20 degree face angle each of the turbulators of CH2, CH3, Ch4 drastically reduce the drag force experienced by the club heads. Specifically, the turbulators of CH2, CH3 and CH4 reduce the drag forces on the club head by 78%, 14% and 63%, respectively.

Table 10 shows measured values of the aerodynamic drag expressed in lbf for the different orientation angles of the club head at 120 mph.

TABLE 10

| Orientation Angle | CH1 | CH2 | % Drag Reduction CH1-CH2 | CH3 | % Drag Reduction CH1-CH3 | CH4 | % Drag Reduction CH1-CH4 |
|---|---|---|---|---|---|---|---|
| 0° Face Angle | 1.151 | .782 | 38% | 1.010 | 13% | .720 | 46% |
| 20° Open Face Angle | 1.542 | 0.872 | 56% | 1.586 | 3% | 0.896 | 53% |

As can be seen from the results in table 10, at swing speeds of 120 mph, club heads including turbulators experience reduced drag force through the swinging motion compared to club heads devoid of turbulators. The greater the reduction in drag force, the less force required by the user to achieve or increase the club head speed, which can result in increased swing speeds and longer ball travel distances. From table 10, it should be noted that at a closed face angle, the turbulators of CH2, CH3 and CH4 drastically reduce the drag force experienced by the club heads. Specifically, the turbulators of CH2, CH3 and CH4 reduce the drag forces on the club head by 38%, 13% and 46%, respectively. Further, it should be noted, that at the 20 degree face angle and 120 mph, the turbulators of CH2 and CH4 reduce the drag force on the club head by 56% and 53%, respectively, while the turbulator of CH2 reduces the drag force on the club head by 3%.

Example 1

In one exemplary embodiment, a golf club head comprises a club face, a rear opposite the club face, a heel end, a toe end opposite the heel end, a crown, a sole opposite the crown, and a leading edge. The crown comprise turbulators, wherein the turbulators are positioned from front to back within a third portion of the crown from the club face. The turbulators comprise a plurality of ridges. The ridges are curvilinear extending from a first end to a second end. The ridges are orientated such that they produce an angle relative to the leading edge of the golf club head.

Example 2

In another exemplary embodiment, a golf club head comprises a club face, a rear opposite the club face, a heel end, a toe end opposite the heel end, a crown, a sole opposite the crown, and a leading edge. The crown comprise turbulators, wherein the turbulators are positioned from front to back within a fourth portion of the crown from the club face. The turbulators comprise a plurality of ridges. The turbulators comprise at least two ridges of the plurality of ridge to be curvilinear extending from a first end to a second end, and at least one ridge of the plurality of ridges to be linear. The at least one ridge is angled relative to the leading edge of the golf club head.

Example 3

An exemplary golf club head 100 comprising a turbulator 3000 having a ridge apex 3015 positioned further from a leading edge 112 was compared to a similar control club head comprising a turbulator having a ridge apex positioned closer to the leading edge 112 (see Table 11). The ridge apex is defined as a maximum height of the ridge measured in a direction perpendicular from a base of the ridge. The turbulator 3000 of the exemplary golf club head 100 comprises a plurality of ridges 3001-3006 including the ridge apex 3015. The turbulator of the similar control club head comprises a plurality of ridges 1-6 including the ridge apex.

Table 11 compares the distance from the leading edge 112 to the ridge apex between the exemplary golf club head 100 with turbulator 3000 and the similar control club head with the turbulator. A test was conducted in an air tunnel comparing the exemplary golf club head 100 and the similar control club head for various club head speeds (e.g. 60 to 120 mph, see Tables 12 and 13) and various angles relative to the leading edge 112 (e.g. 0 degrees, 20 degrees, 40 degrees, see Tables 12 and 13). As illustrated in Table 11, the distances from the leading edge 112 to the ridge apex 3015 for each ridge of the turbulator 3000 of the exemplary golf club head 100 is approximately two times larger than the distances from the leading edge 112 to the ridge apex for each ridge of the turbulator of the similar control club head. As illustrated in Tables 12 and 13, the drag force increases as club head speed increases, where the increases in drag force for the turbulator 3000 of the exemplary golf club head 100 is on average lower than the increases in drag force for the turbulator of the similar control club head. Based on the distances from the leading edge 112 to the ridge apex for the ridges, the test resulted in the exemplary golf club head 100 with the turbulator 3000 having on average 5% less drag force on the crown 110 compared to the similar control club head with the turbulator. These results show that by increasing the distance between the ridge apex and the leading edge 112, the air flow separation distance 121 increases thereby delaying the separation of air flow towards the aft region 126 of the crown 110. The increased distance between the ridge apex 3015 and the leading edge 112 of the exemplary golf club head 100 provides the advantage of tripping the air flow later thereby reducing the drag force on the crown 110.

TABLE 11

| Ridge Apex Distance from the Leading Edge 12 (inch) | | | | | | |
|---|---|---|---|---|---|---|
| | 3001 | 3002 | 3003 | 3004 | 3005 | 3006 |
| Exemplary Golf Club 100 with Turbulator 3000 | 0.483 | 0.452 | 0.44 | 0.44 | 0.424 | 0.29 |
| | 1 | 2 | 3 | 4 | 5 | 6 |
| Control Golf Club with Turbulator | 0.21 | 0.194 | 0.186 | 0.18 | 0.19 | 0.136 |

TABLE 12

| Drag Force (lbf) at 0 Degrees | | | |
|---|---|---|---|
| Club Head Speed (mph) | 100 | 110 | 120 |
| Exemplary Golf Club 100 with Turbulator 3000 | 0.53 | 0.68 | 0.78 |
| Control Golf Club with Turbulator | 0.7 | 0.79 | 0.9 |

TABLE 13

| Drag Force (lbf) at 40 Degrees | | | |
|---|---|---|---|
| Club Head Speed (mph) | 100 | 110 | 120 |
| Exemplary Golf Club 100 with Turbulator 3000 | 1.1 | 1.3 | 1.58 |
| Control Golf Club with Turbulator | 1.19 | 1.5 | 1.61 |

Any reference made herein to certain parts of a golf club head such as a face, a rear, a heel or heel end, a toe or toe end, a crown and a sole of a golf club head may refer to portions of the golf club head that generally represent those parts.

Although a particular order of actions is described above for making turbulators or club heads with turbulators, these actions may be performed in other temporal sequences. For example, two or more actions described above may be performed sequentially, concurrently, or simultaneously. Alternatively, two or more actions may be performed in reversed order. Further, one or more actions described above may not be performed at all. The apparatus, methods, and articles of manufacture described herein are not limited in this regard.

Although certain example systems, methods, apparatus, and articles of manufacture have been described herein, the scope of coverage of this disclosure is not limited thereto. On the contrary, this disclosure covers all systems, methods, apparatus, and articles of manufacture fairly falling within the scope of the appended claims either literally or under the doctrine of equivalents.

The invention claimed is:

1. A golf club head comprising:

a crown, a sole, a toe end, a heel end, a face portion defining a loft plane, a rear portion, and a leading edge between the face portion and the crown; and a turbulator including a plurality of ridges disposed on the crown, wherein each ridge of the plurality of ridges includes:

a base positioned directly adjacent to the crown;

a top surface opposite the base of the ridge;

a ridge apex defined as a maximum height of the ridge measured in a direction perpendicular from the base of the ridge;

a front surface comprises a first end closest to the face portion and a second end closest to the ridge apex; and a rear surface defining a portion of the ridge being closest to the rear portion of the golf club head, extending from behind the ridge apex towards the rear portion of the golf club head;

wherein:

the turbulator is positioned between the face portion and an apex of the crown;

the turbulator is positioned entirely within a forward two-fifths portion of the crown in a front end to a rear end direction;

the front surface defines a portion of the ridge being closest to the face portion, extending from near the face portion towards the rear portion of the golf club head; and the ridge apex of each ridge of the plurality of ridges is positioned within a first 50% of a ridge length;

the apex of the crown is located in a front region of the crown rearward of the leading edge and along a centerline extending from the front end to the rear end of the golf club head.

2. The golf club head of claim 1, wherein the front surface is angled from the loft plane, where the angle comprises a range from 87 degrees to 100 degrees.

3. The golf club head of claim 1, wherein the plurality of ridges extends in a direction substantially perpendicular to the face portion.

4. The golf club head of claim 1, wherein the ridge apex of each ridge of the plurality of ridges is positioned within a first 35% of the ridge length.

5. The golf club head of claim 1, wherein the ridge length is substantially greater than a ridge width, wherein the ridge width is defined as extending in a direction from the heel end to the toe end.

6. The golf club head of claim 1, wherein the top surface extending between the front surface and the rear surface, the top surface having a width extending in a direction from the heel end to the toe end of the golf club head.

7. The golf club head of claim 6, wherein the base extends an entire length of the ridge in a direction from the front surface to the rear surface of the ridge; and the base having a width extending in a direction from the heel end to the toe end of the golf club head, wherein the width of the top surface is at least 50-90% of the width of the base.

8. The golf club head of claim 1, wherein the plurality of ridges is selected from the group consisting of: at least 2 ridges, at least 3 ridges, at least 4 ridges, at least 5 ridges, and at least 6 ridges.

9. The golf club head of claim 8, wherein the first end of the front surface is positioned on the leading edge.

10. The golf club head of claim 1, wherein: at least a pair of ridges are separate and spaced apart to define a space between the pair of ridges, and each ridge, of the pair of ridges, extends between the heel end and the toe end to define a width and extends between the face portion and the rear portion to define a length; the length is substantially greater than the width for the pair of ridges; the space between the pair of ridges is substantially greater than the width of each of an adjacent pair of ridges that define the space.

11. A golf club head comprising:

a crown, a sole, a toe end, a heel end, a face portion, a rear portion, a loft plane, and a leading edge between the face portion and the crown; and a turbulator including a plurality of ridges disposed on the crown, wherein each ridge of the plurality of ridges includes:

a base positioned directly adjacent to the crown;

a top surface opposite the base of the ridge;

a ridge apex defined as a maximum height of the ridge measured in a direction perpendicular from the base of the ridge;

a front surface comprises a first end closest to the face portion and a second end closest to the ridge apex; and a rear surface defining a portion of the ridge being closest to the rear portion of the golf club head, extending from behind the ridge apex towards the rear portion of the golf club head; wherein:

the front surface defines a portion of the ridge being closest to the face portion, extending from near the face portion towards the rear portion of the golf club head;

the turbulator is positioned between the face portion and an apex of the crown;

the turbulator is positioned entirely within a forward two-fifths portion of the crown in a front end to a rear end direction;

the apex of the crown is located in a front region of the crown rearward of the leading edge and along a centerline extending from the front end to the rear end of the golf club head.

12. The golf club head of claim 11, wherein the front surface is angled from the loft plane, where the angle comprises a range from 87 degrees to 100 degrees.

13. The golf club head of claim 11, wherein the ridge apex of each ridge of the plurality of ridges is positioned within a first 50% of a ridge length.

14. The golf club head of claim 11, wherein each ridge of the plurality of ridges comprises:

a pair of side walls extending from the base to the top surface, and wherein each side wall tapers towards the top surface at an angle of no less than 60 degrees.

15. The golf club head of claim 11, wherein the top surface extending between the front surface and the rear surface, the top surface having a width extending in a direction from the heel end to the toe end of the golf club head.

16. The golf club head of claim 15, wherein the base extends an entire length of the ridge in a direction from the front surface to the rear surface of the ridge; and the base having a width extending in a direction from the heel end to the toe end of the golf club head, wherein the width of the top surface is at least 50-90% of the width of the base.

17. The golf club head of claim 11, wherein the plurality of ridges is selected from the group consisting of: at least 2 ridges, at least 3 ridges, at least 4 ridges, at least 5 ridges, and at least 6 ridges.

18. The golf club head of claim 11, wherein the leading edge comprises a leading edge plane forming a leading edge angle with the loft plane, wherein the first end of the front surface of each ridge of the plurality of ridges being at least partly located between the leading edge plane and the rear portion, but not extending beyond the leading edge plane.

19. The golf club head of claim 18, wherein the first end of the front surface is positioned on the leading edge.

20. The golf club head of claim 11, wherein:

a pair of ridges are separate and spaced apart to define a space between the pair of ridges, and each ridge, of the pair of ridges, extends between the heel end and the toe end to define a width and extends between the face portion and the rear portion to define a length; the length is substantially greater than the width for each ridge of the pair of ridges; the space between the pair of ridges is substantially greater than the width of each of an adjacent pair of ridges that define the space.

* * * * *